US007026109B2

(12) United States Patent
Ohzeki et al.

(10) Patent No.: US 7,026,109 B2
(45) Date of Patent: Apr. 11, 2006

(54) PHOTOTHERMOGRAPHIC MATERIAL

(75) Inventors: Tomoyuki Ohzeki, Kanagawa (JP); Hiroyuki Mifune, Kanagawa (JP); Tadashi Inaba, Kanagawa (JP); Kohzaburoh Yamada, Kanagawa (JP); Katsuyuki Watanabe, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/633,253

(22) Filed: Aug. 4, 2003

(65) Prior Publication Data

US 2004/0033454 A1 Feb. 19, 2004

(30) Foreign Application Priority Data

Aug. 16, 2002 (JP) ..... 2002-237328
Dec. 27, 2002 (JP) ..... 2002-378994

(51) Int. Cl.
*G03C 1/498* (2006.01)
*G03C 1/37* (2006.01)

(52) U.S. Cl. ..... 430/619; 430/600; 430/603; 430/607; 430/611; 430/613; 430/614

(58) Field of Classification Search ..... 430/619, 430/600, 603, 607, 611, 613, 614, 264
See application file for complete search history.

(56) References Cited

U.S. PATENT DOCUMENTS 4,332,889 A * 6/1982 Siga et al. ..... 430/583
4,334,010 A * 6/1982 Mifune et al. ..... 430/551
5,968,725 A * 10/1999 Katoh et al. ..... 430/619
6,033,823 A * 3/2000 Van Der Laan et al. .... 430/230
6,090,538 A * 7/2000 Arai et al. ..... 430/619
6,120,983 A * 9/2000 Okada et al. ..... 430/619

FOREIGN PATENT DOCUMENTS

JP A 2002-323729 11/2002

* cited by examiner

*Primary Examiner*—Thorl Chea
(74) *Attorney, Agent, or Firm*—Margaret A. Burke; Sheldon J. Moss

(57) ABSTRACT

The present invention provides a photothermographic material, comprising a photosensitive silver halide, a non-photosensitive organic solvent salt, a reducing agent for a silver ion, and a binder on one face of a support, for being applied by using an organic solvent, the photothermographic material further comprising at least one compound selected from the group of compounds consisting of: a compound represented by the following general formula (1), a compound having a β-lactam ring, a compound having a group that is adsorptive to a silver halide and a group that reduces a silver halide and a precursor thereof:

General formula (1)

7 Claims, No Drawings

PHOTOTHERMOGRAPHIC MATERIAL

CROSS-REFERENCE TO RELATED APPLICATION

This application claims priority under 35 USC 119 from Japanese patent Application Nos. 2002-237328 and 2002-378994, the disclosure of which is incorporated by reference herein.

BACKGROUND OF THE INVENTION

1. Field of the Invention

The present invention relates to photothermographic materials and, particularly, to a photothermographic material favorably used in medical diagnosis, industrial photograph, printing, and COM. Further, the present invention relates to the photothermographic material, suitable for laser exposure and favorably applied to medical images, photographic printing plates or the like, which is excellent in storage stability with passage of time and image storage stability. In particular, the present invention relates to the photothermographic material appropriate for blue-color laser exposure and red to infrared laser exposure.

2. Description of the Related Arts

In recent years, a dry photographic development process is strongly desired in the fields of medical diagnosis and printing plate-making from the standpoints of environmental preservation and space saving. In these fields, digitalization is progressing whereupon a system in which image information is inputted to a computer, stored, optionally processed, transmitted to a place where an image is required by communications, outputted to a photosensitive material by a laser image setter or a laser imager, and the photosensitive material is developed to form an image at the place, is rapidly spreading. As for the photosensitive materials, capability of recording by laser exposure of high illuminance and forming a clear black image having high resolution and sharpness is required. As for such digital imaging recording materials, various types of hard copy systems utilizing a pigment or a dye, such as an ink jet printer and an electronic photographic system, are distributed as an ordinary image-forming system. However, none of the hard copy systems is satisfactory in regard to image qualities (sharpness, graininess, gradation, and color tone) which decide diagnostic performance as an image for use in the medical use and recording speed (sensitivity). Thus none of the hard copy systems has attained a level which can replace a conventional wet-development-type silver salt film for medical use.

On the other hand, thermally developable image forming systems utilizing an organic silver salt are described in, for example, U.S. Pat. Nos. 3,152,904, and 3,457,075 and D. Klosterboer, "Thermally Processed Silver Systems" (see, Imaging Processes and Materials, Neblette, 8th Ed. compiled by Sturge, V. Walworth and A. Shepp, Chap. 9, page 279, 1989). In particular, the photothermographic material comprises a photosensitive layer in which a photosensitive silver halide, a reducing agent, a reducible silver salt (for example, organic silver salt) and, optionally, a toning agent for controlling color tone of silver are ordinarily dispersed in a binder matrix.

When the photothermographic material is heated at a high temperature (for example, 80° C. or more) after being exposed imagewise, a monochromatic black silver image is produced by an redox reaction between the silver halide or the reducible silver salt (functioning as an oxidizing agent) and the reducing agent. The redox reaction is accelerated by a catalytic action of a latent image of the silver halide generated by such exposure. Therefore, the monochromatic silver images are formed in exposed areas of the material. Such photothermographic materials are disclosed in many references other than those described above (see, for example, U.S. Pat. No. 2,910,377 and Japanese Patent Publication (JP-B) No. 43-4924).

In the above-described photothermographic material, a polymer which has a glass transition point in a temperature region lower than that of a thermal development temperature is used as a binder.

As for laser light according to the invention, a gas laser ($Ar^+$, He—Ne, or He—Cd), a YAG laser, a dye laser, a semiconductor laser and the like are ordinarily used. Further, a combination of the semiconductor laser with a second harmonic generating element or the like can also be used. As for light-emission wavelengths, lasers in a wide range of wavelength regions of from a blue region to an infrared region are used. Among other things, an infrared semiconductor laser is low in price and can obtain a consistent light emission whereby it is appropriate for designing a laser image output system which is compact, easy in manipulation, convenient and needs no particular choice of location to be placed in. For this account, infrared sensitivity is required for the photothermographic material and, accordingly, various kinds of studies have been made for enhancing the infrared sensitivity. Infrared spectral sensitization, however, has a problem that it is unstable and liable to be decomposed during a storage period of the photosensitive material to decrease sensitivity thereof whereupon not only enhancement of sensitivity but also improvement of storage stability thereof have been required.

In recent years, a blue semiconductor laser has been developed whereupon, since it becomes possible to perform ultra-fine image recording, attain an increase of recording density and obtain a long-life and consistent output, it is expected that demand for the blue semiconductor laser will be increased and, according, the photothermographic material corresponding thereto is required.

In the photothermographic material, a photosensitive silver halide remains in a film even after development is performed and, at the same time, an undeveloped organic silver salt remains therein. Further, since all materials necessary for development are previously contained in the film and remain therein even after the development is performed, when an image generated by the development is exposed to light or stored at a high temperature, fog is increased or an additional development proceeds whereupon image densities are changed, or silver color tones are changed, thereby causing a serious problem in storage stability of the image.

It is found that, when silver iodide is used as a photosensitive silver halide in the photothermographic material, storage properties of an optical image are improved; however, sensitivity thereof is lower than that in a case of using silver bromide, or silver iodobromide having a low iodine content.

As a way for increasing sensitivity of a silver iodide photographic emulsion, it is recited in scientific literatures and the like that sensitization is performed by addition of halogen receptors such as sodium nitrite, pyrogallol, and hydroquinone to the emulsion, immersion in a silver nitrate aqueous solution, or sulfur sensitization at pAg 7.5 (see, for example, The Journal of Photographic Science, Vol. 8, page 119 (1960), ibid. Vol. 28, page 163 (1980), or Photographic Science and Engineering, Vol. 5, page 216 (1961)). However, a sensitizing effect by these halogen receptors in the photothermographic material, that is a theme of the invention, is very small, thus, extremely unsatisfactory. On this account, development of a technique which is capable of substantially enhancing the sensitivity of the photothermographic material which contains silver iodide having a high iodine content has ardently been desired.

Particularly, in the photothermographic material which uses an organic solvent as a coating solvent, since the organic solvent inhibits adsorption of various kinds of chemical sensitizers to silver halide grains, a sensitization effect can not be fully exerted. Thus, it has been a difficult problem to realize high sensitivity.

SUMMARY OF THE INVENTION

An object of the present invention is to solve various types of above-described conventional problems and to provide a photothermographic material which has sufficient sensitivity for laser exposure, can rapidly be developed to obtain a high image density and is excellent in storage stability of an image. Particularly, an object of the invention relates to improvements of such features of an organic solvent coating-type photothermographic material.

It has been found that the above-described object of the invention is achieved by following techniques.

The first aspect of the invention provides a photothermographic material (W) comprising, on one surface of a support, a photosensitive silver halide, a non-photosensitive organic silver salt, a reducing agent for a silver ion, and a binder, which are applied to the support using an organic solvent, wherein the photothermographic material further comprises at least one compound selected from the group of compounds consisting of a compound represented by the following general formula (1), a compound having a β-lactam ring, and a compound having a group that is adsorptive to a silver halide and a group that reduces a silver halide, or a precursor of the compound having a group that is adsorptive to a silver halide and a group that reduces a silver halide:

General formula (1)

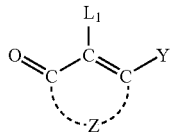

wherein in general formula (1),

Y represents a hydroxyl group or an —$NL_2L_3$ group, in which $L_2$ and $L_3$ may be same as or different from each other and each independently represent a hydrogen atom, an alkyl group, or an aryl group;

$L_1$ represents a sulfur-containing saturated heterocyclic residue, an alkyl group, an aryl group, or a hydrogen group, a group represented by -A-S-B in which A represents an alkylene group and B represents a hydrogen atom, an alkyl group, or an aryl group; and Z represents an atomic group required for forming a 5- or 6-membered carbon ring which may have a substituent.

The second aspect of the invention provides a photothermographic material (W), wherein a content of silver iodide in the photosensitive silver halide is from 40% by mol to 100% by mol.

The third aspect of the invention provides a photothermographic material (W), wherein an average grain diameter of the photosensitive silver halide is from 5 nm to 80 nm.

The fourth aspect of the invention provides a photothermographic material (W), wherein $L_1$ in the general formula (1) represents a sulfur-containing saturated heterocyclic residue or a group represented by -A-S-B.

The fifth aspect of the invention provides a photothermographic material (W), wherein Z in the general formula (1) represents an atomic group required for forming a 6-membered carbon ring.

The sixth aspect of the invention provides a photothermographic material (W), wherein Y in the general formula (1) represents a hydroxyl group.

The seventh aspect of the invention provides a photothermographic material (W), wherein the compound having a β-lactam ring is a penicillin or a cephalosporin.

The eighth aspect of the invention provides a photothermographic material (W), wherein the compound having a β-lactam ring is a penicillin or a cephalosporin, the penicillin is represented by the following general formula (2), and the cephalosporin is represented by the following general formula (3):

General formula (2)

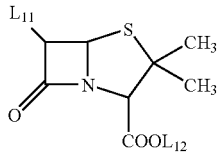

General formula (3)

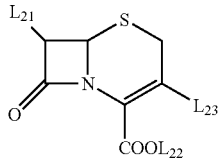

wherein in general formulae (2) and (3), $L_{11}$ and $L_{21}$ each independently represent an amino group or a substituted amino group;

$L_{12}$ and $L_{22}$ each independently represent a hydrogen atom, an alkaline metal ion, a quaternary ammonium ion, a hydrocarbon, or a heterocyclic residue; and $L_{23}$ represents a hydrogen atom, a halogen atom, an amino group, a hydroxyl group, a mercapto group, an alkyl group, an alkoxy group, an aryloxy group, an alkylthio group, an arylthio group, an acyloxy group, an acylthio group, a formyl group, or a heterocyclic residue.

The ninth aspect of the invention provides a photothermographic material (W), wherein the compound having a P-lactam ring is a penicillin or a cephalosporin, the penicillin is represented by the general formula (2), the cephalosporin is represented by the general formula (3), and in the general formulae (2) and (3), $L_{11}$ and $L_{21}$ each independently represent an amino group or an acylamino group;

$L_{21}$ and $L_{22}$ each independently represent a hydrogen atom, an alkaline metal ion, or an ammonium ion; and $L_{23}$ represents a non-substituted or substituted alkyl group.

The tenth aspect of the invention provides a photothermographic material (W), wherein the compound having a group that is adsorptive to a silver halide and a group that reduces a silver halide is a compound represented by the following general formula (4):

E-(W)n-F General formula (4)

wherein in general formula (4),

E represents an atomic group containing a group that can be adsorbed to a silver halide;

W represents a divalent linking group;

n represents 0 or 1; and

F represents a reducing group.

The eleventh aspect of the invention provides a photothermographic material (W), wherein the compound having a group that is adsorptive to a silver halide and a group that reduces a silver halide is a compound represented by the general formula (4), and the group that can be adsorbed to a silver halide in the general formula (4) is a mercapto group, a thione group, or a group that generates an imino silver.

The twelfth aspect of the invention provides a photothermographic material (W), wherein the compound having a group that is adsorptive to a silver halide and a group that reduces a silver halide is a compound represented by the general formula (4), and the group that can be adsorbed to a silver halide in the general formula (4) is a mercapto group.

The thirteenth aspect of the invention provides a photothermographic material (W), wherein the compound having a group that is adsorptive to a silver halide and a group that reduces a silver halide is a compound represented by the general formula (4), and the group that can be adsorbed to a silver halide in the general formula (4) is a group derived from a member selected from the group consisting of hydroxylamines, hydroxamic acids, hydroxyureas, hydroxysemicarbazides, phenols, hydrazines, hydrazides, and 3-pyrazolidones.

The fourteenth aspect of the invention provides a photothermographic material (W), wherein the compound having a group that is adsorptive to a silver halide and a group that reduces a silver halide is a compound represented by the general formula (4), and the group that can be adsorbed to a silver halide in the general formula (4) is a group derived from a member selected from the group consisting of hydroxyureas, hydroxysemicarbazides, phenols, hydrazides, and 3-pyrazolidones.

The fifteenth aspect of the invention provides a photothermographic material (W), wherein the precursor is a compound which generates a mercapto group.

The sixteenth aspect of the invention provides a photothermographic material (W), wherein the precursor is a thiazolium, a thiazoline, a thiazolidine, or a disufide.

The seventeenth aspect of the invention provides a photothermographic material (W), wherein the precursor is a thiazolium having a triple bond on a substituent.

The eighteenth aspect of the invention provides a photothermographic material (W), wherein an average grain size of the photosensitive silver halide is from 5 nm to 50 nm.

The nineteenth aspect of the invention provides a photothermographic material (W), wherein a content of silver iodide in the photosensitive silver halide is from 90% by mol to 100% by mol.

The twentieth aspect of the invention provides a photothermographic material (W) comprising, as the binder, polyvinyl butyral in an amount of 50% by weight to 100% by weight based on a total binder component in a photosensitive layer which is provided on the support.

DETAILED DESCRIPTION OF THE INVENTION

Hereinafter, the present invention will be described in detail.

1. Photothermographic Material

A photothermographic material according to the invention comprises, on at least one surface of a support, an image-forming layer containing an infrared-sensitized photosensitive silver halide in which a content of silver iodide is in the range of from 40% by mol to 100% by mol, a non-photosensitive organic silver salt, a reducing agent, and a binder. The image-forming layer may be constituted by a monolayer or a plurality of layers. Further, the photothermographic material according to the invention may comprise an intermediate layer, or a surface protection layer on the image-forming layer, or a back layer or a back protection layer on an opposite face of the support. The image-forming layer, or a layer adjacent thereto contains at least one compound selected from the group of compounds consisting of: a compound represented by the general formula (1), a compound having a β-lactam ring, a compound having a group that is adsorptive to a silver halide and a group that reduces a silver halide, and a precursor thereof.

A constitution of these layers and favorable components thereof will be described in detail below.

1-1. Image-Forming Layer

1-1-1. Compound Represented by General Formula (1) and Compound having β-Lactam Ring First, the compound of the general formula (1) of the invention is described in detail.

General formula (1)

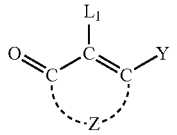

In the general formula (1), Y represents a hydroxyl group or an —$NL_2L_3$ group, wherein $L_2$ and $L_3$ may be same with or different from each other and each independently represent a hydrogen atom, an alkyl group, or an aryl group;

$L_1$ represents a sulfur-containing saturated heterocyclic residue, a group represented by -A-S-B (wherein A represents an alkylene group; B represents at least one member selected from the group consisting of: a hydrogen atom, an alkyl group and an aryl group), an alkyl group, an aryl group, or a hydrogen group; and Z represents an atomic group necessary for forming a 5- or 6-membered carbon ring which may contain a substituent.

Next, the general formula (1) is described in detail.

In the general formula (1), Y represents a hydroxyl group or an —$NL_2L_3$ group. $L_2$ and $L_3$ may be same with or different from each other and each independently represent a hydrogen atom, an alkyl group (preferably having 1 to 5 carbon atoms, such as a methyl group, an ethyl group and a butyl group), or an aryl group (preferably, a phenyl group) whereupon, preferably, one of $L_2$ and $L_3$ represents a hydrogen atom.

The term "sulfur-containing saturated heterocyclic residue represented by $L_1$" as used herein is intended to include a saturated heterocyclic residue containing at least one sulfur atom as one of ring-constituting atoms and, preferably, a saturated heterocyclic residue in which the number of atoms constituting the ring is 5, or 6 including a sulfur atom and, also, a carbon atom adjacent to the sulfur atom is bonded to a carbon atom of a carbon ring of a compound represented by the general formula (1). Specific examples thereof include a 2-tetrahydrothienyl group and a 2-tetrahydrothiopyranyl group. The heterocyclic residue may have a substituent such as a methyl group, an ethyl group, a methoxy group, and an acetoamide group.

As for alkylene groups represented by A in a group represented by -A-S-B for $L_1$, for example, a methylene group is mentioned. As for alkyl groups represented by B, those having from 1 to 12 carbon atoms is preferable and examples thereof include a methyl group and an ethyl group. Further, as for aryl groups represented by B, a phenyl group is preferable. Specific examples of groups represented by -A-S-B include a mercaptoethyl group, an ethylthiomethyl group, a dodecylthiomethyl group and a phenylthiomethyl group.

As for alkyl groups represented by $L_1$, for example, a methyl group and an ethyl group are mentioned while, as for aryl groups, for example, a phenyl group is mentioned.

As for $L_1$, a sulfur-containing saturated heterocyclic residue and a group represented by -A-S-B are preferable and the sulfur-containing saturated heterocyclic residue is particularly preferable.

In the general formula (1), Z represents an atomic group necessary for forming a 5-, or 6-membered carbon ring and specific examples thereof include a group forming a cyclopentene or cyclohexene ring. Such carbon ring may contain at least one substituent on Z whereupon examples of such substituents include an alkyl group (such as a methyl group, and an ethyl group), and an aryl group (such as a phenyl group, a p-tolyl group, a p-methoxyphenyl group, and a 3,4-dichlorophenyl group).

The compound represented by the general formula (1) can take a structure of a 1,3-dione tautomer, when Y represents a hydroxyl group. Also, it can take a structure of a 1-imino-3-one tautomer, when Y represents $NL_2L_3$ in which at least one of $L_2$ and $L_3$ represents a hydrogen atom.

Further, the compound represented by the general formula (1) may be used in a form of a proper inorganic salt such as a hydrochloride, and a sulfate or a proper organic salt such as an acetate.

As for synthesis of the compound represented by the general formula (1), description in JP-B No. 60-24459 can be referenced.

Specific examples of such compounds represented by the general formula (1) according to the invention are as follows:

I-1

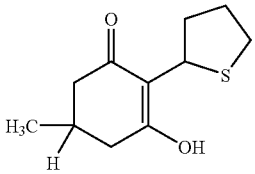

I-2

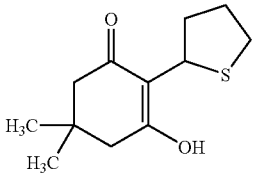

I-3

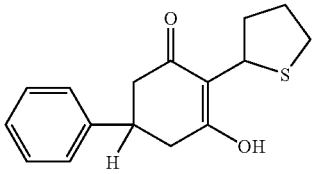

-continued

I-4

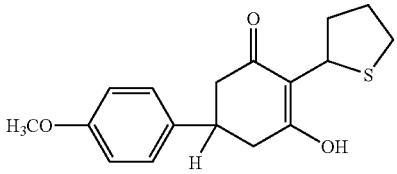

I-5

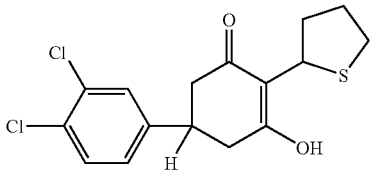

I-6

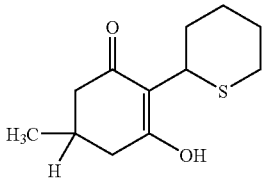

I-7

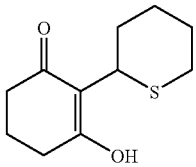

I-8

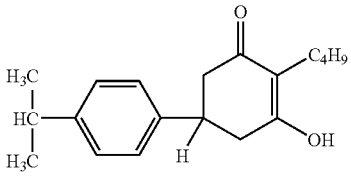

I-9

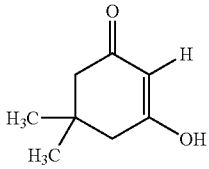

I-10

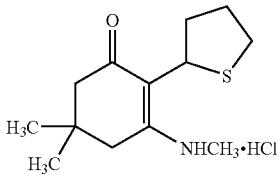

I-11

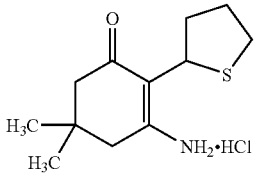

-continued

I-12

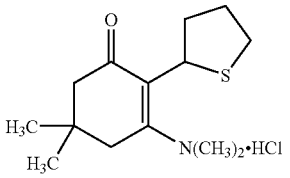

I-13

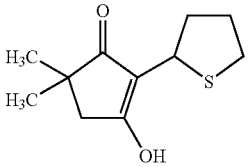

I-14

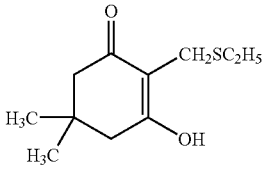

I-15

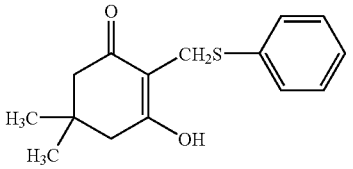

I-16

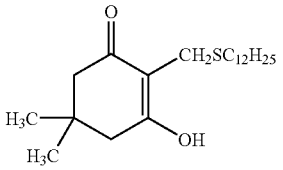

Next, the compound having a β-lactam ring according to the invention will be explained.

The term "compound having a β-lactam ring" as used herein is intended to include so-called antibiotics each having a β-lactam ring in the molecule such as penicillins, cephalosporins, norcadicins, oxapenams, and carbapenems in which penicillins and cephalosporins are, particularly, preferable representative compounds thereamong. Preferable penicillins and cephalosporins according to the invention can be represented by the following general formulae (2) and (3), respectively:

General formula (2)

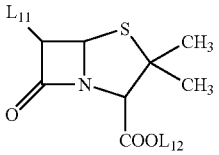

-continued

General formula (3)

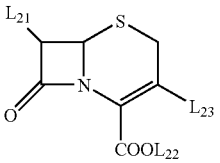

wherein $L_{11}$ and $L_{21}$ each independently represent an amino group or a substituted amino group (for example, an acylamino group, an alkoxycarbonylamino group, or an aryloxycarbonylamino group);

$L_{12}$ and $L_{22}$ each independently represent one selected from the group consisting of: a hydrogen atom, an alkaline metal ion (for example, a sodium ion, or a potassium ion), a quaternary ammonium ion (for example, an ammonium ion, or a tetramethylammonium ion), and a hydrocarbon or heterocyclic residue (for example, a methyl group, an ethyl group, a benzyl group, a phthalimidomethyl group, or a succinimidomethyl group); and $L_{23}$ represents one selected from the group consisting of: a hydrogen atom, a halogen atom (for example, a chlorine atom), an amino group, a hydroxyl group, a mercapto group, an alkyl group (for example, a methyl group), an alkoxy group (for example, an ethoxy group), an aryloxy group (for example, a phenoxy group), an alkylthio group (for example, a methylthio group), an arylthio group (for example, a phenylthio group), an acyloxy group (for example, an acetoxy group), an acylthio group (for example, an acetylthio group), a formyl group, and a heterocyclic residue (for example, a pyridinio group).

Particularly, $L_{11}$, and $L_{21}$ each preferably represent an amino group or an acylamino group; $L_{21}$, and $L_{22}$ each preferably represent a hydrogen atom, an alkaline metal ion, or an ammonium ion; and $L_{23}$ preferably represents a non-substituted or substituted alkyl group.

As for preferable penicillins and synthesis methods thereof, and preferable cephalosporins and synthesis methods thereof that can be used in the invention, JP-B No. 59-30259, and JP-B No. 59-30258 can be referenced, respectively.

Next, specific examples of such penicillins will be described below.

2-1. 6-aminopenicillinic acid 2-2. penicillin G 2-3. penicillin X 2-4. penicillin K 2-5. penicillin V 2-6. 6-piperazinomethylene aminopenicillanic acid 2-7. phenoxymethyl penicillin 2-8. methicillin 2-9. ampicillin 2-10. carbenicillin 2-11. ciclacillin 2-12. sulbenicillin 2-13. amoxicillin 2-14. piperacillin 2-15. 6-propylthioacetylaminopenicillanic acid Next, specific examples of such cephalosporins will be described below.

3-1. 7-aminocephalosporan
3-2. deacetylcephalosporin C
3-3. cephaloridine
3-4. cephalocin
3-5. cephalexin
3-6. 7-(5-carboxy-5-phthalimidamide)cephalosporanic acid
3-7. cephacetrile
3-8. cefsulodine
3-9. cephazolin
3-10. 7-pyperidinomethylene aminocephalosporanic acid
3-11. 7-acetamido-3-acetoxymethylceph-3-em-4-carboxylic acid
3-12. sodium 3-acetoxymethyl-7-[[2-(2,6-dimethyl phenylamino)thiazole-4-yl]acetamido]ceph-3-em-4-carboxylate A compound represented by the general formula (1) and a compound having a β-lactam ring may either be added singly or in combination.

An amount of the compound represented by the general formula (1) or the compound having a β-lactam ring to be used can be, though varying according to silver halide grains to be used, in the range of from $10^{-6}$ mol to 1 mol, preferably in the range of from $10^{-5}$ mol to $10^{-1}$ mol from the standpoint of performance and cost, and more preferably in the range of approximately from $10^{-4}$ mol to $10^{-2}$ mol, per 1 mol of silver halide.

The compound represented by the general formula (1) and the compound having a β-lactam ring to be used can be added after being dissolved in a coating solvent or an appropriate solvent miscible with the coating solvent, which does not give an adverse effect to photographic characteristics and selected among organic solvents, for example, alcohols, glycols, ketones, esters, or amides.

Timing of addition of the compound represented by the general formula (1) or the compound having a β-lactam ring may be any time in a period of from after formation of a grain of silver halide emulsion to immediately before a coating operation, preferably in the period of from before start of chemical sensitization to immediately before the coating operation, and more preferably immediately before the coating operation.

1-1-2. Compound Having a Group that is Adsorptive to a Silver Halide and a Group that Reduces a Silver Halide According to the invention, it is preferable that an adsorptive redox compound having a group that is adsorptive to a silver halide and a group that reduces a silver halide is contained in the molecule. The adsorptive redox compound is preferably a compound represented by the following general formula (4):

$$E\text{-}(W)n\text{—}F \qquad \text{General formula (4)}$$

wherein E represents a group adsorptive to a silver halide (hereinafter also referred to as "adsorptive group");

W represents a divalent linking group;

n represents 0 or 1; and

F represents a reducing group.

Next, the general formula (4) will be described in detail.

In the general formula (4), an adsorptive group represented by E is a group which is directly adsorbed to a silver halide or a group which promote adsorption to the silver halide whereupon specific examples of such adsorptive groups include; a heterocyclic group having at least one member selected from the group consisting of a mercapto group (or a salt thereof), a thione group (—C(═S)—), a nitrogen atom, a sulfur atom, a selenium atom, and a tellurium atom; a sulfide group; a disulfide group; a cationic group; and an ethynyl group.

In the general formula (4), a mercapto group (or a salt thereof) as an adsoptive group represented by E is not limited to a mercapto group (or a salt thereof) itself but also can be a heterocyclic group, an aryl group and an alkyl group preferably substituted with at least one mercapto group (or a salt thereof). The term "heterocyclic group" as used herein is intended to include an aromatic or non-aromatic heterocyclic group which is a monocycle or condensed ring of at least from 5 to 7 members whereupon examples of such heterocyclic groups include an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, and a triazine ring group and, further, they may include a heterocyclic group having a quaternized nitrogen atom; here, a substituted mercapto group may be dissociated to be a mesoion whereupon examples of such heterocyclic groups include an imidazolium ring group, a pyrazolium ring group, a thiazolium ring group, a triazolium ring group, a tetrazolium ring group, a thiadiazolium ring group, a pyridinium ring group, a pyrimidinium ring group, and a triazinium ring group and, among them, a triazolium ring group (for example, 1,2,4-triazolium-3-thiolate ring group) is preferable. As for an aryl group, mentioned is a phenyl group or a naphthyl group. As for an alkyl group, mentioned is a linear, branched, or cyclic alkyl group having from 1 to 30 carbon atoms. When a mercapto group forms a salt, examples of counter-ions include a cation ($Li^+$, $Na^+$, $K^+$, $Mg^{2+}$, $Ag^+$, $Zn^{2+}$ or the like) of such as an alkaline metal, an alkaline earth metal, or a heavy metal, an ammonium ion, a heterocyclic group having a quaternized nitrogen atom, a phosphonium ion, and the like.

A mercapto group as an adsorptive group may, further, be tautomerized to be a thione group whereupon specific examples thereof include a group which contains a thioamide group (in this case, a —C(═S)—NH— group), or a partial structure of the thioamide group, namely, a chain, or cyclic group selected from thioamide group, a thioureido group, a thiourethane group, a dithiocarbamic acid ester group, and the like. In this case, examples of such cyclic groups include a thiazolidine-2-thione group, an oxazolidine-2-thione group, a 2-thiohydantoin group, a rhodanine group, an isorhodanine group, a thiobarbituric acid group, and a 2-thioxo-oxazolidine-4-one group.

In the general formula (4), a thione group as an adsorptive group represented by E include not only a thione group formed by tautomerizing the above-described mercapto group, but also a chain or cyclic thioamido group, thioureido group, thiourethane group, and dithiocarbamic acid ester group each of which can not be tautomerized into the mercapto group (because of an absence of hydrogen atom on an α-position of the thione group).

In the general formula (4), a heterocyclic group having at least one atom selected from the group consisting of a nitrogen atom, a sulfur atom, a selenium atom, and a tellurium atom as an adsorptie group represented by E is a nitrogen-containing heterocyclic group having an —NH— group capable of forming an imino silver (>NAg) as a partial structure of a heterocycle, or a heterocyclic group having an —S— group, an —Se— group, a —Te— group, or an ═N— group capable of being coordinated to a silver ion by a coordinate bond as a partial structure whereupon examples of the former groups include a benztriazole group, a triazole group, an indazole group, a pyrazole group, a tetrazole group, a benzimidazole group, an imidazole group, a purine group, while examples of the latter groups include a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, and a benzotellurazole group. The former groups are preferred.

In the general formula (4), a sulfide group or disulfide group as an adsorptive group represented by E is intended to include all groups having an —S— group or an —S—S— group as a partical structure; however, a group having an alkyl (or alkylene)-X-alkyl (or alkylene) group, an aryl (or arylene)-X-alkyl (or alkylene) group, or an aryl (or arylene)-X-aryl (or arylene) group as a partial structure is preferable, in which X represents an —S— group or an —S—S— group. Further, these sulfide or disulfide groups may each form a ring structure whereupon specific examples of those forming a ring structure include a thiolan ring, a 1,3-dithiolan ring, a 1,2-dithiolan ring, a thian ring, a dithian ring, and a thiomorpholine ring. Particularly preferably as a sulfide group, mentioned is a group having an alkyl (or alkylene)-S-alkyl (or alkylene) as a partial structure, while particularly preferably as a disulfide group, mentioned is a group having a 1,2-dithiolan ring group.

In the general formula (4), a cationic group as an adsorptive group represented by E is a group having a quaternized nitrogen atom and specifically examples thereof include a nitrogen-containing heterocyclic group having an ammonio group or a quaternized nitrogen atom. The ammonio group here denotes a group such as a trialkyl ammonio group, a dialkyl aryl ammonio group, and an alkyl diaryl ammonio group whereupon examples of such ammonio groups include a benzyl methyl ammonio group, a trihexyl ammonio group, and a phenyl diethyl ammonio group. The term "nitrogen-containing heterocyclic group having a quaternized nitrogen atom" as used herein is intended to include a pyridinio group, a quinolinio group, an isoquinolinio group, and an imidazolio group whereupon a pyridinio group, and an imidazolio group are preferable, and a pyridinio group is particularly preferable. These nitrogen-containing heterocyclic groups each having a quatenized nitrogen atom may contain a given substituent; however, in cases of the pyridinio group and the imidazolio group, examples of preferable substituents include an alkyl group, an aryl group, an acylamino group, a chlorine atom, an alkoxycarbonyl group, and a carbamoyl group whereupon, in the case of the pyridinio group, particularly preferable substituent is a phenyl group.

In the general formula (4), an ethynyl group as an adsorptive group represented by E is a —C≡CH group whereupon a hydrogen atom thereof may be substituted.

Any of the above-described adsorptive group may contain a given substituent. Examples of such substituents include a halogen atom (for example, a fluorine atom, a chlorine atom, a bromine atom, or an iodine atom), an alkyl group (for example, a linear, branched, or cyclic alkyl group which contains a bicycloalkyl group or an active methine group), an alkenyl group, an alkynyl group, an aryl group, a heterocyclic group (a position to be substituted is not limited), an acyl group, an alkoxycarbonyl group, an aryloxycarbonyl group, a heterocyclic oxycarbonyl group, a carbamoyl group, an N-hydroxycarbamoyl group, an N-acylcarbamoyl group, an N-sufonylcarbamoyl group, an N-carbamoylcarbamoyl group, a thiocarbamoyl group, an N-sulfamoylcarbamoyl group, a carbazoyl group, a carboxyl group or a salt thereof, an oxalyl group, an oxamoyl group, a cyano group, a carbonimidoyl group, a formyl group, a hydroxy group, an alkoxy group (including a group having a unit of an ethyleneoxy group or a propyleneoxy group in a repeating manner), an aryloxy group, a heterocyclic oxy group, an acyloxy group, an (alkoxy or aryloxy) carbonyloxy group, a carbamoyloxy group, a sufonyloxy group, an amino group, (an alkyl, aryl, or a heterocyclic) amino group, an acylamino group, a sulfonamide group, a ureido group, a thioureido group, an N-hydroxyureido group, an imido group, an (alkoxy or aryloxy) carbonylamino group, a sufamoylamino group, a semicarbazide group, a thiosemicarbazide group, a hydrazino group, an ammonio group, an oxamoylamino group, an N-(alkyl or aryl) sufonylureido group, an N-acylureido group, an N-acylsulfamoylamino group, a hydroxyamino group, a nitro group, a heterocyclic group containing a quaternized nitrogen atom (for example, a pyridinio group, an imidazolio group, a quinolinio group, or an isoquinolinio group), an isocyano group, an imino group, a mercapto group, (an alkyl, aryl, or a heterocyclic) thio group, (an alkyl, aryl, or a heterocyclic) dithio group, an (alkyl or aryl) sulfonyl group, an (alkyl or aryl) sulfinyl group, a sulfo group or a salt thereof, a sulfamoyl group, an N-acylsulfamoyl group, an N-sulfonylsulfamoyl group or a salt thereof, a phosphino group, a phosphinyl group, a phosphinyloxy group, a phosphinylamino group, and a silyl group. Further, the term "active methine group" as used herein is intended to include a methine group which has been substituted by two electron-attracting groups whereupon examples of such electron-attracting groups include an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, and a carbonimidoyl group. Here, two electron-attracting groups may be combined with each other to form a ring structure. Further, the term "salt" as used herein is intended to mean a cationic ion of, for example, an alkaline metal, an alkaline earth metal, or a heavy metal, or an organic cationic ion such as an ammonium ion, and a phosphonium ion.

Still further, specific examples of such adsorptive groups are those as described in Japanese Patent Application Laid-Open (JP-A) 11-95355, pp 4 to 7.

In the formula (4), examples of preferable adsorptive groups as represented by E include a mercapto-substituted heterocyclic group (for example, a 2-mercaptothiadiazole group, a 3-mercapto-1,2,4-triazole group, a 5-mercaptotetrazole group, a 2-mercapto-1,3,4-oxadiazole group, a 2-mercaptobenzothiazole group, a 2-mercaptobenzimidazole group, or a 1,5-dimethyl-1,2,4-triazolium-3-thiolate group), a dimercapto-substituted heterocyclic group (for example, a 2,4-dimercaptopyrimidine group, a 2,4-dimercaptotriazine group, a 3,5-dimercapto-1,2,4-triazole group, or a 2,5-dimercapto-1,3-thiazole group), and a nitrogen-containing heterocyclic group having an —NH— group which is capable of forming an imino silver (>NAg) as a partial structure of a heterocycle (for example, a benzotriazole group, a benzimidazole group, or an indazole group) and, among these, the dimercapto-substituted heterocyclic group is particularly preferable.

In the formula (4), W represents a divalent linking group. The linking group may be any linking group so long as it does not give any adverse effect to photographic characteristics. For example, any divalent linking group constituted by at least one member selected from the group consisting of: a carbon atom, a hydrogen atom, an oxygen atom, a nitrogen atom, and a sulfur atom can be utilized. Examples of such linking groups include an alkylene group having from 1 to 20 carbon atoms (for example, a methylene group, an ethylene group, a trimethylene group, a tetramethylene group, or a hexamethylene group), an alkenylene group having from 2 to 20 carbon atoms, an alkynylene group having from 2 to 20 carbon atoms, an arylene group having from 6 to 20 carbon atoms (for example, a phenylene group, or a naphthylene group), a —CO— group, an —$SO_2$— group, an —O— group, an —S— group, an —$NR_1$— group and combinations thereof: here, $R_1$ represents a hydrogen atom, an aliphatic group, or an aryl group. As for such aliphatic groups represented by $R_1$, aliphatic groups having 1 to 30 carbon atoms are preferable. Preferable example include an alkyl group, an alkenyl group, an alkynyl group, and an aralkyl group each of which is linear, branched, or cyclic and has 1 to 20 carbon atoms, (for example, a methyl group, an ethyl group, an isopropyl group, a t-butyl group, an n-octyl group, an n-decyl group, an n-hexadecyl group, a cyclopropyl group, a cyclopentyl group, a cyclohexyl group, an allyl group, a 2-butenyl group, a 3-pentenyl group, a propargyl group, 3-pentynyl group and benzyl group) while, as for such aryl groups represented by $R_1$, mentioned is an aryl group of a monocycle or a condensed cycle having preferably from 6 to 30 carbon atoms and more preferably from 6 to 20 carbon atoms whereupon examples of such aryl groups include a phenyl group, and a naphthyl group. A linking group represented by W may have a given substituent whereupon the definition of such substituents is the same as that of the substituents for the adsorptive groups as defined above.

In the formula (4), a reducing group represented by F is a group capable of reducing a silver ion whereupon examples of such reducing groups include residues derived from a formyl group, an amino group, a triple-bond group such as an acetylene group and a propargyl group, a mercapto group, hydroxylamines, hydroxamic acids, hydroxyureas, hydroxyurethanes, hydroxysemicarbazides, reductones (inclusive of derivatives thereof), anilines, phenols (inclusive of chromane-6-ols, 2,3-dihydrobenzofuran-5-ols, aminophenols, sulfonamidephenols, and polyphenols such as hydroquinones, catechols, resorcinols, benzene triols, and bisphenols), hydrazines, hydrazides, and phenidones.

In the formula (4), preferable reducing group represented by F is a residue derived from compounds represented by the following formulae ($B_1$) to ($B_{13}$):

($B_1$)

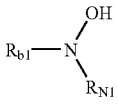

($B_2$)

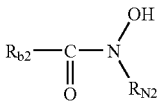

($B_3$)

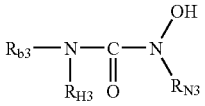

-continued ($B_4$)

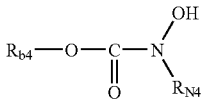

($B_5$)

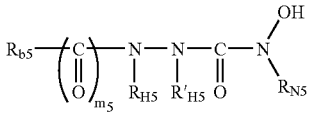

($B_6$)

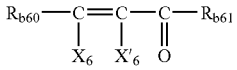

($B_7$)

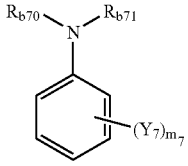

($B_8$)

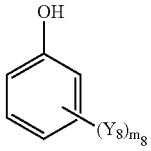

($B_9$)

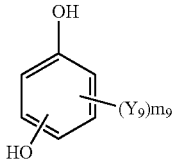

($B_{10}$)

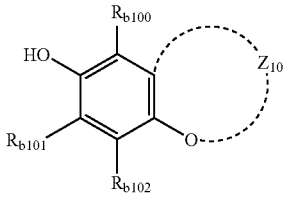

($B_{11}$)

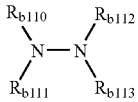

($B_{12}$)

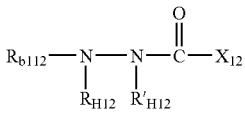

($B_{13}$)

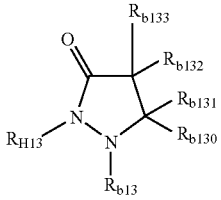

In the formulae ($B_1$) to ($B_{13}$), $R_{b1}$, $R_{b2}$, $R_{b3}$, $R_{b4}$, $R_{b5}$, $R_{b70}$, $R_{b71}$, $R_{b100}$, $R_{b111}$, $R_{b112}$, $R_{b113}$, $R_{b12}$, $R_{b13}$, $R_{N1}$, $R_{N2}$, $R_{N3}$, $R_{N4}$, and $R_{N5}$ each independently represent a hydrogen atom, an alkyl group, an aryl group, or a heterocyclic group;

$R_{H3}$, $R_{H5}$, $R'_{H5}$, $R_{H12}$, $R'_{H12}$, and $R_{H13}$ each independently represent a hydrogen atom, an alkyl group, an aryl group, an acyl group, an alkylsulfonyl group, or an arylsulfonyl group and $R_{H3}$ may further be a hydroxyl group;

$R_{b100}$, $R_{b101}$, $R_{b102}$, and $R_{b130}$ to $R_{b133}$ each independently represent a hydrogen atom or a substituent;

$Y_7$ and $Y_8$ each independently represent a substituent exclusive of a hydroxyl group;

$Y_9$ represents a substituent;

$m_5$ represents 0 or 1;

$m_7$ represents an integer of 0 to 5;

$m_8$ represents an integer of 1 to 5; and $m_9$ represents an integer of 0 to 4. Here, $Y_7$ to $Y_9$ may each be an aryl group, which may further have a substituent, to be condensed with a benzene ring (for example, benzene condensed ring).

In the formula ($B_1$) to ($B_{13}$), $Z_{10}$ represents a non-metallic atomic group capable of forming a ring; and $X_{12}$ represents a hydrogen atom, an alkyl group, an aryl group, a heterocyclic group, an alkoxy group, an amino group (inclusive of an alkylamino group, an arylamino group, a heterocyclic amino group, and a cyclic amino group), or a carbamoyl group.

In the formula ($B_6$), $X_6$ and $X'_6$ each independently represent one member selected from the group consisting of: a hydroxyl group, an alkoxy group, a mercapto group, an alkylthio group, an amino group (inclusive of an alkylamino group, an arylamino group, a heterocyclic amino group, and a cyclic amino group), an acylamino group, a sulfonamide group, an alkoxycarbonylamino group, a ureido group, an acyloxy group, an acylthio group, an alkylaminocarbonyloxy group, and an arylaminocarbonyloxy group;

$R_{b60}$ and $R_{b61}$ each independently represent an alkyl group, an aryl group, an amino group, an alkoxy group, or aryloxy group whereupon $R_{b60}$ and $R_{b61}$ may be bonded to each other to form a ring structure.

In the above explanation of respective groups in the formulae ($B_1$) to ($B_{13}$), the alkyl group denotes a linear, branched or cyclic, substituted or non-substituted alkyl group having 1 to 30 carbon atoms; the aryl group denotes a monocycle or condensed cyclic substituted or non-substituted aromatic hydrocarbon ring; and the heterocyclic group denotes an aromatic or non-aromatic, monocycle or condensed cyclic, substituted or non-substituted heterocyclic group having at least one heteroatom.

Further, the definition of substituents recited in the above explanation of respective groups in the formulae ($B_1$) to ($B_{13}$) are the same as that of the substituents for the adsorptive groups described above. These substituents may each further be substituted by at least any one of these substituents.

In the formulae ($B_1$) to ($B_5$), $R_{N1}$, $R_{N2}$, $R_{N3}$, $R_{N4}$, and $R_{N5}$ each preferably represent a hydrogen atom, or an alkyl group whereupon the alkyl group preferably alkyl groups are linear, branched, or cyclic, substituted or non-substituted alkyl groups each having 1 to 12 carbon atoms and more preferably linear or branched, substituted or non-substituted alkyl groups each having from 1 to 6 carbon atoms whereupon examples of such alkyl groups include a methyl group, an ethyl group, a propyl group, and a benzyl group.

In the formula ($B_1$), $R_{b1}$ preferably represents an alkyl group or a heterocyclic group whereupon the alkyl group denotes a linear, branched, or cyclic, substituted or non-substituted alkyl group preferably having 1 to 30 carbon atoms, more preferably 1 to 18 carbon atoms, while the heterocyclic group denotes a 5- or 6-membered, monocyclic or condensed cyclic, aromatic or non-aromatic heterocyclic group which may have a substituent. The heterocyclic group preferably is a aromatic heterocyclic group whereupon examples of such heterocyclic groups include a pyridine ring group, a pyrimidine ring group, a triazine ring group, a thiazole ring group, a benzothiazole ring group, an oxazole ring group, a benzoxazole ring group, an imidazole ring group, a benzimidazole ring group, a pyrazole ring group, an indazole ring group, an indole ring group, a purine ring group, a quinoline ring group, an isoquinoline ring group, and a quinazoline ring group whereupon a triazine ring group and a benzothiazole ring group are particularly preferable thereamong. An alkyl group or a heterocyclic group, represented by $R_{b1}$, which further has one or more —N($R_{N1}$)OH groups as substituents is also a favorable example of compounds represented by the formula ($B_1$).

In the formula ($B_2$), $R_{b2}$ preferably represents an alkyl group, an aryl group, or a heterocyclic group and more preferably an alkyl group or an aryl group. A preferable range of the alkyl group is the same as that recited in the description for $R_{b1}$. The aryl group is preferably a phenyl group or a naphthyl group and particularly preferably a phenyl group whereupon the aryl group may have a substituent. A group, represented by $R_{b2}$, which further has one or more —CON($R_{N2}$)OH groups as substituents is a favorable example of compounds represented by the formula ($B_2$).

In the formula ($B_3$), $R_{b3}$ preferably represents an alkyl group, or an aryl group. Preferable ranges of these groups are the same as those recited in the descriptions of $R_{b1}$ and $R_{b2}$. $R_{H3}$ preferably represents a hydrogen atom, an alkyl group, or a hydroxyl group, and more preferably a hydrogen atom. A group, represented by $R_{b3}$, which further has one or more —N($R_{H3}$)CON($R_{N3}$)OH groups as substituents is a favorable example of compounds represented by the formula ($B_3$). Further, $R_{b3}$ and $R_{N3}$ may be bonded to each other to form a ring structure (preferably 5- or 6-membered saturated heterocycle).

In the formula ($B_4$), $R_{b4}$ preferably represents an alkyl group whereupon a preferable range thereof is the same as that recited in the description on $R_{b1}$. A group, represented by $R_{b4}$, which further has one or more —OCON($R_{N4}$)OH groups as substituents is a favorable example of compounds represented by the formula ($B_4$).

In the formula ($B_5$), $R_{b5}$ preferably represents an alkyl group or an aryl group and more preferably an aryl group whereupon preferable ranges of these groups are the same as those recited in the descriptions of $R_{b1}$ and $R_{b2}$. $R_{H5}$, and $R'_{H5}$ each independently represent preferably a hydrogen atom or an alkyl group and more preferably a hydrogen atom.

In the formula ($B_6$), a case in which $R_{b60}$, and $R_{b61}$ are bonded to each other to form a ring structure is preferable. The ring structure formed here is a 5- to 7-membered non-aromatic, carbon ring or heterocycle which may either be a monocycle or a condensed ring. Preferable specific examples of such ring structures include a 2-cyclopentene-1-one ring, a 2,5-dihydrofuran-2-one ring, a 3-pyrroline-2-one ring, a 4-pyrazoline-3-one ring, a 2-cyclohexene-1-one ring, a 5,6-dihydro-2H-pyran-2-one ring, a 5,6-dihydro-2-pyridone ring, a 1,2-dihydronaphthalene-2-one ring, a coumarin ring (benzo-α-pyran-2-one ring), a 2-quinolone ring, a 1,4-dihydronaphthalene-1-one ring, a chromone ring (benzo-γ-pyran-4-one ring), a 4-quinolone ring, an indene-1-one ring, a 3-pyrroline-2,4-dione ring, a uracil ring, a thiouracil ring, and a dithiouracil ring whereupon a 2-cyclopentene-1-one ring, a 2,5-dihydrofuran-2-one ring, a 3-pyrroline-2-one ring, a 4-pyrazoline-3-one ring, a 1,2-dihydronaphthalene-2-one ring, a coumarin ring (benzo-α-pyran-2-one ring), a 2-quinolone ring, a 1,4-dihydronaphthalene-1-one ring, a chromone ring (benzo-γ-pyran-4-one ring), a 4-quinolone ring, an indene-1-one ring, and a dithiouracil ring are more preferable, and a 2-cyclopentene-1-one ring, a 2,5-dihydrofuran-2-one ring, a 3-pyrroline-2-one ring, an indene-1-one ring, and a 4-pyrazoline-3-one ring are still more preferable.

In a case in which $X_6$, or $X'_6$ represents a cyclic amino group, such cyclic amino group is a non-aromatic nitrogen-containing heterocyclic group in which is a nitrogen atom is bonded to the main chain, whereupon examples of such cyclic amino groups include a pyrrolidino group, a piperidino group, a piperazino group, a morpholino group, a 1,4-thiazine-4-yl group, a 2,3,5,6-tetrahydro-1,4-thiazine-4-yl group, and an indolyl group.

Preferable examples of $X_6$, and $X'_6$ include a hydroxyl group, a mercapto group, an amino group (inclusive of an alkylamino group, an arylamino group, and a cyclic amino group), an acylamino group, a sulfonamide group, an acyloxy group and an acylthio group, more preferably at least one member selected from the group consisting of: a hydroxyl group, a mercapto group, an amino group, an alkylamino group, a cyclic amino group, a sulfonamide group, an acylamino group, and an acyloxy group, and particularly preferably at least one member selected from the group consisting of: a hydroxyl group, an amino group, an alkylamino group, and a cyclic amino group. Further, it is preferable that at least one of $X_6$ and $X'_6$ is a hydroxyl group.

In the formula ($B_7$), $R_{b70}$ or $R_{b70}$ is preferably a hydrogen atom, an alkyl group and an aryl group, and more preferably an alkyl group. A preferable range of the alkyl group is the same as that recited in the description on $R_{b1}$. $R_{b70}$ and $R_{b71}$ may be bonded to each other to form a ring structure (for example, a pyrrolidine ring, a piperidine ring, a morpholino ring, or a thiomorpholino ring). A substituent represented by $Y_7$ is a group or a salt such as an alkyl group (a preferable range thereof is the same as that recited in the description on $Rb_1$), an alkoxy group, an amino group, an acylamino group, a sulfonamide group, a ureido group, an acyl group, an alkoxycarbonyl group, a carbamoyl group, a sulfamoyl group, a chlorine atom, a sulfo group or a salt thereof, and a carboxyl group or a salt thereof; and $m_7$ preferably represents 0 to 2.

In the formula ($B_8$), m preferably represents 1 to 4; and a plurality of $Y_8$ may be same with or different from one another. $Y_8$ when $m_8$ is 1, or at least one of a plurality of $Y_8$ when $m_8$ is two or more, is preferably an amino group (inclusive of an alkylamino group, and an arylamino group), a sulfonamide group, or an acylamino group. When $m_8$ is two or more, a remaining $Y_8$ is preferably one selected from the group consisting of: a sulfonamide group, an acylamino group, an ureido group, an alkyl group, an alkylthio group, an acyl group, an alkoxycarbonyl grop, a carbamoyl group, a sulfo group or a salt thereof, a carboxyl group or a salt thereof, a chlorine atom, and the like. Here, when an o'-(or p'-)hydroxyphenylmethyl group (which may have a substituent) is substituted as a substituent represented by $Y_8$ at an ortho position or a para position of the hydroxyl group, the resultant compound is included in a group of compounds ordinarily referred to as bisphenol. Such resultant compounds are also preferable examples of compounds represented by the formula ($B_8$). Further, a case in which $Y_8$ represents a benzene condensed ring and, as a result, the formula ($B_8$) represents naphthols is also extremely favorable.

In the formula ($B_9$), substitution positions of two hydroxyl groups may be in an ortho position (catechols), a metha position (resorcinols), or a para position (hydroquinones) therebetween. $m_9$ is preferably 1 to 2. A plurality of $Y_9$ may be same with or different from one another. Examples of preferable substituents represented by $Y_9$ include a chlorine atom, an acylamino group, an ureido group, a sulfonamide group, an alkyl group, an alkylthio group, an alkoxy group, an acyl group, an alkoxycarbonyl group, a carbamoyl group, a sulfo group or a salt thereof, a carboxyl group or a salt thereof, a hydroxyl group, an alkylsujonyl group, and an arylsulfonyl group. A case in which $Y_9$ represents a benzene condensed ring and the formula ($B_9$), as a result, represents a 1,4-naphthohydroquinone, is also preferable. When the formula ($B_9$) represents catechols, it is preferable that $Y_9$ represents a sulfo group, a salt of a sulfo group, or a hydroxyl group.

In the formula ($B_{10}$), when $R_{b100}$, $R_{b101}$, and $R_{b102}$ each independently represent a substituent, preferable examples of such substituents are the same as those in a case of $Y_9$. Among others, an alkyl group (particularly a methyl group) is preferable. A ring structure which is formed by $Z_{10}$ is preferably a chromane ring, and a 2,3-dihydrobenzofuran ring whereupon these ring structures may contain a substituent and may form a spiro ring.

In the formula ($B_{11}$), $R_{b110}$, $R_{b111}$, $R_{b112}$, or $R_{b113}$ is preferably an alkyl group, an aryl group and a heterocyclic group whereupon preferable ranges of these groups are the same as those recited on the descriptions in $R_{b1}$ and $R_{b2}$. Among others, an alkyl group is preferable. Two alkyl groups represented by any two groups of $R_{b110}$ to $R_{b113}$ may be bonded to each other to form a ring structure. Such ring structure is a 5- or 6-membered non-aromatic heterocycle whereupon examples of such heterocycles include a pyrrolidine ring, a piperidine ring, a morpholino ring, a thiomorpholino ring, and a hexahydropyridazine ring.

In the formula ($B_{12}$), $R_{b12}$ preferably represents an alkyl group, an aryl group, or a heterocyclic group whereupon preferable ranges of these groups are the same as those recited in the descriptions on $R_{b1}$ and $R_{b2}$. $X_{12}$ preferably represents an alkyl group, an aryl group (particularly a phenyl group), a heterocyclic group, an alkoxy group, an amino group (inclusive of an alkylamino group, an arylamino group, a heterocyclic amino group, and a cyclic amino group), or a carbamoyl group, and more preferably an alkyl group (particularly an alkyl group having from 1 to 8 carbon atoms), an aryl group (particularly a phenyl group), and an amino group (inclusive of an alkylamino group, an arylamino group, and a cyclic amino group). $R_{H12}$ and $R'_{H12}$ is preferably a hydrogen atom or an alkyl group and more preferably a hydrogen atom.

In the formula ($B_{13}$), $R_{b13}$ preferably represents an alkyl group or an aryl group whereupon preferable ranges of these groups are the same as those recited in the descriptions on $R_{b1}$ and $Rb_2$. $R_{b130}$, $R_{b131}$, $R_{b132}$, or $R_{b133}$ is preferably a hydrogen atom, an alkyl group (particularly that having from 1 to 8 carbon atoms), or an aryl group (particularly a phenyl group). $R_{H13}$ is preferably a hydrogen atom or an acyl group and more preferably a hydrogen atom.

In the formula (4), preferable examples of the reducing group represented by F includes hydroxylamines, hydroxamic acids, hydroxureas, hydroxysemicarbazides, phenols, hydrazines, hydrazides, and phenidones and more preferably hydroxyureas, hydroxysemicarbazides, phenols, hydrazides and phenidones.

In the formula (4), as for the reducing group represented by F, an oxidation potential thereof can be measured by using a measuring method described in, for example, Akira Fujishima "Denkikagaku Sokuteiho" (Electrochemical Measuring Method), pp. 150–208, Gihodo Shuppan Co., Ltd. or "Jikkenkagaku Koza" (Series of Experimental Chemistry), edited by the Chemical Society of Japan, 4 ed., vol. 9, pp. 282–344, Maruzen Co., Ltd. For example, the oxidation potential can be measured by using a technique of a rotating discvoltammetry; specifically; a sample is dissolved in a solution obtained by mixing methanol and a Britton-Robinson buffer having a pH of 6.5 at a mixing ratio of 10%: 90% by volume; then, a nitrogen gas is allowed to flow in the resultant solution for 10 minutes; thereafter, a measurement is conducted by using a rotating disc electrode (RDE) made of glassy carbon as a working electrode, a platinum wire as a counter electrode, and a saturated calomel electrode as a reference electrode at 25° C., 1000 rotations/minute, with a sweep rate of 20 mV/second to obtain a voltamogram and a half-wave potential (E1/2) can be determined from the thus-obtained voltamogram.

When the reducing group represented by F recited in the invention is subjected to a measurement by using a measuring method as described above, the oxidation potential thereof is preferably in the range of approximately from −0.3 V to 1.0 V, more preferably in the range of approximately from −0.1 V to 0.8 V and particularly preferably in the range of approximately from 0 V to 0.7 V.

Most of such reducing agents represented by F recited in the invention are compounds known in the photographic industry whereupon examples thereof are also described in, for example, JP-A Nos. 2001-42466, 8-114884, 8-314051, 8-333325, 9-133983, 11-282117, 10-246931, 10-90819, 9-54384, 10-171060, and 7-77783. Further, as an example of phenols, mentioned is a compound as described in U.S. Pat. No. 6,054,260.

A compound represented by the formula (4) recited in the invention may be a compound in which a ballast group or a polymer chain that is ordinarily used in an immobile photographic additive such as a coupler is incorporated. Further, as for polymers, mentioned is a polymer as described in JP-A No. 1-100530.

A compound represented by the formula (4) recited in the invention may be in bis or tris forms. A molecular weight of a compound represented by the formula (1) recited in the invention is preferably in the range of 100 to 10000, more preferably in the range of from 120 to 1000 and particularly preferably in the range of from 150 to 500.

Examples of such compounds represented by the formula (4) recited in the invention are mentioned below; however, the invention is not limited thereto. Preferable examples thereof also include compounds as illustrated in JP-A Nos. 2000-330247, and 2001-42446.

(1)

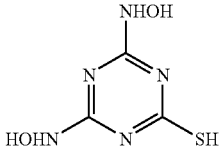

-continued (2)

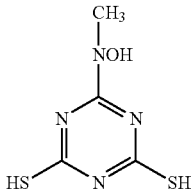

(3)

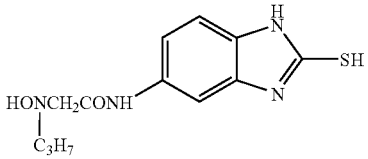

(4)

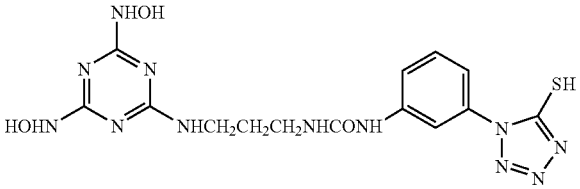

(5)

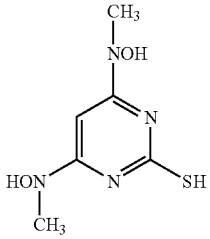

(6)

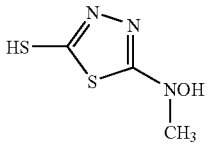

(7)

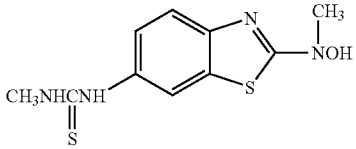

(8)

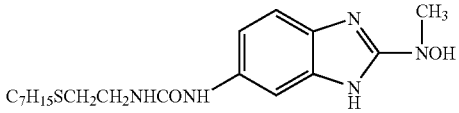

(9)

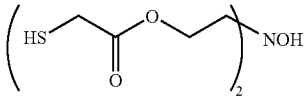

-continued
(10)
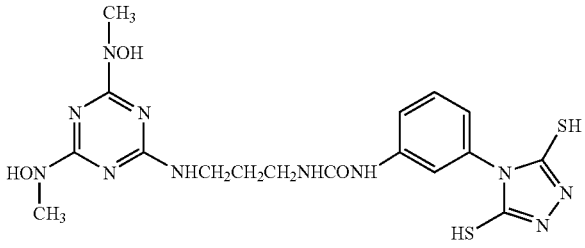
(11)
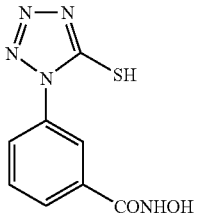
(12)
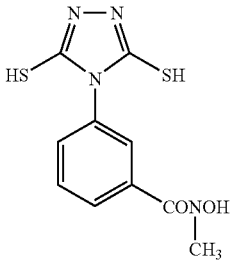
(13)
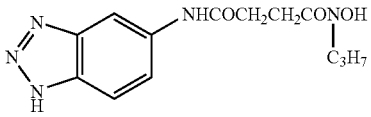
(14)
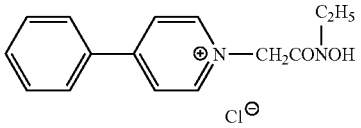
(15)
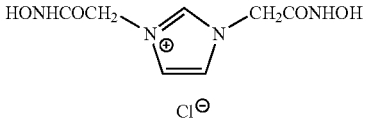
(16)
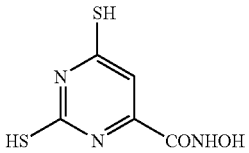
(17)
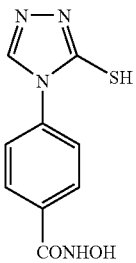
-continued
(18)
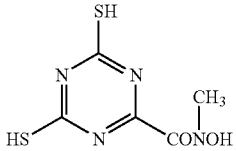
(19)
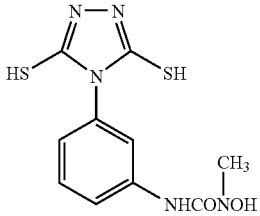
(20)
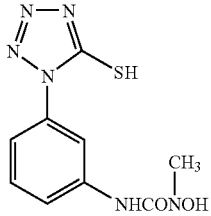
(21)
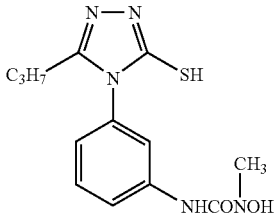
(22)
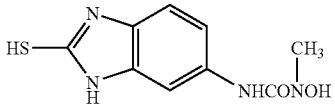
(23)
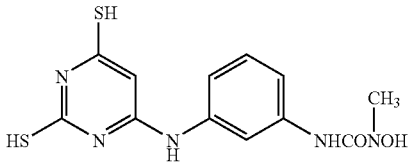
(24)
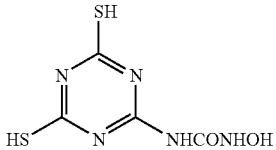
(25)
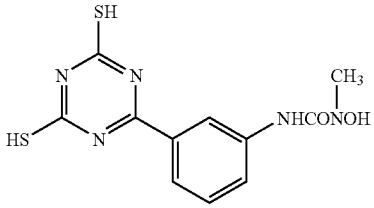

-continued
(26)
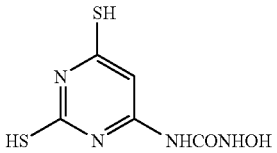
(27)
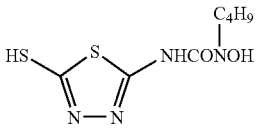
(28)
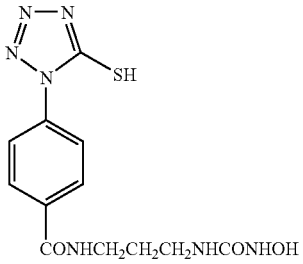
(29)
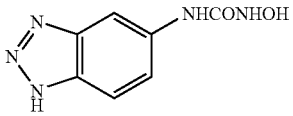
(30)
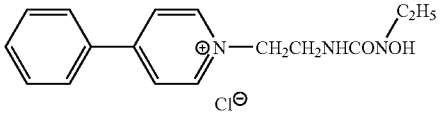
(31)
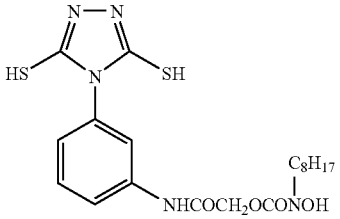
(32)
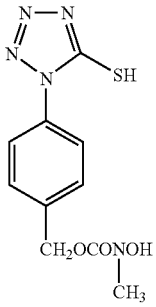
(33)
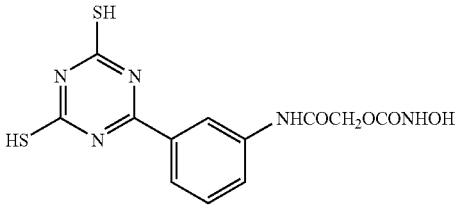
-continued
(34)
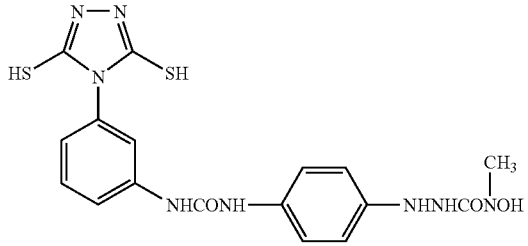
(35)
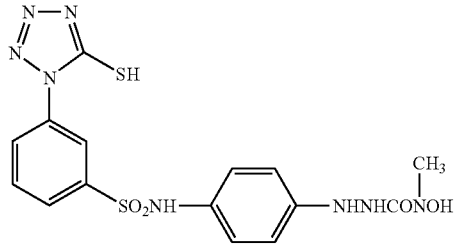
(36)
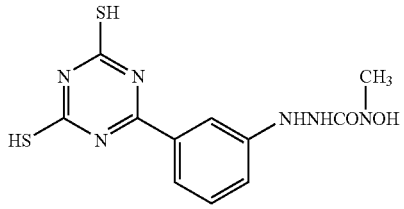
(37)
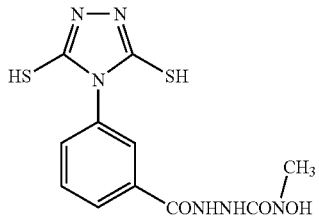
(38)
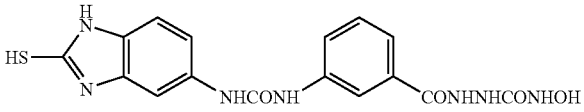
(39)
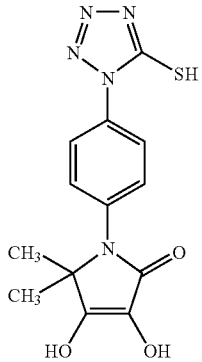

-continued
(40)
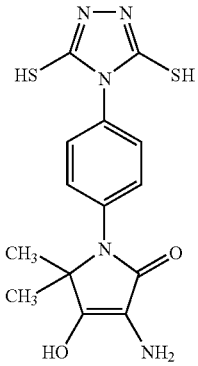
(41)
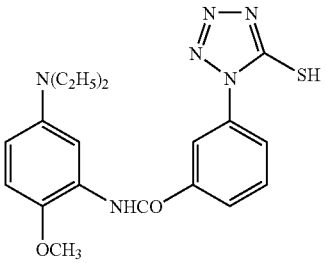
(42)
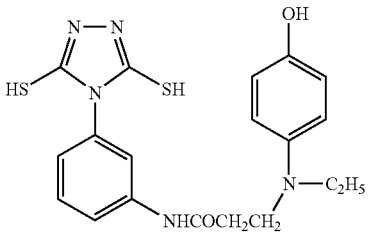
(43)
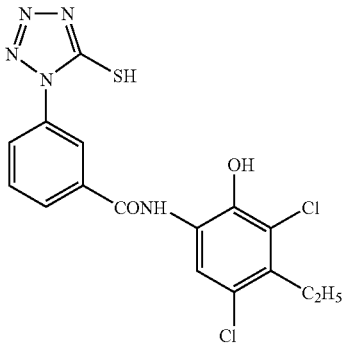
(44)
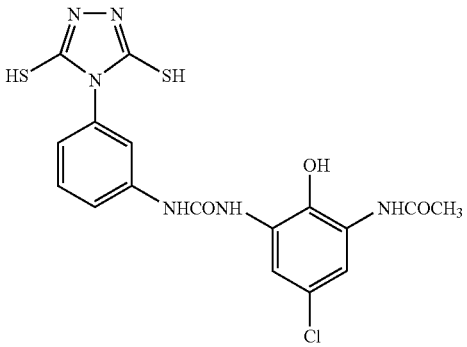
-continued
(45)
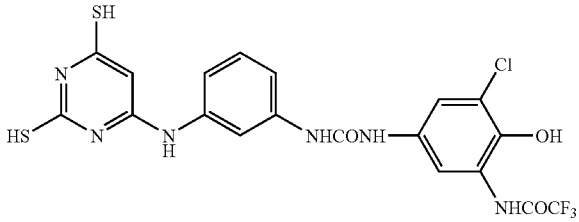
(46)
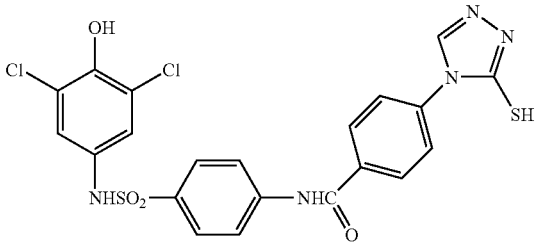
(47)
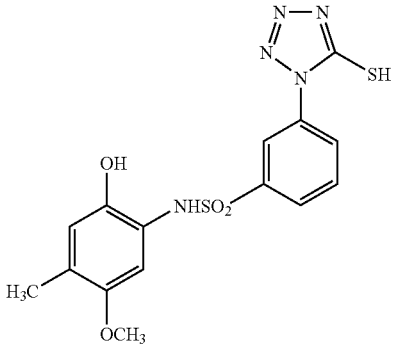
(48)
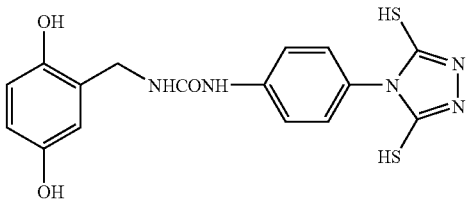
(49)
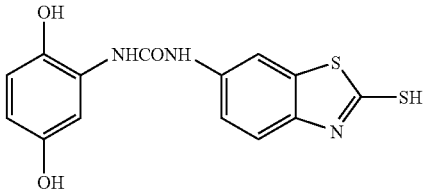
(50)
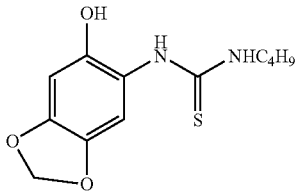

-continued
(51)
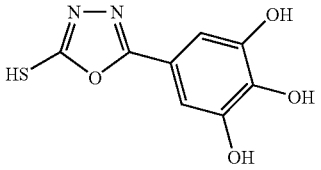
(52)
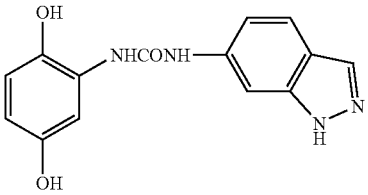
(53)
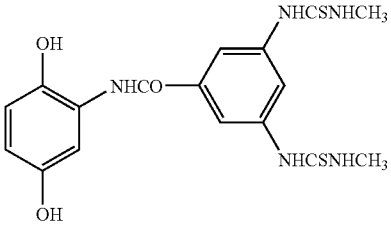
(54)
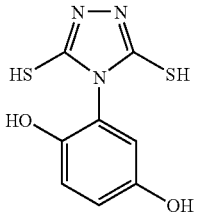
(55)
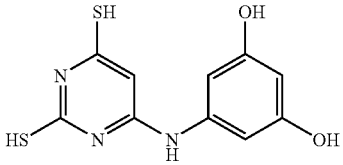
(56)
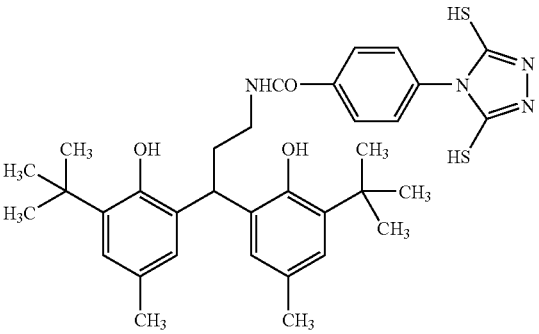
(57)
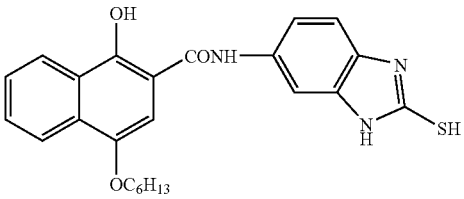
-continued
(58)
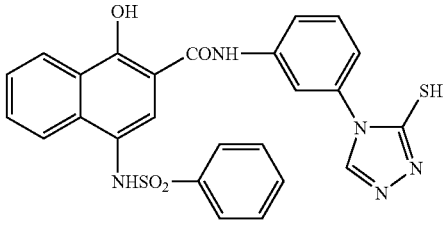
(59)
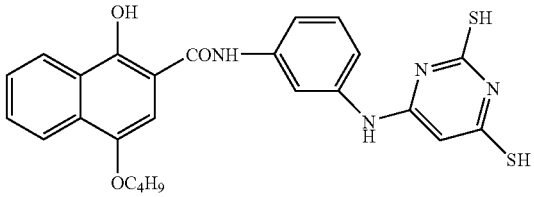
(60)
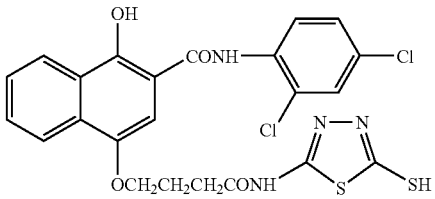
(61)
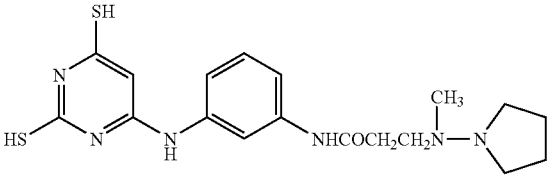
(62)
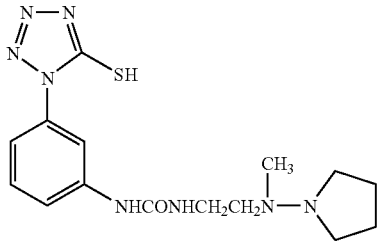
(63)
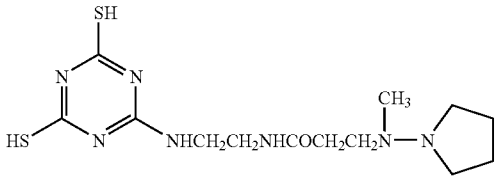
(64)
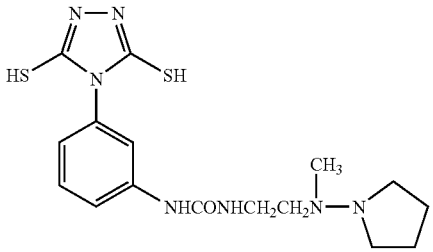

-continued
(65)
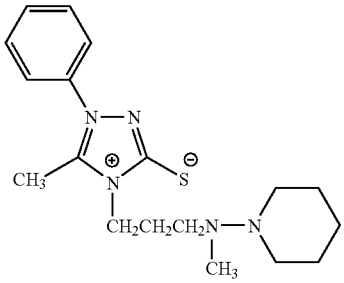
(66)
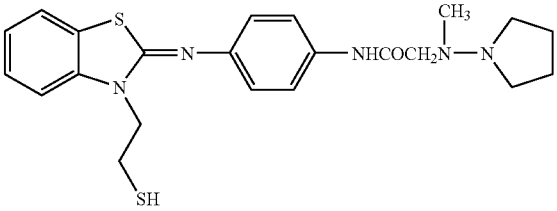
(67)
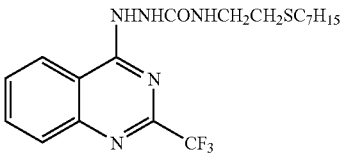
(68)
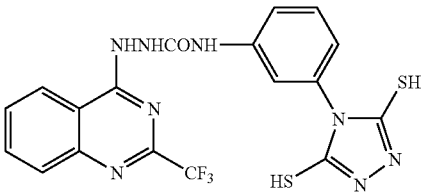
(69)
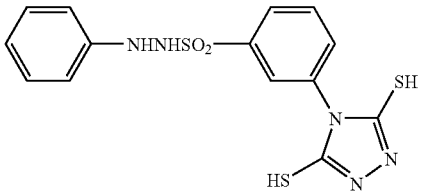
(70)
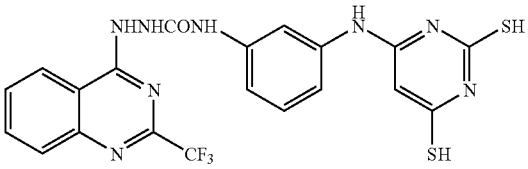
-continued
(71)
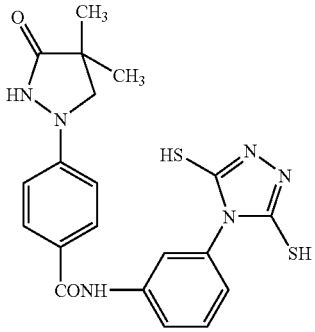
(72)
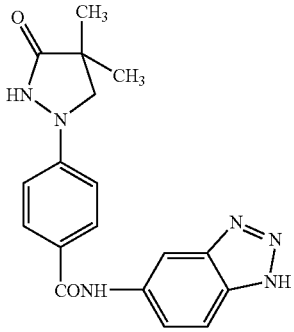
(73)
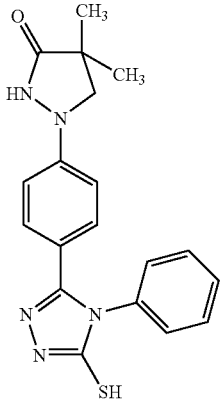
(74)
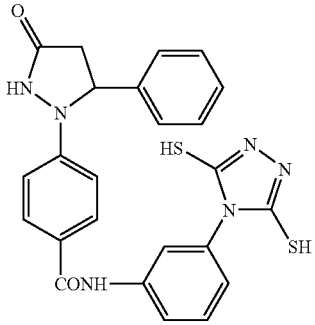

-continued
(75)
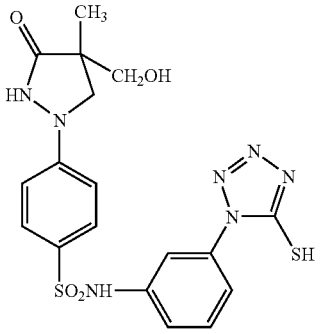
(76)
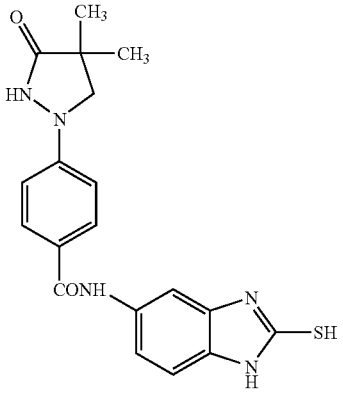
(77)
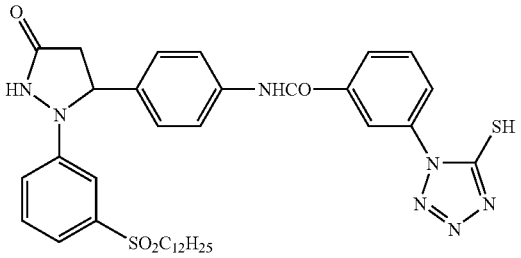
(78)
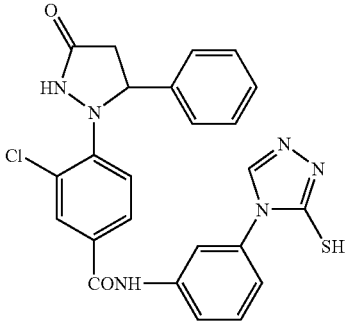
-continued
(79)
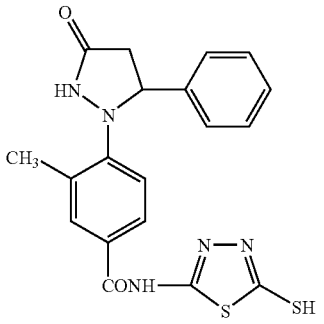
(80)
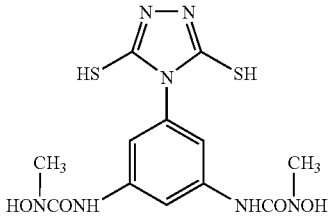
(81)
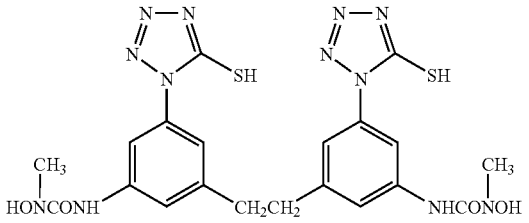
(82)
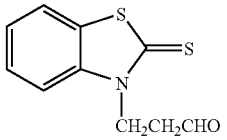
(83)
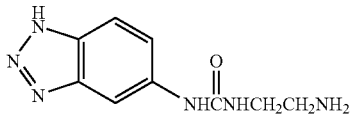
(84)
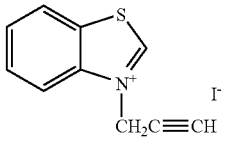
(85)
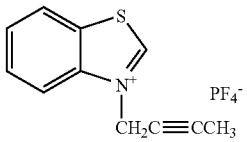
(86)
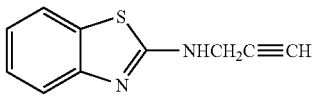
(87)
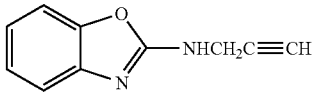

-continued (88)

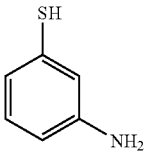

(89)

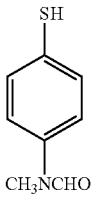

(90)

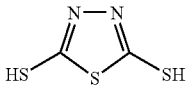

(91)

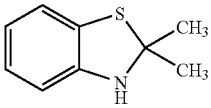

(92)

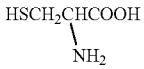

(93)

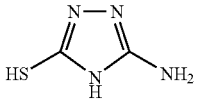

(94)

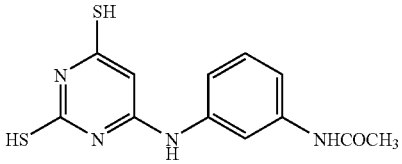

(95)

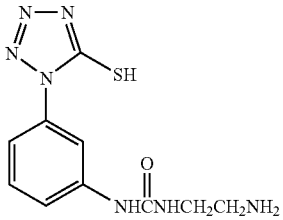

(96)

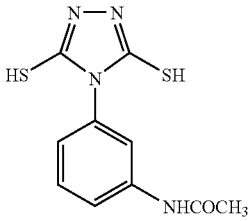

Compound recited in the invention can easily be synthesized following a known method. As for compounds represented by the formula (4) recited in the invention, one kind of compound may be used alone. Also, simultaneous use of two or more kinds of compounds is also preferable. When two or more kinds of compounds are used, the compounds may be added in a same layer or may be added in different layers whereupon addition methods thereof may be different from one another.

It is preferable that the compound represented by the formula (4) is added in a silver halide emulsion layer, preferably at preparation of an emulsion. When the compound is added at preparation of the emulsion, it is possible to add the compound at any time in the preparation of the emulsion, such as in a step of forming a silver halide grain, before start of a desalting step, in the desalting step, before start of a chemical ripening, in a chemical ripening step, and in a step before preparation of the final emulsion. Further, the compound can be added in a plurality of times in a plurality of steps. Still further, it is preferable that the compound is added in the emulsion layer, however, the compound can be previously added not only in the emulsion layer, but also in an adjoining protective or intermediate layer and, then, allowed to be diffused at the time of coating.

A preferable amount of the compound represented by the formula (4) to be added is, though substantially varying depending on addition methods as described above and a species of the compound to be added, ordinarily in the range of from $1\times10^{-6}$ mol to 1 mol, preferably from $1\times10^{-5}$ mol to $5\times10^{-1}$ mol and more preferably from $1\times10^{-4}$ mol to $1\times10^{-1}$ mol, per 1 mol of photosensitive silver halide.

The compound represented by the formula (4) can be dissolved in water, a water-soluble solvent such as methanol and ethanol, or a mixture solvent thereof and, then, added. Here, the pH of the resultant solution may appropriately be adjusted with an acid or a base. The solution may contain a surfactant, as well as a compound represented by the formula (4). Further, the compound may be dissolved in an organic solvent having a high boiling point and, then, added as an emulsified dispersion. Still further, the compound may also be added as a solid dispersion.

The compound having a group that is adsorptive to a silver halide and a group that reduces a silver halide recited in the invention, the compound represented by the general formula (4) recited in the invention, and the compound having a β-lactam ring may be used in combination of two kinds or three kinds thereof. For example, combination use of two kinds of the compound is possible, that is a combination of the compound having a group that is adsorptive to a silver halide and a group that reduces a silver halide and the compound represented by the general formula (4), a combination of the compound having a group that is adsorptive to a silver halide and a group that reduces a silver halide and the compound having a β-lactam ring, or a combination of the compound represented by the general formula (4) and the compound having a β-lactam ring can be used. Further combination use of three kinds of the compound is also possible, that is the compound having a group that is adsorptive to a silver halide and a group that reduces a silver halide, the compound represented by the general formula (4), and the compound having a β-lactam ring can simultaneously be used. A ratio of these compounds to be simultaneously used may be, though substantially varying in accordance with a kind of the specific compound and a composition of a layer, ordinarily in the range of from 1/100 to 100/1 to one another in terms of molar ratio.

1-1-4. Photosensitive Silver Halide

1) Halogen Composition

It is important that a photosensitive silver halide recited in the invention has a composition in which a silver iodide content is as high as 40% by mol to 100% by mol. A remaining content is not particularly limited and can be selected from silver chloride, silver bromide, and organic silver salts such as silver thiocyanate, and silver phosphate whereupon, particularly, silver bromide or silver chloride is preferable. By using the silver halide having a composition in which the silver iodide content is high as described above, a favorable photothermographic material in which image storage properties after subjected to a developing treatment is enhanced, and particularly an increase of fogging caused by light irradiation is remarkably small can be designed.

Further, the silver iodide content is more preferably in the range of 70% by mol to 100% by mol, and the silver iodide content in the range of 90% by mol to 100% by mol is particularly preferable in view of the image storage properties against light irradiation after the developing treatment.

Distribution of a halogen composition within a grain may be uniform, changed stepwise, or changed continuously. Further, a silver halide grain having a core/shell structure can also favorably be used. As for structures, a 2- to 5-fold structure is preferable, and a core/shell grain having a 2- to 4-fold structure can more preferably be used. Still further, a structure with high silver iodide content in a core in which a silver iodide content in a core portion is high, and a structure with high silver iodide content in a shell in which a silver iodide content in a shell portion is high can also be favorably used. Furthermore, a technique in which silver chloride or silver bromide is localized on a surface of a grain as an epitaxial portion can also be favorably employed.

2) Grain Size

As for the silver halide having a high silver iodide content recited in the invention, a grain size is particularly important. When the size of the silver halide is unduly large, an amount of the silver halide to be applied which is necessary for attaining a required maximum density is increased in general, to lower transparency of a layer; which is not preferable.

When the silver halide having a high silver iodide content is used, it is necessary that, in order to attain a sufficient maximum optical density, a size of a silver halide grain is substantially small compared with that of conventional silver bromide or silver iodobromide having a low iodine content and an amount of silver iodide to be added is suppressed to be small. The grain size of the silver halide is preferably in the range of 5 nm to 70 nm, more preferably in the range of 10 nm to 50 nm and particularly preferably in the range of 20 nm to 45 nm. The term "grain size" as used herein denotes a length of an edge of a grain in a case that the grain is in so-called normal crystal form such as a cubic form and a octahedral form, and denotes an average diameter of circles having the same area with a projected area in a case that the grain is not in normal crystal form such as a spherical form and a rod-like form, when grains are observed by an electron microscope.

3) Applied Amount

An amount of the silver halide grain to be applied is, based on 1 mol of silver of a non-photosensitive organic silver salt to be described below, in the range of from 0.1% by mol to 15% by mol, preferably in the range of from 0.5% by mol to 12% by mol and particularly preferably in the range of from 1% by mol to 9% by mol. A selection of such amount to be applied is important, in order to suppress a remarkable development inhibition by the silver halide high in silver iodide content, which inhibition has been found by the inventor.

4) Grain-Forming Method

A method for forming a photosensitive silver halide is well known in the art; for example, methods as described in Research Disclosure No. 17029 (June, 1978) and U.S. Pat. No. 3,700,458 can be used and, specifically, a method can be employed in which firstly a photosensitive silver halide is prepared by adding a silver-supplying compound and a halogen-supplying compound to gelatin or another polymer aqueous solution and, then, the thus-prepared photosensitive silver halide is added with an organic silver salt. Further, a method as described in paragraphs [0217] to [0224] of JP-A No. 11-119374, a method described in JP-A No. 11-352627, or a method described in JP-A No. 2000-347335 is preferably used.

For example, a so-called halidation method can also be preferably used, in which a part of silver of an organic silver salt is halogenated by an organic or inorganic halogenated compound. The organic halogenated compound to be used in this method is not particularly limited so long as it reacts with the organic silver salt to form a silver halide whereupon examples of such organic halogenated compounds include an N-halogenoimide (such as N-bromosuccinimide), a halogenated quaternary nitrogen compound (such as tetrabutylammonium bromide), an associated compound of a halogenated quaternary nitrogen salt with a halogen molecule (such as pyridinium bromide perbromide). The inorganic halogenated compound is not particularly limited so long as it reacts with an organic silver salt to form a silver halide whereupon examples of such inorganic halogenated compounds include an alkali metal halide or an ammonium halide (such as sodium chloride, lithium bromide, potassium iodide, and ammonium bromide), an alkali earth metal halide (such as calcium bromide, and magnesium chloride), a transition metal halide (such as ferric chloride, and cupric bromide), a metal complex having a halogen ligand (such as sodium bromoiridate, and ammonium chlororhodate), and a halogen molecule (such as bromine, chlorine, and iodine). The organic and inorganic halogenated compounds can be used optionally. An amount of the halogenated compound to be used at the time of the halidation is, based on 1 mol of the organic silver salt, preferably in the range of from 1 mmol to 500 mmol and more preferably in the range of from 10 mmol to 250 mmol, in terms of halogen atom.

A photosensitive silver halide grain may be desalted by rinsing with water according to a method known in the art, such as noodle washing and flocculation. According to the invention, the grain may be or may not be desalted.

5) Grain Shape

Examples of shapes of silver halide grains include a cubic shape, an octahedral shape, a tetradecahedral shape, a dodecahedral shape, a tabular shape, a spherical shape, a rod-like shape, and a potato-like shape. Particularly, silver halide grains in dodecahedral, tetradecahedral, and tabular shape are preferable. The silver halide high in silver iodide content recited in the invention can be of a complicated shape; however, examples of preferable shapes thereof include a conjugated grain as described in R. L. Jenkins et al., The Journal of Photographic Science, Vol. 28, p. 164, FIG. 1 (1980). Further, a grain in tabular shape as shown in FIG. 1, ibid., can also preferably be used. The silver halide grain having a round corner can also be preferably used. There is no particular restriction on a face index (Miller index) of an outer surface of the photosensitive silver halide grain recited in the invention; however, a proportion of [100] face, which is high in spectral sensitization efficiency when a spectral sensitizing dye is adsorbed thereon, is preferably high. The proportion of [100]face is preferably 50% or more, more preferably 65% or more and still more preferably 80% or more. The proportion of Miller index [100] face can be determined by using a method, as described in T. Tani, J. Imaging Sci., 29, 165 (1985), which utilizes adsorption dependency of [111] face and [100] face in adsorption of a sensitizing dye.

6) Heavy Metal

The photosensitive silver halide grain preferably contains at least one kind of metal complex comprising a metal selected from the group consisting of: rhodium, rhenium, ruthenium, osmium, iridium, cobalt, mercury, and iron. Single kind of metal complex may be used, and two or more kinds of metal complexes comprising a same metal with or different metals from each other may also be used in combination. A content of the metal complex is, based on 1 mol of silver, preferably in the range of 1 nmol to 10 mmol and more preferably in the range of 10 nmol to 100 μmol. With respect to a specific structure of the metal complex, metal complexes having structures as described in JP-A No. 7-225449 may be used. As for cobalt, and iron compounds, a hexacyano metal complex is preferably used. Specific examples of such hexacyano metal complexes include a ferricyanic acid ion, a ferrocyanic acid ion, and a hexacyanocobaltic acid ion. However, the examples are not limited to the above compounds. A phase in the silver halide, in which the metal complex is contained, is not particularly limited whereupon the the metal complex may be uniformly contained or may be contained in a manner in which a concentration in a core portion is higher, or a concentration in a shell porotion is higher.

7) Gelatin

Various kinds of gelatin can be used as gelatin to be contained in the photosensitive silver halide emulsion recited in the invention. In order to maintain an excellent dispersion state of the photosensitive silver halide emulsion in a coating solution containing an organic silver salt, it is preferable to use low molecular weight gelatin having a molecular weight in the range of from 500 to 60,000. These kinds of gelatin may be used at the time of grain formation or at the time of dispersion after a desalting treatment is performed; however, they are preferably used at the time of dispersion after the desalting treatment is performed.

8) Chemical Sensitization

The photosensitive silver halide grain is preferably chemically sensitized. As for preferable chemical sensitization methods, a sulfur sensitization method, a selenium sensitization method and a tellurium sensitization method can be used, as is well known in the art. Further, a noble metal sensitization using, for example, a gold compound, or a compound of platinum, palladium, or iridium, or a reduction sensitization can also be used. As for compounds that can be favorably used in the sulfur sensitization method, the selenium sensitization method and the tellurium sensitization method, known compounds can be used and compounds as described in JP-A No. 7-128768 can also be used.

The photosensitive silver halide emulsion recited in the invention preferably comprises an FED sensitizer (Fragmentable electron donating sensitizer) as a compound which generates two electrons by one photon. As for such FED sensitizers, compounds as described in U.S. Pat. Nos. 5,747,235, 5,747,236, 6,054,260, and 5,994,051, and JP-A No. 2002-287293 are preferable. As for steps in which the FED sensitizer is added, any step in a manufacturing process of the photosensitive emulsion, that is, in a preparation process from crystal growth to immediately before application is preferable. An amount thereof to be added is, though varying depending on various kinds of conditions, as a standard, preferably in the range of from $1\times10^{-7}$ mol to $1\times10^{-1}$ mol and more preferably from $1\times10^{-6}$ mol to $5\times10^{-2}$ mol, per 1 mol of silver halide.

9) Sensitizing Dye

As for sensitizing dyes applicable to the invention, a sensitizing dye capable of spectrally sensitizing the silver halide grain in a desired wavelength region when adsorbed thereby and having spectral sensitivity appropriate to spectral characteristics of an exposure light source can advantageously be selected. It is preferable that the photothermographic material recited in the invention is spectrally sensitized such that it has a peak of spectral sensitivity, particularly, in the range of from 600 nm to 900 nm, or in the range of from 300 nm to 500 nm. As for the sensitizing dyes and addition methods thereof, paragraphs [0103] to [0109] of JP-A No. 11-65021, compounds represented by the general formula (II) in JP-A No. 10-186572, dyes represented by the general formula (I) in JP-A No. 11-119374, paragraph [0106] of JP-A No. 11-119374, U.S. Pat. No. 5,510,236, dyes mentioned in Example 5 in U.S. Pat. No. 3,871,887, JP-A No. 2-96131, dyes disclosed in JP-A No. 59-48753, pp. 19 (line 38) to 20 (line 35) of EP-A No. 0803764, JP-A Nos. 2001-272747, 2001-290238, and 2002-023306, and the like can be referenced. Further, dyes represented by the general formulae (Da) to (Dd), specific examples of which is described as No. 1 to No. 53, described in Japanese Patent Application No. 2002-102319 can also favorably be used in the invention. These sensitizing dyes may be used either alone or in combination of two or more kinds. According to the invention, timing of adding the sensitization dye into the silver halide emulsion is preferably in a period of from after a desalting step to a coating step and more preferably in a period of from after desalting to before completion of chemical ripening.

An amount of the sensitizing dye recited in the invention to be added can be a desired amount in accordance with sensitivity or fogging performance, and preferably in the range of from $1\times10^{-6}$ mol to 1 mol and more preferably in the range of from $1\times10^{-4}$ mol to $1\times10^{-1}$ mol, per mol of silver halide in a photosensitive layer.

According to the invention, in order to enhance spectral sensitizing efficiency, a super-sensitizer can be used. As for such super-sensitizers recited in the invention, mentioned are compounds described in, for example, EP-A No. 587, 338, U.S. Pat. Nos. 3,877,943 and 4,873,184, JP-A Nos. 5-341432, 11-109547 and 10-111543.

10) Simultaneous Use of Silver Halides

In the photothermographic material recited in the invention, a single kind of photosensitive silver halide emulsion may be used, or two or more kinds of silver halide emulsions (for example, those having different average grain sizes, different halogen compositions, different crystal habits or different chemical sensitization conditions from one another) may simultaneously be used. Using a plurality of kinds of photosensitive silver halides having different extents of sensitivity from one another allows control of gradation. Related technologies are described in, for example, JP-A Nos. 57-119341, 53-106125,47-3929, 48-55730, 46-5187, 50-73627 and 57-150841. Sensitivity difference among individual emulsions is preferably 0.21 ogE or more.

11) Mixing of Silver Halide and Organic Silver Salt

It is preferable that the photosensitive silver halide grain recited in the invention is formed under a condition in which a non-photosensitive organic silver salt is absent and, then, chemically sensitized. Such procedure is taken because a method in which the silver halide is formed by a so-called conversion method, that is, by adding a halogenating agent to the organic silver salt, can not give sufficient sensitivity in some cases.

The organic silver salt is formed by firstly adding an alkali metal salt (such as sodium hydroxide, and potassium hydroxide) to an organic acid to convert at least a part of the organic acid into an alkali metal soap of the organic acid and, then, adding a water-soluble silver salt (such as silver nitrate) to the resultant solution whereupon a photosensitive silver halide can be added in any of such steps as described above. There are four main manners of adding a photosensitive silver halide, namely, A) previously adding a silver halide in an organic acid, then adding alkali metal salt, then, further adding a water-soluble silver salt; B) adding a silver halide after formation of an alkali metal soap of an organic acid, then adding a water-soluble silver salt; C) preparing an alkali metal soap of an organic acid, converting a part of the alkali metal soap to a silver salt, then, adding a silver halide, then, converting the remaining part of the alkali metal soap to a silver salt; and D) adding a silver halide after an organic silver salt is prepared; whereupon the manners B) and C) are preferable.

It is preferable that the organic silver salt containing the silver halide is in a fine particle dispersion state and, then, used. As for methods for allowing it to be in fine particles, at least one device selected from the group consisting of: a high-speed stirrer, a ball mill, a sand mill, a colloid mill, a vibration mill, a high-pressure homogenizer and the like can be used.

12) Addition of Silver Halide to Coating Solution and Mixing

A preferable timing at which the silver halide recited in the invention is added to a coating solution for an image-forming layer may be during a period of from 180 minutes before coating till immediately before coating, and preferably during a period of from 60 minutes before coating till 10 seconds before coating; however, a method and a condition of such addition is not particularly limited, so long as an effect recited in the invention can sufficiently be exhibited. Specific mixing methods include, for example, a method of mixing in a tank such that an average dwelling time, as calculated from an inflow rate and a supplying flow rate to a coater, is allowed to be within a predetermined duration, and a method of using a static mixer or the like as described, for example, in N. Harnby, M. F. Edwards & A. W. Nienow, (translated by Koji Takahashi), "Liquid Mixing Technology" Chap. 8, The Nikkan Kogyo Shimbun, Ltd. (1989).

1-1-5. Reducing Agent

It is preferable that a favorable reducing agent recited in the invention is a compound represented by the following general formula (R) which will be described in detail below:

General formula (R)

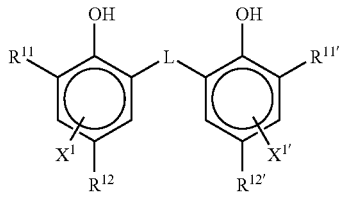

wherein $R^{11}$ and $R^{11'}$ each independently represent an alkyl group having from 1 to 20 carbon atoms;

$R^{12}$ and $R^{12'}$ each independently represent a substituent that can be substituted with a hydrogen atom or a benzene ring;

L represents an —S— group, or a —$CHR^{13}$— group, wherein $R^{13}$ represents a hydrogen atom or an alkyl group having from 1 to 20 carbon atoms; and $X^1$ and $X^{1'}$ each independently represent a group that can be substituted with a hydrogen atom or a benzene ring.

Next, each substituent will be described in detail.

1) $R^{11}$ and $R^{11'}$ $R^{11}$ and $R^{11'}$ each independently represent a substituted or non-substituted alkyl group having from 1 to 20 carbon atoms whereupon such substituent of the alkyl group is not particularly limited; examples of preferable substituents include an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom.

2) $R^{12}$ and $R^{12'}$, and $X^1$ and $X^{1'}$ $R^{12}$ and $R^{12'}$ each independently represent a group that can be substituted with a hydrogen atom or a benzene ring.

$X^1$ and $X^{1'}$ each independently represent a group that can be substituted with a hydrogen atom or a benzene ring. Examples of groups that can be substituted with a benzene ring include an alkyl group, an aryl group, a halogen atom, an alkoxy group, and an acylamino group.

3) L

L represents an —S— group or a —$CHR^{13}$ group, in which $R^{13}$ represents a hydrogen atom or an alkyl group having from 1 to 20 carbon atoms whereupon the alkyl group may have a substituent.

Specific examples of non-substituted alkyl groups represented by $R^{13}$ include a methyl group, an ethyl group, a propyl group, a butyl group, a heptyl group, an undecyl group, an isopropyl group, a 1-ethylpentyl group, and a 2,4,4-trimethylpentyl group.

Examples of substituents of the alkyl group, being the same as those of $R^{11}$, include a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, and sulfamoyl group.

4) Preferable Substituent $R^{11}$ and $R^{11'}$ each independently represent preferably a secondary or tertiary alkyl group having 3 to 15 carbon atoms whereupon specific examples of such alkyl groups include an isopropyl group, an isobutyl group, a t-butyl group, a t-amyl group, a t-octyl group, a cyclohexyl group, a cyclopentyl group, a 1-methylcyclohexyl group, a 1-methylcyclopropyl group. $R^{11}$ and $R^{11'}$ each independently represent more preferably a tertiary alkyl group having from 4 to 12 carbon atoms and, among other things, a t-butyl group, a t-amyl group, and a 1-methylcyclohexyl group are still more preferable, and a t-butyl group is most preferable.

$R^{12}$ and $R^{12'}$ each independently represent preferably an alkyl group having 1 to 20 carbon atoms whereupon specific examples of such alkyl groups include a methyl group, an ethyl group, a propyl group, a butyl group, an isopropyl group, a t-butyl group, a t-amyl group, a cyclohexl group, a 1-methylcyclohexyl group, a benzyl group, a methoxymethyl group, and methoxyethyl group and more preferably a methyl group, an ethyl group, a propyl group, an isopropyl group, and a t-butyl group.

$X^1$ and $X^{1'}$ each independently represent preferably a hydrogen atom, a halogen atom, and an alkyl group and more preferably a hydrogen atom.

L preferably represents a —$CHR^{13}$— group.

$R^{13}$ preferably represents a hydrogen atom or an alkyl group having 1 to 15 carbon atoms whereupon examples of alkyl groups include a methyl group, an ethyl group, a propyl group, an isopropyl group, and a 2,4,4-trimethylpentyl group. $R^{13}$ particularly preferably represents a hydrogen atom, a methyl group, a propyl group, and isopropyl group.

When $R^{13}$ represents a hydrogen atom, $R^{12}$ and $R^{12'}$ each independently represent preferably an alkyl group having 2 to 5 carbon atoms, more preferably an ethyl group and a propyl group and more preferably an ethyl group.

When $R^{13}$ represents a primary or secondary alkyl group having 1 to 8 carbon atoms, $R^{12}$ and $R^{12'}$ each independently represent preferably a methyl group. As for such primary or secondary alkyl groups each having 1 to 8 carbon atoms, a methyl group, an ethyl group, a propyl group, and an isopropyl group are preferable, and a methyl group, an ethyl group and a propyl group are more preferable.

When $R^{11}$, $R^{11'}$, $R^{12}$, and $R^{12'}$ each independently represent a methyl group, $R^{13}$ preferably represents a secondary alkyl group. Here, as for such secondary allyl groups represented by $R^{13}$, an isopropyl group, an isobutyl group, and a 1-ethylpentyl group are preferable, and an isopropyl group is more preferable.

The above-described reducing agents exhibit various kinds of thermal developing performance by combining $R^{11}$, $R^{11'}$, $R^{12}$, $R^{12'}$, and $R^{13}$ thereamong in various manners. Since the thermal developing performance can be adjusted by simultaneously using two or more kinds of reducing agents at various mixing ratios, it is preferable to use two or more kinds of reducing agents in combination depending on applications.

Specific examples of compounds represented by the general formula (R) recited in the invention are described below; however, the invention is by no means limited thereto.

(I-1)

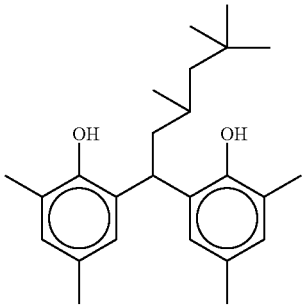

(I-2)

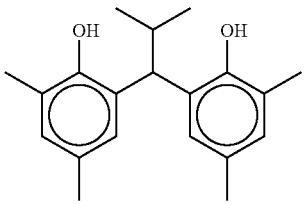

(I-3)

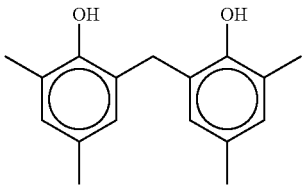

-continued (I-4)

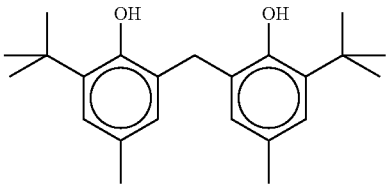

(I-5)

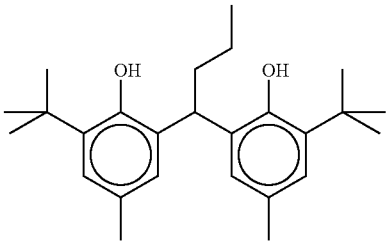

(I-6)

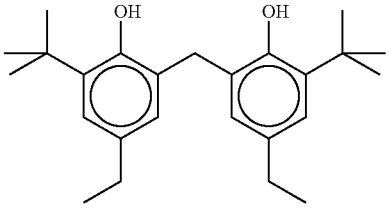

(I-7)

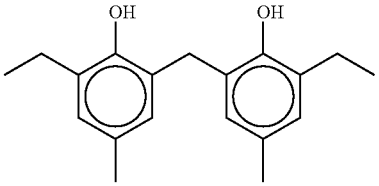

(I-8)

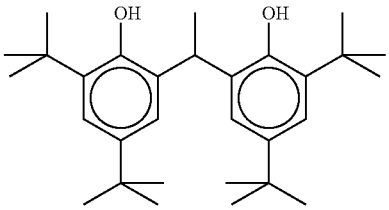

(I-9)

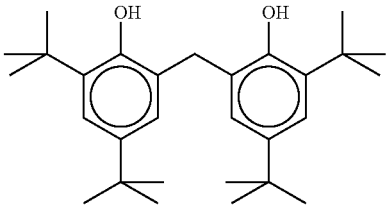

(I-10)

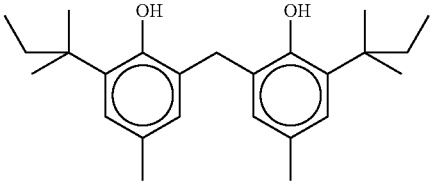

-continued (I-11)

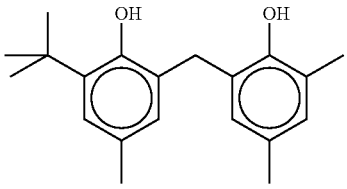

(I-12)

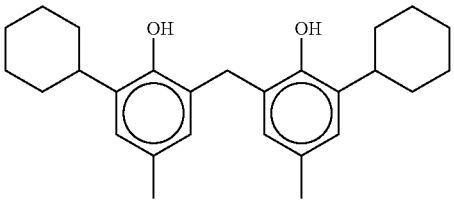

(I-13)

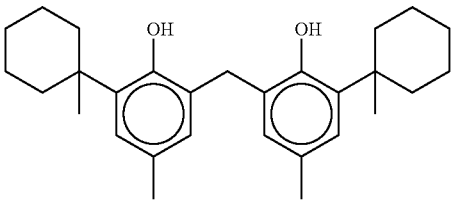

(I-14)

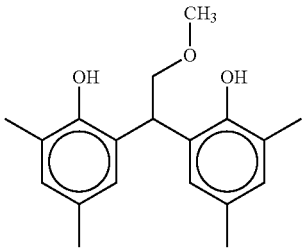

(I-15)

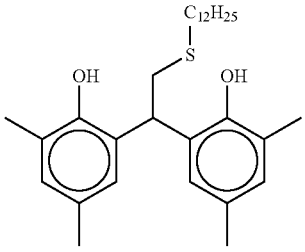

(I-16)

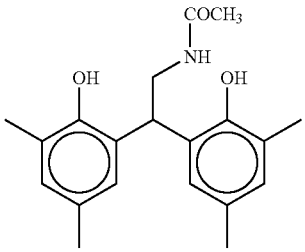

(I-17)

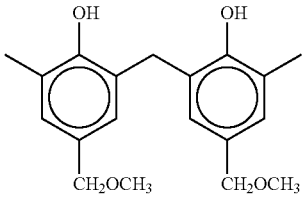

-continued (I-18)

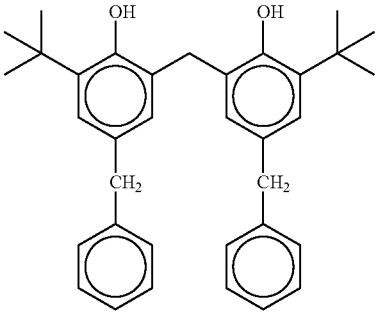

(I-19)

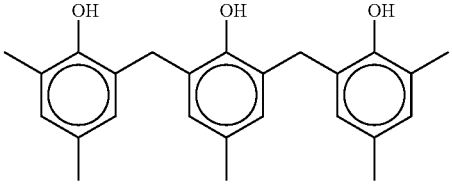

(I-20)

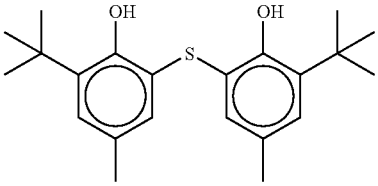

According to the invention, an amount of the reducing agent to be added is preferably in the range of 0.01 $g/m^2$ to 5.0 $g/m^2$ and more preferably in the range of 0.1 $g/m^2$ to 3.0 $g/m^2$ and the reducing agent is contained, based on 1 mol of silver in a face having an image-forming layer, preferably in the range of 5% by mol to 50% by mol and more preferably in the range of 10% by mol to 40% by mol.

The reducing agent recited in the invention can be added to an image-forming layer containing an organic silver salt and a photosensitive silver halide or an adjacent layer thereto; however, the reducing agent is preferably contained in the image-forming layer.

The reducing agent recited in the invention may be added to a coating solution in any form, for example, in a solution form, an emulsified dispersion form, and a solid fine particle dispersion form.

1-1-6. Non-Photosensitive Organic Silver Salt

A non-photosensitive organic silver salt used in the invention is relatively stable to light, but, when heated to 80° C. or more in the presence of an exposed photosensitive silver halide and a reducing agent, it functions as a silver salt to form a silver image. The organic silver salt may be any organic substance which can supply a silver ion that can be reduced. Such non-photosensitive organic silver salts are described in, for example, paragraphs [0048] and [0049] of JP-A No. 10-62899, pp. 18 (line 24) to 19 (line 37) of EP-A No. 0803764, EP-A No. 0962812, JP-A Nos. 11-349591, 2000-7683, and 2000-72711. Silver salts of organic acids, particularly, long chain aliphatic carboxylic acids (each having 10 to 30 carbon atoms, preferably 15 to 28 carbon atoms) are preferable. Preferable examples of such organic silver salts of aliphatic acids include silver behenate, silver arachidate, silver stearate, silver oleate, silver laurate, silver caproate, silver myristate, silver palmitate, and mixtures thereof. According to the invention, it is preferable to use, among these organic silver salts, an organic silver salt in which a content of silver behenate is in the range of 30% by mol to 90% by mol and particularly preferably in the range of 40% by mol to 70% by mol. As for remaining organic silver salts, a silver salt of a long-chain aliphatic carboxylic acid, preferably having from 10 to 30 carbon atoms, more preferably having from 15 to 28 carbon atoms, is preferably used.

A shape of the organic silver salt recited in the invention is not particularly limited, and any form of cubic, rectangular, rod-like, acicular, tabular, and scaly forms is permissible, and the cubic, rectangular, rod-like, and acicular forms are relatively preferable thereamong. The terms "cubic, rectangular, rod-like, and acicular organic silver salts" as used herein are defined as described below. An organic silver salt is observed under an electron microscope, and a shape of an organic silver salt grain is approximated to a rectangular parallelepiped. Three different edges of the rectangular parallelepiped are represented as a, b and c ($a \leqq b \leqq c$). A grain which satisfies the relation of $0.9 \leqq a/c < 1.0$ is defined as a cubic grain. A grain which satisfies the relations of $0.2 \leqq a/c < 0.9$ and $0.2 \leqq b/c < 1.0$ is defined as a rectangular grain. A grain which satisfies the relations of $0.1 \leqq a/c < 0.2$ and $0.1 \leqq b/c < 0.3$ is defined as a rod-like grain. A grain which satisfies the relations of $a/c < 0.1$ and $b/c < 0.1$ is defined as an acicular grain. According to the invention, a preferable form of the organic silver salt is an acicular grain or a rod-like grain whereupon the acicular grain is most preferable.

The organic silver salt having a smaller grain size is preferable. It is well known in the field of a silver halide photographic material that there is an inverse proportional relation between a size of a silver salt crystal grain and a covering power thereof. This relation is valid also in the photothermographic material recited in the invention. Thus, when the organic silver salt grain in the image-forming portion of the photothermographic material has larger size, a covering power thereof decreases to reduce an image density. As for the grain size of the organic silver salt, specifically, a grain size in which a length of a short axis is in the range of 0.01 μm to 0.20 μm and a length of a long axis is in the range of 0.10 μm to 5.0 μm, is preferable. A grain size in which a length of a short axis is in the range of 0.01 μm to 0.15 μm and a length of a long axis is in the range of 0.10 μm to 4.0 μm, is more preferable. A grain size distribution of the organic silver salts is preferably monodispersed. The term "monodispersed" as used herein is intended to mean that the percentage of a value obtained by dividing the standard deviation of the length of the short axis or long axis by the length of the short axis or long axis, respectively, is preferably 100% or less, more preferably 80% or less, and still more preferably 50% or less.

As for a method of measuring the shape of the organic silver salt, the shape of the organic silver salt can be determined by a method utilizing a transmission electron microscope image of an organic silver salt dispersion. Another method of determining the monodispesibility is a method of obtaining the standard deviation of a volume weight average diameter of the organic silver salt whereupon the percentage (variation coefficient) of the value obtained by dividing the standard deviation by the volume weight average diameter is preferably 100% or less, more preferably 80% or less, and still more preferably 50% or less. As for a measurement method, for example, a laser light scattering-type grain size measuring apparatus which is available in the market can be utilized.

The organic silver salt is prepared by the steps comprising: forming grains in a water-soluble solvent; drying the thus-formed grains; and dispersing the thus-dried grains in a solvent such as MEK. Such drying is performed in a air flow-type flush jet dryer at an oxygen partial pressure of preferably 15% by vol or less, more preferably in the range of 0.01% by vol to 15% by vol and still more preferably in the range of from 0.01% by vol to 10% by vol.

The organic silver salt recited in the invention can be used in a desired amount whereupon an amount of silver to be applied is preferably in the range of 0.1 $g/m^2$ to 5 $g/m^2$ and more preferably in the range of 1 $g/m^2$ to 3 $g/m^2$.

1-1-7 Binder

As binders recited in the invention, any natural or synthetic resin can be used such as gelatin, polyvinyl butyral, polyvinyl acetal, polyvinyl chloride, polyvinyl acetate, cellulose acetate, polyolefin, polyester, polystyrene, polyacrylonitrile, polycarbonate, polyvinyl butyral, butyl ethyl cellulose, a methacrylate copolymer, a maleic anhydride ester copolymer, polystyrene, and a butadiene-styrene copolymer. Particularly, polyvinyl butyral is preferably contained in the photosensitive layer as a binder; specifically, polyvinyl butyral can be used as a binder in an amount of 50% by mass or more on the basis of an entire components of the binder in the photosensitive layer. Of course, examples of binders include a copolymer and a terpolymer. An entire amount of polyvinyl butyral is, based on an entire amount of the binder in the photosensitive layer, preferably in the range of 50% by mass to 100% by mass and more preferably in the range of 70% by mass to 100% by mass. Tg of the binder is preferably in the range of 40° C. to 90° C. and more preferably in the range of 50° C. to 80° C. Here, Tg represents a glass transition temperature.

As for the entire amount of the binder, the binder is used in an amount sufficient for holding components of the image-forming layer within the layer. In other words, the binder is used in an amount in such a range that is efficient for functioning as a binder. The efficient range can properly be determined by a person in the field. As a standard amount of the binder that can hold the organic silver salt, a weight ratio of the binder to the organic silver salt is preferably in the range of from 15:1 to 1:3 and particularly preferably in the range of from 8:1 to 1:2.

1-1-8. Development Accelerator

In the photothermographic material recited in the invention, sulfonamide phenolic compounds represented by the general formula (A) as described in JP-A Nos. 2000-267222 and 2000-330234, hindered phenolic compounds represented by the general formula (II) as described in JP-A No. 2001-92075, hydrazine-type compounds represented by the general formula (1) as described in JP-A Nos. 10-62895 and No. 11-15116, the general formula (D) as described in JP-A No. 2002-156727, and the general formula (1) as described in JP-A No. 2002-278017, and phenolic or naphthol-type compounds represented by the general formula (2) as described in JP-A No. 2001-264929 are favorably used. These development accelerators are used, based on the reducing agent, in an amount of 0.1% by mol to 20% by mol, preferably 0.5% by mol to 10% by mol, and more preferably 1% by mol to 5% by mol. As a method of introducing the development accelerator to the photosensitive material, methods similar to the methods of introducing the reducing agents can be employed, whereupon it is preferably incorporated after being dissolved in an organic solvent.

Among the above-described development accelerators used in the invention, the hydrazine-type compounds represented by the general formula (D) as described in JP-A No. 2002-156727 and the phenolic or naphthol-type compounds represented by the general formula (2) as described in JP-A No. 2001-264929 are more preferable.

Particularly preferable development accelerators used in the invention are compounds represented by the general formulae (A-1) and (A-2) described below.

Q1-NHNH-Q2 (General formula A-1)

In the general formula (A-1), Q1 represents an aromatic group, or a heterocyclic group which combines with —NHNH-Q2 via a carbon atom; and Q2 represents a carbamoyl group, an acyl group, an alkoxycarbonyl group, an aryloxycarbonyl group, a sulfonyl group, and a sufamoyl group.

In the general formula (A-1), the aromatic group or the heterocyclic group represented by Q1 is preferably a 5- to 7-membered unsaturated ring. Preferable examples of such rings include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, and a thiophene ring whereupon a condensed ring in which these rings are condensed with each other is also preferable.

These rings may each have a substituent whereupon, when these rings each have two or more substituents, these substituents may be same with or different from each other. Examples of the substituents include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsufonyl group, an arylsulfonyl group, an alkoxycarbonyl group, an aryloxycarbonyl group, and an acyl group. When these substituents are groups that can be substituted by a substituent, these substituents may further have a substituent whereupon examples of such substituent on a substituent on Q1 include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsufonyl group, an arylsulfonyl group, and an acyloxy group.

The carbamoyl group represented by Q2 is a carbamoyl group preferably having 1 to 50 carbon atoms and more preferably 6 to 40 carbon atoms whereupon examples of such carbamoyl groups include a unsubstituted carbamoyl group, a methyl carbamoyl group, an N-ethyl carbamoyl group, an N-propyl carbamoyl group, an N-sec-butyl carbamoyl group, an N-octyl carbamoyl group, an N-cyclohexyl carbamoyl group, an N-tert-butyl carbamoyl group, an N-dodecyl carbamoyl group, an N-(3-dodecyloxypropyl) carbamoyl group, an N-octadecyl carbamoyl group, an N-{3-(2,4-tert-pentylphenoxy)propyl} carbamoyl group, an N-(2-hexyldecyl) carbamoyl group, an N-phenyl carbamoyl group, an N-(4-dodecyloxy phenyl) carbamoyl group, an N-(2-chloro-5-dodecyloxycarbonylphenyl) carbamoyl group, an N-naphthyl carbamoyl group, an N-3-pyridyl carbamoyl group, and an N-benzyl carbamoyl group.

The acyl group represented by Q2 is an acyl group preferably having 1 to 50 carbon atoms and more preferably 6 to 40 carbon atoms whereupon examples of such acyl groups include a formyl group, an acetyl group, a 2-methylpropanoyl group, a cyclohexyl carbonyl group, an octanoyl group, a 2-hexyldecanoyl group, a dodecanoyl group, a chloroacetyl group, a trifluoroacetyl group, a benzoyl group, a 4-dodecyloxybenzoyl group, and a 2-hydroxymethyl benzoyl group. The alkoxycarbonyl group represented by Q2 is an alkoxycarbonyl group preferably having 2 to 50 carbon atoms and more preferably 6 to 40 carbon atoms whereupon examples of such alkoxycarbonyl groups include a methoxycarbonyl group, an ethoxycarbonyl group, an isobutyloxycarbonyl group, a cyclohexyloxycarbonyl group, a dodecyloxycarbonyl group, and a benzyloxycarbonyl group.

The aryloxycarbonyl group represented by Q2 is an aryloxycarbonyl group preferably having 7 to 50 carbon atoms and more preferably 7 to 40 carbon atoms whereupon examples of such aryloxycarbonyl groups include a phenoxycarbonyl group, a 4-octyloxyphenoxycarbonyl group, a 2-hydroxymethyl phenoxycarbonyl group, and a 4-dodecyloxyphenoxycarbonyl group. The sulfonyl group represented by Q2 is a sulfonyl group preferably having 1 to 50 carbon atoms and more preferably 6 to 40 carbon atoms whereupon examples of such sulfonyl groups include a methyl sulfonyl group, a butyl sulfonyl group, an octyl sulfonyl group, a 2-hexadecyl sulfonyl group, a 3-dodecyloxypropyl sulfonyl group, a 2-octyloxy-5-tert-octylphenyl sulfonyl group, and a 4-dodecyloxyphenyl sulfonyl group.

The sulfamoyl group represented by Q2 is a sulfamoyl group having preferably 0 to 50 carbon atoms and more preferably 6 to 40 carbon atoms whereupon examples of such sulfamoyl groups include an unsubstituted sulfamoyl group, an N-ethyl sulfamoyl group, an N-(2-ethylhexyl) sulfamoyl group, an N-decyl sulfamoyl group, an N-hexadecyl sulfamoyl group, an N-{3-(2-ethylhexyloxy)propyl} sulfamoyl group, an N-(2-chloro-5-dodecyloxycarbonylphenyl) sulfamoyl group, and an N-(2-tetradecyloxyphenyl) sulfamoyl group. The group represented by Q2 may further have the group described as an example of a 5- to 7-membered unsaturated substituent represented by Q1 at a position at which a substituent can substitute Q2 whereupon, when the group has two or more substituents, these substituents may be same with or different from one another.

Next, a preferable range of the compound represented by the general formula (A-1) will be described. As Q1, a 5- or 6-membered unsaturated ring is preferable, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isooxazole ring and a condensed ring in which one of these rings is condensed with a benzene ring or an unsaturated heterocycle, are more preferable. Further, as Q2, a carbamoyl group is preferable and a carbamoyl group having a hydrogen group on a nitrogen atom is particularly preferable.

General formula (A-2)

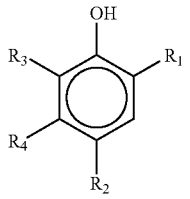

In the general formula (A-2), $R_1$ represents an alkyl group, an acyl group, an acylamino group, a sulfonamide group, an alkoxycarbonyl group, or a carbamoyl group;

$R_2$ represents a hydrogen atom, a halogen atom, an alkyl group, an alkoxy group, an aryloxy group, an alkylthio group, an arylthio group, an acyloxy group, or a carbonic acid ester; and $R_3$, and $R_4$ each independently represent a group that can be substituted on a benzene ring described as an example of the substituent in the general formula (A-1). $R_3$, and $R_4$ may be bonded to each other to form a condensed ring.

As $R_1$, preferable are an alkyl group having 1 to 20 carbon atoms (for example, a methyl group, an ethyl group, an isopropyl group, a butyl group, a tert-octyl group, or a cyclohexyl group), an acylamino group (for example, an acetylamino group, a benzoylamino group, a methylureido group, or a 4-cyanophenylureido group), and a carbamoyl group (for example, an n-butyl carbamoyl group, an N,N-diethyl carbamoyl group, a phenyl carbamoyl group, a 2-chlorophenyl carbamoyl group, or a 2,4-dichlorophenyl carbamoyl group) whereupon an acylamino group (including an ureido group and an urethane group) is more preferable.

As $R_2$, preferable are a halogen atom (more preferably a chlorine atom, or a bromine atom), an alkoxy group (for example, a methoxy group, a butoxy group, an n-hexyloxy group, an n-decyloxy group, a cyclohexyloxy group, or a benzyloxy group), and an aryloxy group (for example, a phenoxy group or a naphthoxy group).

As $R_3$, preferable are a hydrogen atom, a halogen atom and an alkyl group having 1 to 20 carbon atoms whereupon a halogen atom is most preferable. As $R_4$, preferable are a hydrogen atom, an alkyl group, and an acylamino group whereupon an alkyl group and an acylamino group are more preferable. Preferable substituents of these groups are the same as in the case of $R_1$. It is also preferable that, when $R_4$ represents an acylamino group, $R_3$ and $R_4$ may be bonded to each other to form a carbostyryl ring.

In the general formula (A-2), when $R_3$ and $R_4$ are bonded to each other to form a condensed ring, the condensed ring is particularly preferably a naphthalene ring. A same substituent as that mentioned in the general formula (A-1) may be combined to the naphthalene ring. When the general formula (A-2) represents a naphthol-type compound, $R_1$ preferably represents a carbamoyl group. Among such carbamoyl groups, benzoyl group is particularly preferable. As $R_2$, an alkoxy group and an aryloxy group are preferable whereupon an alkoxy group is particularly preferable.

Next, preferable examples of the development accelerators recited in the invention will be described; however, the invention is by no means limited thereto.

(A-1)

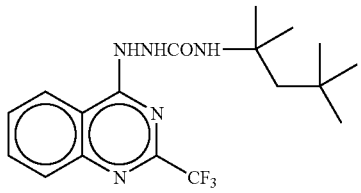

(A-2)

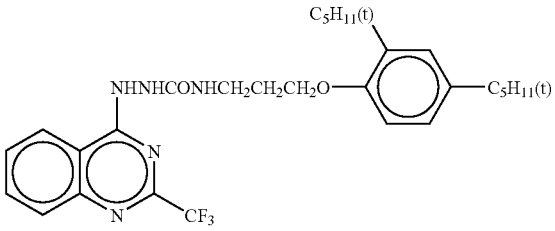

-continued (A-3)

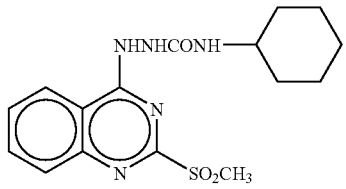

(A-4)

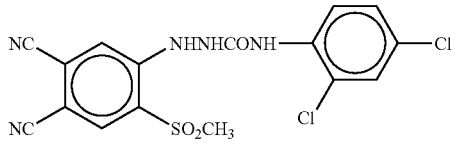

(A-5)

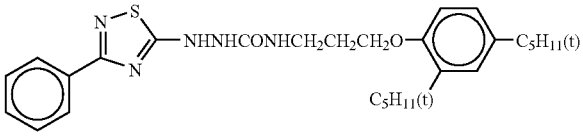

(A-6)

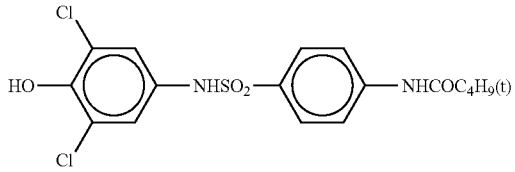

(A-7)

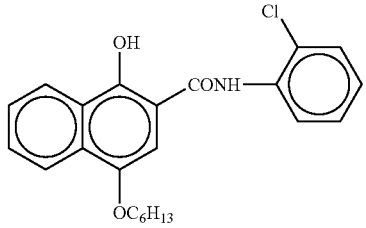

(A-8)

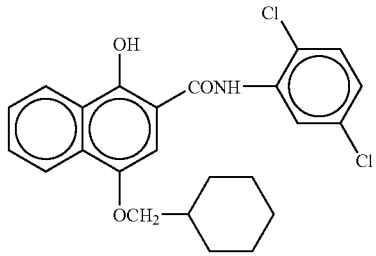

(A-9)

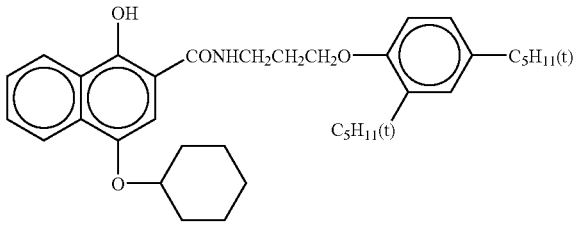

-continued (A-10)

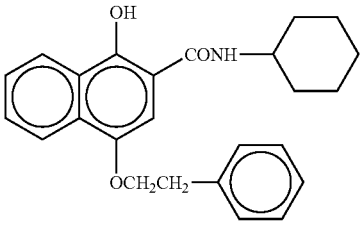

(A-11)

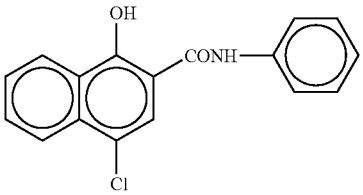

(A-12)

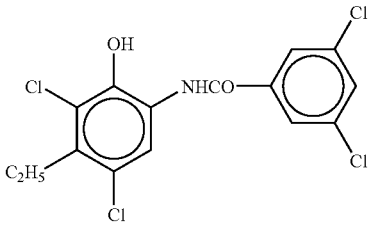

1-1-9. Hydrogen Bonding Compound

When a reducing agent recited in the invention has an aromatic hydroxyl group (—OH), or an amino group, particularly when it is one of the above-described bisphenols, it is preferable to use simultaneously a non-reducing compound having a group that can form a hydrogen bond with such groups of the reducing agent.

Examples of a group that can form a hydrogen bond with a hydroxyl group or an amino group include a phosphoryl group, a sulfoxide group, a sulfonyl group, a carbonyl group, an amide group, an ester group, a urethane group, a ureido group, a t-amino group, and a nitrogen-containing aromatic group. Among these groups, compounds having a phosphoryl group, a sulfoxide group, an amide group (having no >N—H group and blocked as >N—Ra wherein Ra represents a substituent exclusive of H), a urethane group (having no >N—H group and blocked as >N—Ra wherein Ra represents a substituent exclusive of H), a ureido group (having no >N—H group and blocked as >N—Ra wherein Ra represents a substituent exclusive of H) are preferable.

Particularly favorable hydrogen bonding compounds recited in the invention are compounds represented by the following general formula (D):

General formula (D)

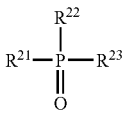

wherein $R^{21}$, $R^{22}$, and $R^{23}$ each independently represent an alkyl group, an aryl group, an alkoxy group, an aryloxy group, an amino group, or a heterocyclic group whereupon these groups may be non-substituted or have a substituent.

When any one of $R^{21}$, $R^{22}$, and $R^{23}$ has a substituent, examples of such a substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group and a phosphoryl group; here, the substituent is preferably an alkyl group or an aryl group whereupon examples of such alkyl groups and aryl groups include a methyl group, an ethyl group, an isopropyl group, a t-butyl group, a t-octyl group, a phenyl group, a 4-alkoxyphenyl group, and a 4-acyloxyphenyl group.

Specific examples of such an alkyl group represented by $R^{21}$, $R^{22}$, or $R^{23}$ include a methyl group, an ethyl group, a butyl group, an octyl group, a dodecyl group, an isopropyl group, a t-butyl group, a t-amyl group, a t-octyl group, a cyclohexyl group, a 1-methyl cyclohexyl group, a benzyl group, a phenethyl group, and a 2-phenoxypropyl group.

Specific examples of such aryl groups include a phenyl group, a cresyl group, a xylyl group, a naphthyl group, a 4-t-butylphenyl group, a 4-t-octylphenyl group, a 4-anisidyl group, and a 3,5-dichlorophenyl group.

Specific examples of such alkoxy groups include a methoxy group, an ethoxy group, a butoxy group, an octyloxy group, a 2-ethylhexyloxy group, a 3,5,5-trimethyl hexyloxy group, a dodecyloxy group, a cyclohexyloxy group, a 4-methyl cyclohexyloxy group, and a benzyloxy group.

Specific examples of such aryloxy groups include a phenoxy group, a cresyloxy group, an isopropylphenoxy group, a 4-t-butylphenoxy group, a naphthoxy group, and a biphenyloxy group.

Specific examples of such amino groups include a dimethylamino group, a diethylamino group, a dibutylamino group, a dioctylamino group, an N-methyl-N-hexylamino group, a dicyclohexylamino group, a diphenylamino group, and an N-methyl-N-phenylamino group.

As for $R^{21}$, $R^{22}$, and $R^{23}$, an alkyl group, an aryl group, an alkoxy group, and aryloxy group are preferable. From the standpoint of an effect of the invention, it is preferable that at least one of $R^{21}$, $R^{22}$ and $R^{23}$ is an alkyl group or an aryl group, and it is more preferable that at least two of $R^{21}$, $R^{22}$ and $R^{23}$ are an alkyl group or an aryl group. Further, taking availability at a low price into consideration, it is preferable that $R^{21}$, $R^{22}$, and $R^{23}$ are the same group with one another.

Specific examples of hydrogen bonding compounds that can be used in the invention, representative example of which is the compound represented by the general formula (D), are shown below; however, the invention is by no means limited thereto.

(D-1)

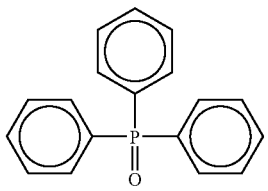

-continued
(D-2)
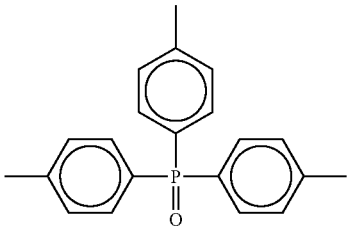
(D-3)
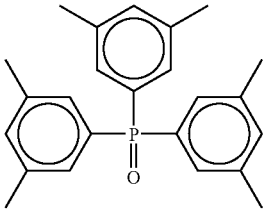
(D-4)
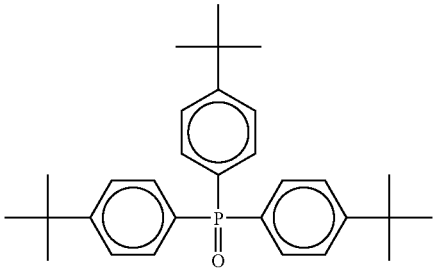
(D-5)
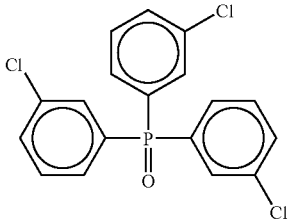
(D-6)
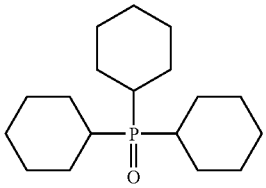
(D-7)
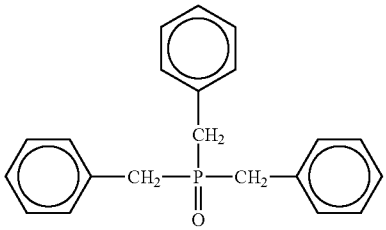
-continued
(D-8)
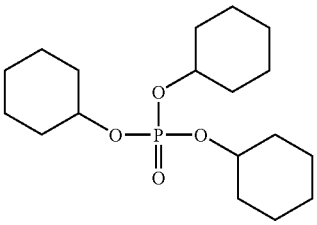
(D-9)
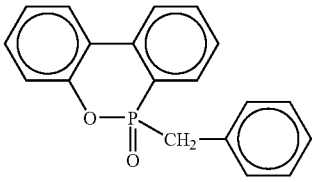
(D-10)
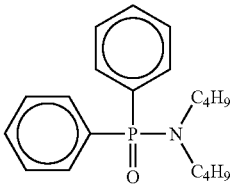
(D-11)
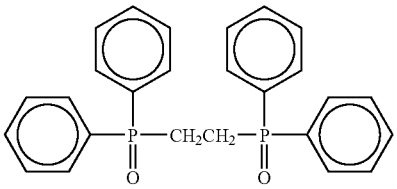
(D-12)
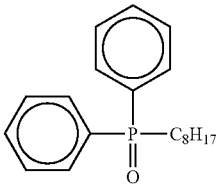
(D-13)
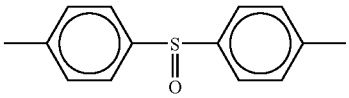
(D-14)
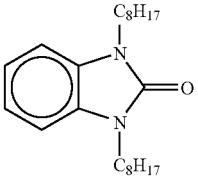
(D-15)
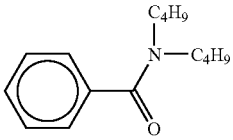

Specific examples of the hydrogen bonding compounds further include those described in EP-A No. 1096310, JP-A Nos. 2002-156727 and 2002-318431.

The compound represented by the general formula (D) recited in the invention may be contained in the coating solution, in the same manner as in the case of the reducing agent, in a form of the solution, the emulsified dispersion, and the solid fine particle dispersion, to be used in a photosensitive material. The solution form is preferable. The compound recited in the invention forms a complex in a solution state by forming a hydrogen bond with a compound having a phenolic hydroxyl group or an amino group and the complex can be isolated in a form of a crystal of the complex in some cases depending on combinations of the reducing agents and the compounds represented by the general formula (D) recited in the invention.

The compound represented by the general formula (D) recited in the invention is used, based on the reducing agent, preferably in an amount of 1% by mol to 200% by mol, more preferably 10% by mol to 150% by mol and still more preferably 20% by mol to 100% by mol.

1-1-10. Other Additives

1) Disulfide Compound

According to the invention, for the purpose of controlling development by inhibiting or accelerating the development, improving spectral sensitization efficiency, improving storage properties before and after the development and the like, it is preferable that a disulfide compound represented by the formula Ar—S—S—Ar is contained in the photosensitive material. In the formula, Ar represents an aromatic ring or a condensed aromatic ring having at least one atom selected from the group consisting of: a nitrogen atom, a sulfur atom, an oxygen atom, a selenium atom, and a tellurium atom.

Preferable examples of such disulfides include benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazoline whereupon benzimidazole, benzothiazole, and benzotellurazole are more preferable.

These aromatic rings may each have a substituent. Preferable examples of such substituents include a halogen atom (such as Br and Cl), a hydroxyl group, an amino group, a carboxyl group, an alkyl group (preferably having 1 to 4 carbon atoms), an alkoxy group (preferably having 1 to 4 carbon atoms), and an aryl group (that may have a substituent).

An amount of the disulfide compound to be added is, based on 1 mol of silver halide in the image-forming layer, preferably in the range of from 0.001 mol to 1 mol, and more preferably in the range of from 0.003 mol to 0.1 mol.

2) Toning Agent

In the photothermographic material recited in the invention, a toning agent is preferably added. Such toning agents are described in paragraphs [0054] to [0055] of JP-A No. 10-62899, page 21, lines 23 to 48 of EP-A No. 0803764, JP-A Nos. 2000-356317 and 2000-187298. In particular, phthalazinones (such as phthalazinone, phthalazinone derivatives or their metal salts, for example, 4-(1-naphthyl) phthalazinone, 6-chlorophthalazinone, 5,7-dimethoxy phthalazinone and 2,3-dihydro- 1,4-phthalazinedione); combinations of phthalazinones and phthalic acids (for example, phthalic acid, 4-methylphthalic acid, 4-nitrophthalic acid, diammonium phthalate, sodium phthalate, potassium phthalate and tetrachlorophthalic acid anhydride); phthalazines (such as phthalazine, phthalazine derivatives or their metal salts, for example, 4-(1-naphthyl) phthalazine, 6-isopropyl phthalazine, 6-t-butyl phthalazine, 6-chloro phthalazine, 5,7-dimethoxyphthalazine and 2,3-dihydrophthalazine) are preferable whereupon, in combinations with a silver halide high in silver iodide content, combinations of phthalazines and phthalic acids are particularly preferred.

An amount of the toning agent to be added is, based on 1 mol of silver in the image-forming layer, preferably in the range of 0.1% by mol to 50% by mol and more preferably in the range of 0.5% by mol to 20% by mol.

3) Antifoggant

According to the invention, it is preferable to contain any one of compounds which are represented by the following general formula (H) as an antifoggant:

$$Q\text{-}(Y)n\text{-}C(Z_1)\text{-}(Z_2)X \qquad \text{(General formula H)}$$

In the general formula (H), Q represents an alkyl group, an aryl group, or a heterocyclic group;

Y represents a divalent linking group;

n represents 0 or 1;

$Z_1$ and $Z_2$ each independently represent a halogen atom; and

X represnts a hydrogen atom or an electron-attracting group.

In the general formula (H), Q preferably represents a phenyl group substituted by an electron-attracting group whose Hammet's substituent constant σp has a positive value. Regarding the Hammet's substituent constant, for example, Journal of Medicinal Chemistry, 1973, Vol. 16, No. 11, pp. 1207 to 1216 can be referenced.

Examples of such electron-attracting groups include a halogen atom (for example, a fluorine atom (σp value: 0.06)), a chlorine atom (σp value: 0.23), a bromine atom (σp value: 0.23) and an iodine atom (σp value: 0.18)), a trihalomethyl group (for example, a tribromomethyl group (σp value: 0.29), a trichloromethyl group (σp value: 0.33) and a trifluoromethyl group (σp value: 0.54)), a cyano group (σp value: 0.66), a nitro group (σp value: 0.78), an aliphatic, aryl or a heterocyclic sulfonyl group (for example, a methane sulfonyl group (σp value: 0.72)), an aliphatic, aryl or a heterocyclic acyl group (for example, an acetyl group (σp value: 0.50) and a benzoyl group (σp value: 0.43)), an alkynyl group (for example, a group of C≡CH (σp value: 0.23)), an aliphatic, aryl or a heterocyclic oxycarbonyl group (for example, a methoxycarbonyl group (σp value: 0.45) and a phenoxycarbonyl group (σp value; 0.44)), a carbamoyl group (σp value: 0.36), a sulfamoyl group (σp value: 0.57), a sulfoxide group, a heterocyclic group and a phosphoryl group.

A σp value is preferably in the range of 0.2 to 2.0, and more preferably in the range of 0.4 to 1.0.

Examples of preferable electron-attracting groups include a carbamoyl group, an alkoxycarbonyl group, an alkylsulfonyl group, an alkylphosphoryl group, a carboxyl group, an alkyl- or aryl-carbonyl group, and an arylsulfonyl group whereupon a carbamoyl group, an alkoxycarbonyl group, an alkylsulfonyl group, and an alkylphosphoryl group are particularly preferable, and a carbamoyl group is most preferable.

In the general formula (H), X preferably represents an electron-attracting group, and more preferably one member selected from the group consisting of: a halogen atom, an aliphatic, aryl or a heterocyclic sulfonyl group, an aliphatic, aryl or a heterocyclic acyl group, an aliphatic, aryl or a heterocyclic oxycarbonyl group, a carbamoyl group and a sulfamoyl group whereupon a halogen atom is particularly preferred.

Among such halogen atoms, a chlorine atom, a bromine atom and an iodine atom are preferable; a chlorine atom and a bromine atom are more preferable; and a bromine atom is particularly preferable.

In the general formula (H), Y preferably represents —C(═O)—, —SO—, or —$SO_2$— whereupon —C(═O)— and —$SO_2$— are more preferable, and —$SO_2$— is particularly preferable.

In the general formula (H), n represents 0 or 1 whereupon 1 is preferable.

Specific examples of compounds represented by the general formula (H) recited in the invention are described below; however, the invention is by no means limited thereto.

(4-1)

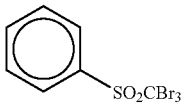

(4-2)

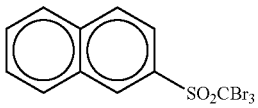

(4-3)

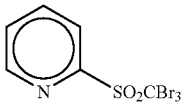

(4-4)

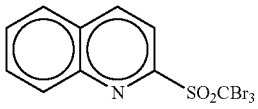

(4-5)

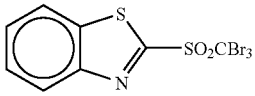

(4-6)

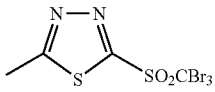

(4-7)

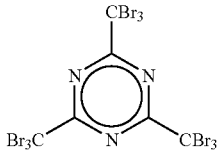

(4-8)

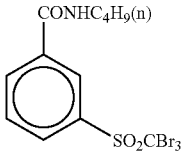

-continued (4-9)

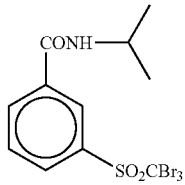

(4-10)

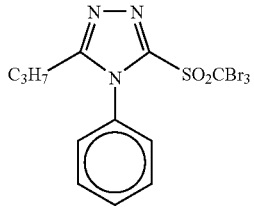

(4-11)

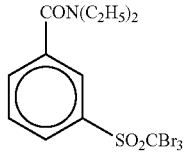

(4-12)

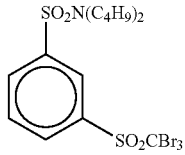

(4-13)

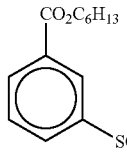

(4-14)

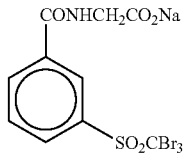

(4-15)

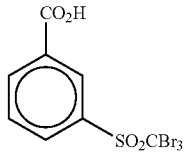

(4-16)

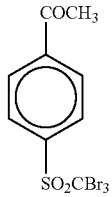

(4-17)

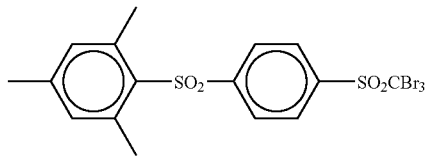

-continued (4-18)

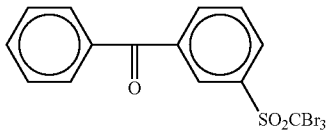

(4-19)

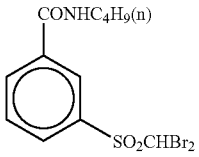

(4-20)

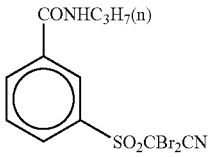

(4-21)

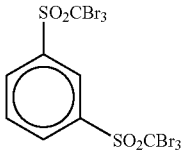

(4-22)

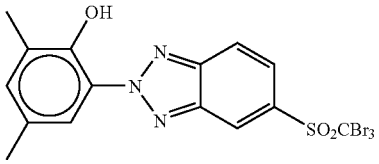

(4-23)

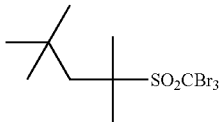

The compound represented by the general formula (H) recited in the invention is used, based on 1 mol of non-photosensitive silver salt in the image-forming layer, preferably in an amount of $1\times10^{-4}$ mol to 0.8 mol, more preferably $1\times10^{-3}$ mol to 0.1 mol, and still more preferably $5\times10^{-3}$ mol to 0.05 mol.

In particular, when the silver halide high in silver iodide content recited in the invention is used, an amount of the compound represented by the general formula (H) to be added is an important factor for obtaining a sufficient suppression of fogging whereupon the compound is most preferably used in an amount of $5\times10^{-3}$ mol to 0.03 mol.

As for methods for allowing the compound represented by the general formula (H) recited in the invention to be contained in the photosensitive material, the same methods as mentioned in the case of the reducing agent are applicable.

A melting point of the compound represented by the general formula (H) is preferably 200° C. or less and more preferably 170° C. or less.

As for other organic polyhalogenated compounds used in the invention, compounds disclosed in patents described in paragraphs [0111] to [0112] of JP-A No. 11-65021 are cited. In particular, organic halogen compounds represented by the formula (P) in JP-A No. 2000-284399, organic polyhalogen compounds represented by the general formula (II) in JP-A No. 10-339934 and organic polyhalogen compounds described in JP-A No. 2001-033911 are preferable.

4) Other Antifoggants

Examples of the appropriate antifoggants, stbilizers, and stabilizer precursors that can be used alone or in combination of them according to the invention, include thiazonium salts described in U.S. Pat. Nos. 2,131,038 and 2,694,716, azaindenes described in U.S. Pat. Nos. 2,886,487 and 2,444,605, compounds described in JP-A No. 9-329865 and U.S. Pat. No. 6,083,681, mercury salts described in U.S. Pat. No. 2,728,663, urazols described in U.S. Pat. No. 3,287,135, sulfocatechols described in U.S. Pat. No. 3,235,652, oximes, nitrons, and nitroindazoles described in UKP No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665, and 4,442,202, triazines described in U.S. Pat. Nos. 4,128,557, 4,137,079, 4,138,365, and 4,459,350, and phosphorus compounds described in U.S. Pat. No. 4,411,985.

In the photothermographic material recited in the invention, it is sometimes advantageous to add a mercury (II) salt as an antifoggant in the photosensitive layer. As for such mercury (II) salts favorable for such purpose, mentioned are mercury acetate, and mercury bromide. According to the invention, an amount of mercury to be added is, based on 1 mol of applied silver, preferably in the range of 1 nmol to 1 mmol, and more preferably in the range of 10 nmol to 100 μmol.

The photothermographic material recited in the invention may contain benzoic acids for the purpose of improving the sensitivity and preventing fog. Any kind of benzoic acid derivatives can be used whereupon preferable examples of structures thereof include compounds described, for example, in U.S. Pat. Nos. 4,784,939 and 4,152,160 and in JP-A Nos. 9-281687, 9-329864 and 9-329865. Although the benzoic acids to be used in the invention may be added to any portion of the photosensitive material, an addition to a layer provided on a face having the photosensitive layer is preferable, and the addition to a layer containing the organic silver salt is more preferable. The benzoic acids may be added at any step during the preparation of the coating solution. In the case of addition to the layer containing the organic silver salt, the benzoic acids may be added at any step within a period of from the preparation of the organic silver salt to the preparation of the coating solution whereupon the addition in a period of from completion of preparation of the organic silver salt to immediately before coating is preferable. The benzoic acids may be added in any form of powder, solution, fine particle dispersion and the like. It is also allowable to add the benzoic acids in a form of solution also containing other additives such as a sensitizing dye, reducing agent and toning agent. Although an amount of the benzoic acids to be added can arbitrarily be selected, the amount is, based on 1 mol of silver, preferably in the range of 1 μmol to 2 mol and more preferably 1 mmol to 0.5 mol.

The photothermographic material recited in the invention may contain an azolium salt for the purpose of preventing fog. Examples of such azolium salts include compounds represented by the general formula (XI) described in JP-A No. 59-193447, compounds described in JP-B No. 55-12581, and compounds represented by the general formula (II) described in JP-A No. 60-153039. The azolium salt may be added in any part of the photosensitive material;

however, as for a layer to which the azolium salt is added, the layer on a face having the photosensitive layer is preferable, and the layer containing the organic silver salt is more preferable.

Timing of adding the azolium salt may be in any step during the preparation of a coating solution. When the azolium salt is added to the layer containing the organic silver salt, the azolium salt may be added in any step of from preparation of the organic silver salt to preparation of a coating solution; however, the azolium salt is preferably added during a period of from the completion of the organic silver salt to immediately before a coating operation. As for methods for adding the azolium salt, any addition method, such as that in a powder state, a solution state or a fine particle dispersion state thereof, may be adopted. The azolium salt may also be added in a state of solution mixed with other additives such as a sensitizing dye, a reducing agent and a toning agent.

According to the invention, an amount of the azolium salt to be added may be any amount; however, it is, based on 1 mol of silver, preferably in the range of $1\times10^{-6}$ mol to 2 mol, and more preferably in the range of from $1\times10^{-3}$ mol to 0.5 mol.

5) Plasticizer and Lubricant

Plasticizers and lubricants that can be used in the photothermographic material recited in the invention are described in paragraph [0117] of JP-A No. 11-65021. Sliding agents are described in paragraphs [0061] to [0064] of JP-A No. 11-84573, and paragraphs [0049] to [0062] of JP-A No. 2001-83679.

6) Dye and Pigment

From the standpoint of improving color tones, preventing an interference fringe pattern to be generated by laser light exposure, and preventing irradiation, various kinds of dyes and pigments can be used in the image-forming layer recited in the invention.

Light absorption of the image-forming layer at an exposure wavelength is preferably in the range of 0.1 to 0.6 and more preferably in the range of 0.2 to 0.5. When the absorption is unduly large, Dmin is increased whereupon it becomes difficult to distinguish an image while, when the absorption is unduly small, sharpness of the image is sometimes impaired. Although any method can be employed for imparting a light-absorbing property to the photosensitive silver halide layer recited in the invention, it is preferable to use a dye for such purpose. Any dye can be used so long as the dye satisfies the above-described absorption condition whereupon examples of such dyes include a pyrazoloazole dye, an anthraquinone dye, an azo dye, an azomethine dye, an oxonole dye, a carbocyanine dye, a styryl dye, a triphenylmethane dye, an indoaniline dye, an indophenol dye, and a squarilium dye. Examples of dyes preferably used in the invention include an anthraquinone dye (for example, compounds 1 to 9 described in JP-A No. 5-341441, compounds 3-6 to 3-18 and 8-23 to 8-38 as described in JP-A No. 5-165147), an azomethine dye (for example, compounds 17 to 47 described in JP-A No. 5-341441), an indoaniline dye (for example, compounds 11 to 19 described in JP-A No. 5-289227, a compound 47 described in JP-A No. 5-341441, compounds 2-10 and 2-11 described in JP-A No. 5-165147), an azo dye (for example, compounds 10 to 16 described in JP-A No. 5-341441), and a squarilium dye (for example, compounds 1 to 20 described in JP-A No. 10-104779, and compounds 1a to 3d described in U.S. Pat. No. 5,380,635). As for an addition method of the dye, the dye may be added in any forms of a solution, an emulsion, a solid fine particle dispersion, and a state of being mordanted with a high molecular mordant, is permissible. An amount of the compound to be used is determined in accordance with a desired absorption amount; however, in general, it is preferable that the amount thereof to be used is in the range of 1 $\mu g/m^2$ to 1 $g/m^2$.

Further, light-absorbing substances described in U.S. Pat. Nos. 3,253,921, 2,274,782, 2,527,583, and 2,956,879 are allowed to be contained in the surface protection layer as filter dyes. Also, the dyes can be mordanted as described, for example, in U.S. Pat. No. 3,282,699. An amount of such filter dye to be used is preferably such an amount that corresponds to absorbance at the exposure wavelength of 0.1 to 3, particularly preferably 0.2 to 1.5.

In the photothermographic material recited in the invention, the absorption of one of portions other than the photosensitive silver halide grain-containing layer at the exposure wavelength is preferably in the range of from 0.1 to 3.0, and more preferably 0.3 to 2.0 from the standpoint of halation prevention. The portion having the absorption at the exposure wavelength is preferably a layer (a back layer, a back-face undercoating or underlining layer, or a back layer protecting layer) disposed on a face at the side of a support opposite to the photosensitive silver halide silver grain-containing layer or a layer disposed between the photosensitive silver halide grain-containing layer and the support (an undercoating or underlining layer).

Further, according to the invention, although photosensitive silver halide grains are spectrally sensitized to an infrared region, for imparting the absorption to a portion other than the photosensitive silver halide grain-containing layer, any method may be used whereupon it is preferable that an absorption maximum at a visible region is allowed to be 0.3 or lower. As for the dye used for coloring, dyes that can be used for imparting the absorption to the photosensitive silver halide layer can also be used for coloring such a portion, and the dye may be the same with or different from the dye used for the photosensitive silver halide layer.

7) Ultrahigh Contrast Agent

For the purpose of forming an ultra-hard gradation image appropriate for printing plate making, an ultrahigh contrast agent is preferably added to an image-forming layer. As for such ultrahigh contrast agents, addition methods thereof, and respective amounts thereof to be added, mentioned are paragraph [0118] of JP-A No. 11-65021, paragraphs [0136] to [0193] of JP-A No. 11-223898, compounds represented by the formula (H), the formulae (1) to (3) and the formulae (A) and (B) in JP-A No. 2000-284399, and compounds represented by the general formulae (III) to (V) in JP-A No. 2000-347345 (specifical compounds denoted by Chemicals 21 to 24). Further, high-contrast promoting agents are also described in paragraph [0102] of JP-A No. 11-65021, and paragraph [0194] to [0195] of JP-A No. 11-223898.

When formic acid or a formate is used as a strong fogging substance, it is preferably contained on a side having the image-forming layer containing the photosensitive silver halide preferably in an amount of 5 mmol or less, and more preferably in an amount of 1 mmol or less, based on 1 mol of silver.

When the ultrahigh contrast agent is used in the photothermographic material recited in the invention, it is preferable to use in combination an acid formed by hydration of diphosphorus pentoxide or a salt thereof. As for such acids formed by hydration of phosphorus pentoxide or the salts thereof, mentioned are meta-phosphoric acid (and salts thereof), pyro-phosphoric acid (and salts thereof), ortho-phosphoric acid (and salts thereof, triphosphoric acid (and salts thereof), tetraphosphoric acid (and salts thereof), and hexameta-phosphoric acid (and salts thereof). Acids formed by hydration of phosphorus pentoxide or the salts thereof which are particularly preferably used are ortho-phosphoric acid (and salts thereof) and hexameta-phosphoric acid (and salts thereof). Specific examples of the salts include sodium ortho-phosphate, sodium dihydrogen ortho-phosphate, sodium hexameta-phosphate and ammonium hexameta-phosphate.

An amount of the acid formed by hydration of diphosphorus pentoxide or the salt thereof to be used (in terms of a coated amount based on 1 $m^2$ of the photosensitive material) may be a desired amount, depending on properties of sensitivity, fog, and the like; however, it is preferably in the range of 0.1 $mg/m^2$ to 500 $mg/m^2$, and more preferably in the range of 0.5 $mg/m^2$ to 100 $mg/m^2$.

1-2. Layer Constitution

The photothermographic material recited in the invention may contain a non-photosensitive layer in addition to the image-forming layer. The non-photosensitive layer can be classified according to its position as follows; (a) a surface protective layer formed on the image-forming layer (on a farther side from a support), (b) an intermediate layer formed between a plurality of image-forming layers or between the image-forming layer and the protective layer, (c) an undercoat layer formed between the image-forming layer and the support, and (d) a back layer formed on an opposite side of the image-forming layer.

Further, a layer acting as an optical filter can be formed in the photosensitive material as a layer classified in the above-described (a) or (b). An antihalation layer can be formed in the photosensitive material as a layer classified in the above-described (c) or (d).

1) Surface Protective Layer

The photothermographic material according to the invention may have a surface protective layer for the purpose of preventing adhesion of the image-forming layer and the like. The surface protective layer may be of a single layer or of a plurality of layers.

As for binders of a surface protective layer, any kind of polymers may be used. Examples of the binders include polyester, gelatin, polyvinyl alcohol, and cellulose derivatives whereupon the cellulose derivatives are preferable. Examples of the cellulose derivatives are shown below; however, cellulose derivatives that can be used in the invention is not limited to them. Examples of cellulose derivatives include cellulose acetate, cellulose acetate butyrate, cellulose propionate, hydroxypropyl cellulose, hydroxypropylmethyl cellulose, methyl cellulose, hydroxyethyl cellulose, carboxymethyl cellulose and mixtures thereof. Thickness of the surface protective layer is preferably in the range of 0.1 μm to 10 μm, and particularly preferably 1 μm to 5 μm.

In the surface protective layer, any adhesion-preventing agent may be used. Examples of such adhesion-preventing agents include a wax, liquid paraffin, silica particles, a styrene-containing elastomer-type block copolymer (for example, a styrene-butadiene-styrene copolymer and styrene-isoprene-styrene copolymer), cellulose acetate, cellulose acetate butyrate, cellulose propionate, and the mixture thereof.

2) Antihalation Layer

In the photothermographic material recited in the invention, an antihalation layer can be formed at the farther side from a light source with respect to the photosensitive layer. Such antihalation layers are described, for example, in paragraphs [0123] to [0124] of JP-A No. 11-65021, JP-A Nos. 11-223898, 9-230531, 10-36695, 10-104779, 11-231457, 11-352625, and 11-352626.

The antihalation layer contains an antihalation dye having an absorption in an exposure wavelength. Since the photothermographic material recited in the invention has an exposure wavelength in an infrared region, a dye absorbing an infrared ray may be used. Even in such case, the dye having no auxiliary absorption in a visible wavelength region is preferable.

When antihalation is performed by using a dye having an auxiliary absorption in the visible wavelength region, it is preferable that color of the dye does not remain substantially after an image is formed. Thus, a method of decolorizing the dye by heat of thermal development is preferably employed. A thermally decolorizable dye and a base precursor are preferably added to the non-photosensitive layer to allow the resultant non-photosensitive layer to function as an antihalation layer. Such techniques are described in JP-A No. 11-231457 and the like.

An amount of the decolorizable dye to be added is determined depending on use of the dye. Ordinarily, the decolorizable dye is used in such an amount that an optical density (absorbance) measured at the objective wavelength exceeds 0.1. The optical density is preferably in the range of from 0.2 to 2. An amount of the decolorizable dye for obtaining the above-described optical density is ordinarily in the range of about 0.001 $g/m^2$ to about 1 $g/m^2$.

When the dye is decolorized in such a way, the optical density after thermal development is performed can be lowered to 0.1 or less. Two or more kinds of decolorizable dyes may be used in combination in a thermally decolorizable-type recording material or in the photothermographic material. In a similar way, two or more kinds of base precursors may be used in combination.

In the thermal decolorization using such a decolorizable dye and base precursor as described above, it is preferable from the viewpoint of thermal decolorization properties and the like that a substance (for example, diphenylsulfone, or 4-chlorophenyl (phenyl) sulfone) which decreases a melting point by 3° C. or more when mixed with the base precursor as described in JP-A No. 11-352626 is simultaneously used.

3) Back Layer

Back layers applicable to the invention are described in paragraphs [0128] to [0130] of JP-A No. 11-65021.

A binder in the back layer, being transparent or semi-transparent and ordinarily colorless, may be a natural polymer, a synthetic resin, a synthetic polymer, a synthetic copolymer, and other material which form a film. Its examples include gelatin, gum arabic, poly(vinyl alcohol), hydoxyethyl cellulose, cellulose acetate, cellulose acetate butyrate, poly(vinyl pyrrolidone), casein, starch, poly (acrylic acid), poly(methyl methacrylic acid), poly(vinyl chloride), poly(methacrylic acid), copoly(styrene/maleic acid anhydride), copoly(styrene/acrylonitrile), copoly(styrene/butadiene), poly(vinyl acetal)s (for example, poly(vinyl formal) and poly(vinyl butylal)), poly(ester), poly(urethane)s, a phenoxy resin, poly(vinylidene chloride), poly(epoxide)s, poly(carbonate)s, poly(vinyl acetate), cellulose esters and poly(amide)s. The binders may be provided for film forming, in a form of an aqueous or organic solvent solution, or an emulsion.

According to the invention, a coloring agent having an absorption maximum in the wavelength region of from 300 nm to 450 nm can be added for the purpose of improving silver color tone and improving change of image with passage of time. Such coloring agents are described in, for example, JP-A Nos. 62-210458, 63-104046, 63-103235, 63-208846, 63-306436, 63-314535, 1-61745, and 2001-100363.

The coloring agent is added ordinarily in the range of from 0.1 $mg/m^2$ to 1 $g/m^2$ and preferably added to a back layer provided on the opposite side of the photosensitive layer.

4) Matting Agent

According to the invention, it is preferred to add a matting agent to the surface protective layer and the back layer for improving transportation properties.

As a matting degree of an emulsion surface, any degree is permissible so far as a so-called star dust-like defect in which a small blank area is generated in an image portion to cause a light leakage does not occur; however, a Beck's degree of smoothness is preferably in the range of from 200 seconds to 10000 seconds, and particularly preferably in the range of from 300 seconds to 8000 seconds. The Beck's degree of smoothness can easily be obtained in accordance with "Testing Method for Smoothness of Paper and Paperboard by Beck's Tester" by the Japanese Industrial Standards (JIS) P8119 and the TAPPI Standard Method T479.

According to the invention, the Beck's degree of smoothness as a matting degree for the back layer is preferably in the range of 10 seconds to 250 seconds, and more preferably in the range of 50 seconds to 180 seconds.

According to the invention, the matting agent is preferably contained in an outermost surface layer of the photosensitive material, a layer functioning as the outermost surface layer, or a layer in a neighborhood of the outer surface layer. It is also preferable that the matting agent is contained in a layer functioning as the so-called protective layer.

The matting agent used herein is ordinarily organic or inorganic fine particles which are insoluble in a coating solvent. Any one of matting agents well-known in the art including organic matting agents described, for example, in U.S. Pat. Nos. 1,939,213, 2,701,245, 2,322,037, 3,262,782, 3,539,344, and 3,767,448 and also inorganic matting agents described, for example, in U.S. Pat. Nos. 1,260,772, 2,192,241, 3,257,206, 3,370,951, 3,523,022, and 3,769,020 can be used. Specific examples of organic compounds which can preferably be used as the matting agents include water-dispersible vinyl polymers such as polymethyl acrylate, polymethyl methacrylate, polyacrylonitrile, an acrylonitrile-α-methyl styrene copolymers, polystyrene, a styrene-divinyl benzene copolymer, polyvinyl acetate, polyethylene carbonate, and polytetrafluoroethylene; cellulose derivatives such as methyl cellulose, cellulose acetate, and cellulose acetate propionate; starch derivatives such as carboxystarch, carboxynitrophenyl starch, urea-formaldehyde-starch reaction products; gelatin which has been hardened with a well-known curing agent; and hardened gelatin which has been coacervate-hardened into microcapsulated hollow particles. Specific examples of inorganic compounds which can preferably be used as the matting agents include silicon dioxide, titanium dioxide, magnesium dioxide, aluminum oxide, barium sulfate, calcium carbonate, silver chloride and silver bromide desensitized by a well-known method (for example, glass, and diatomaceous earth). The aforementioned matting agents may be used as a mixture of substances of different kinds if necessary. A size and shape of the matting agent are not particularly limited and the matting agent of any particle diameter may be used. The matting agent having a particle diameter in the range of from 0.1 μm to 30 μm is preferably used in the invention. A particle diameter distribution of the matting agent may be either narrow or broad. Since the haze and surface luster of the photosensitive material are largely affected by the matting agent, it is preferable to control the particle diameter, shape and particle size distribution of the matting agent in accordance with the necessity during preparation of the matting agent. Or such properties can be controlled also by mixing a plurality of matting agents.

5) Hardening Agent

A hardening agent may be used in layers of the photosensitive material recited in the invention such as the photosensitive layer, the protective layer, the back layer and the like recited in the invention. Examples of such hardening agents are found in various methods as described in T. H. James, The Theory of the Photographic Process, 4th edition, Macmillan Publishing Co., Inc., pp. 77 to 87 (1977). In addition to compounds such as chrome alum, sodium salt of 2,4-dichloro-6-hydroxy-s-triazine, N,N-ethylene bis(vinylsulfone acetamide) and N,N-propylene bis(vinylsulfone acetamide), polyvalent metal ions described in the above-cited reference, page 78 and the like, polyisocyanates as described in U.S. Pat. No. 4,281,060, JP-A No. 6-208193 and the like, epoxy compounds as described in U.S. Pat. No. 4,791,042, and vinyl sulfone-type compounds as described in JP-A No. 62-89048 are preferably used.

The hardening agent is added in a state of a solution. Timing of adding such hardening agent solution into the coating solution for the protective layer is during a period of from 180 minutes before coating to immediately before coating, and preferably during a period of from 60 minutes before coating to 10 seconds before coating; however, mixing methods and mixing conditions for the hardening agent solution are not particularly limited so far as the effects recited in the invention are sufficiently realized.

Specific examples of mixing methods include a mixing method using a tank in which an average staying time calculated from an inflow rate and a feeding flow rate to a coater is adjusted to be a desired time, and a mixing method using a static mixer described in N. Harnby, M. F. Edwards and A. W. Nienow, Techniques of Mixing Liquids, translated by Koji Takahashi, Nikkan Kogyo Newspaper (1989), Chapter 8 an the like.

6) Surfactant

In the photothermographic material recited in the invention, a surfactant may be added for the purpose of improving coating properties, charging properties and the like. As for the surfactants, any of nonionic, anionic, cationic and fluorine-type surfactants may be used. Examples of these surfactants include fluorine-type polymeric surfactants as described in, for example, JP-A No. 62-170950 and U.S. Pat. No. 5,380,644, fluorine-type surfactants as described in, for example, JP-A Nos. 60-244945 and 63-188135, polysiloxane-type surfactant as described in U.S. Pat. No. 3,885,965, and a polyalkylene oxide or an anionic surfactant as described in JP-A No. 6-301140.

According to the invention, such fluorine-type surfactant is particularly preferably be used. Specific examples of preferable fluorine-type surfactants include compounds as described in, for example, JP-A Nos. 10-197985, 2000-19680, and 2000-214554. Also, polymeric fluorine-type surfactants as described in JP-A No. 9-281636 are preferably used. According to the invention, the fluorine-type surfactants as described in JP-A No. 2002-82411 are particularly preferably used.

7) Coating Solvent

As for examples of solvents, mentioned are solvents as described in new edition, "*Youzai Pokettobukku*" (Solvent Pocketbook) (published by Ohm Co., Ltd., 1994); however, the invention is by no means limited thereto. Also, a boiling point of a solvent used in the invention is preferably in the range of from 40° C. to 180° C. Specific examples of such solvents include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisol, ethylene glycol diethyl ether, N,N-dimethylformamide, morpholine, propanesultone, perfluorotributylamine, and water.

8) Antistatic Agent

Further, according to the invention, an antistatic layer containing various kinds of known metal oxides or electrically conductive polymers may be provided. The antistatic layer may concurrently functions as the above-described undercoat layer, back layer surface protective layer or the like, or may separately be provided from these layers. Techniques described in paragraphs [0135] of JP-A No. 11-65021, JP-A Nos. 56-143430, 56-143431, 58-62646, and 56-120519, paragraphs [0040] to [0051] of JP-A No. 11-84573, USP. No. 5,575,957, and paragraphs [0078] to [0084] of JP-A No. 11-223898 can be adopted to the antistatic layer.

9) Support

As for supports according to the invention, mentioned are a polyester film, an undercoated polyethylene film, a polyethylene terephthalate film, a polyethylene naphthalate film, a cellulose nitrate film, a cellulose ester film, a polyvinylacetal film, a polycarbonate film, a related or resin material, glass, paper, metal and the like. Further, a flexible substrate, particularly, a paper support partially acetylated or coated with at least one of baryte and an α-olefin polymer, particularly, having from 2 to 10 carbon atoms, such as polyethylene, polypropylene, and an ethylene-butene copolymer can be used. The support may either be transparent or opaque; however, it is preferably transparent.

As for supports, polyester, particularly, polyethylene terephthalate, which has been subjected to a thermal treatment at a temperature of 130° C. to 185° C. in order to relax residual internal stress generated when being biaxially stretched and to eliminate the strain of thermal contraction generated when subjected to the thermal development, is preferably used.

In case of the photothermographic materials for medical diagnosis, the transparent support may be colored with a blue dye (for example, Dye-1 as described in JP-A No. 8-240877) or may not be colored. Specific examples of the supports are described in paragraphs [0134] of JP-A No. 11-65021.

In the supports, undercoat techniques of a water-soluble polyester as described in JP-A No. 11-84574, a styrene-butadiene copolymer as described in JP-A No. 10-186565, vinylidene chloride copolymers as described in JP-A No. 2000-39684, paragraphs [0063] to [0080] of JP-A No. 2001-83679 and the like are preferably applied.

10) Other Additives

To the photothermographic material, an anti-oxidant, a stabilizing agent, a plasticizer, an ultraviolet ray-absorbing agent or a coating assistant may further be added. A solvent described in paragraph [0133] of JP-A No. 11-65021 may be added. Various kinds of these additives are added either to the photosensitive layer or to the non-photosensitive layer. Concerning those additives, WO98/36322, EP-A No. 803764, JP-A Nos. 10-186567 and 10-18568 and the like can be referenced.

11) Coating Method

The photothermographic material recited in the invention may be applied by any method. Various kinds of coating operations may be used and specific examples thereof include extrusion coating, slide coating, curtain coating, dip coating, knife coating, flow coating, and extrusion coating using such a kind of hopper as described in U.S. Pat. No. 2,681,294. Extrusion coating or slide coating as described in Stephen F. Kistler and Peter M. Schweizer, Liquid Film Coating, Chapman & Hall, pp. 399 to 536 (1997) is preferably used. In particular, extrusion coating is preferably used.

12) Wrapping Material

It is preferable that the photothermographic material recited in the invention is hermetically packed by a wrapping material having at least one of a low oxygen permeability and a low moisture permeability in order to prevent photographic properties from being deteriorated at the time of storage before being used, or prevent a product using the photothermographic material from being curled or curly deformed when the product is in roll form. The oxygen permeability at 25° C. is preferably 50 ml/atm/$m^2$·day or less, more preferably 10 ml/atm/$m^2$·day or less, and still more preferably 1.0 ml/atm/$m^2$·day or less. The moisture permeability is preferably 10 g/atm/$m^2$·day or less, more preferably 5 g/atm/$m^2$·day or less, and still more preferably 1 g/atm/$m^2$·day or less. Specific examples of employable wrapping materials in which at least one of the oxygen permeability and the moisture permeability is low include those described in JP-A Nos. 8-254793 and 2000-206653.

13) Other Employable Techniques

As for techniques employable in the photothermographic materials recited in the invention, techniques described in the following references are further cited: EP-A Nos. 803764, and 883022, WO98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, from 10-186569 to 10-186572, 10-197974, 10-197982, 10-197983, from 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, from 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, 2001-348546, and 2000-187298.

14) Color Image Formation

As for methods for obtaining color images using the photothermographic material recited in the invention, mentioned is a method described in page 10, left column, line 48 to page 11, left column, line 40 of JP-A No. 7-13295. Further, as for stabilizers for the color dye images, those illustrated are in UKP No. 1,326,889, U.S. Pat. Nos. 3,432,300, 3,698,909, 3,574,627, 3,573,050, 3,764,337, and 4,042,394 can be used.

In a case of a multi-color photothermographic material, respective image-forming layers are, as described in U.S. Pat. No. 4,460,681, ordinarily maintained in a separate manner from one another by being provided with a functional or non-functional barrier layer between respective image-forming layers.

3. Image Forming Method 3-1. Exposure

The photosensitive material recited in the invention may be exposed by any method; however, it is preferable to use laser light as an exposure source.

The silver halide emulsion having a high silver iodide content recited in the invention has so far had a problem that sensitivity thereof is low. However, it was found that the problem of such low sensitivity is solved by recording with a light having such an intense irradiation as laser light, and use of a stronger light reduces energy consumed for image recording. Thus, aimed sensitivity can be attained by recording with a strong light in a short period of time.

Particularly when an amount of exposure which realizes a maximum density (Dmax) is provided, an amount of light on a surface of the photosensitive material is preferably in the range of from 0.1 $W/mm^2$ tp 100 $W/mm^2$, more preferably in the range of from 0.5 $W/mm^2$ to 50 $W/mm^2$, and most preferably in the range of from 1 $W/mm^2$ to 50 $W/mm^2$.

As for laser light recited in the invention, a gas laser ($Ar^+$, He—Ne, or He—Cd), a YAG laser, a dye laser, a semiconductor laser and the like are preferable. Further, a combination of the semiconductor laser with a second harmonic generating element or the like can also be used. Preferable lasers are, although determined in correspondence to a light-absorption peak wavelength of a spectral sensitizing dye or the like of the photothermographic material, He-Ne laser and red semiconductor laser which radiates red to infrared light, and $Ar^+$, He—Ne, or He—Cd laser, and blue semiconductor laser which radiates blue to green light. In recent years, particularly, a module fabricated by unifying SHG (Second Harmonic Generator) element with the semiconductor laser, or the blue semiconductor laser has been developed, thereby rapidly attracting people's attention to a laser output device in a short wavelength region. Since the blue semiconductor laser is capable of performing ultra-fine image recording, increasing a recording density and obtaining a long-life and consistent output, it is expected that demand for the blue semiconductor laser will be increased.

The peak wavelength of the laser light is, in a case of blue lasers, in the range of 300 nm to 500 nm and preferably in the range of 400 nm to 500 nm whereas, in a case of red to infrared lasers, in the range of 600 nm to 900 nm and preferably in the range of 620 nm to 850 nm.

The laser light is favorably used in a manner in which it is oscillated in a vertical multi-mode by a method such as a high frequency superimposition method.

3-2. Thermal Development

The photothermographic material recited in the invention may be developed by any method. Ordinarily, the photothermographic material which has been subjected to an imagewise exposure is heated to be developed. A development temperature is preferably in the range of 80° C. to 250° C., and more preferably in the range of 100° C. to 140° C.

A development time is preferably in the range of 1 second to 180 seconds, and more preferably in the range of 10 seconds to 90 seconds.

A plate heater system is preferably used as a thermal development method. As for the thermal development process utilizing the plate heater system, processes described in JP-A No. 11-133572 are preferable. These processes use a thermal development apparatus for obtaining a visible image by allowing the photothermographic material, in which a latent image has been formed, to contact a heating unit in a thermal development part. The heating unit comprises a plate heater and a plurality of pressing rollers arranged along one surface of the plate heater such that they face to the surface. The photothermographic material is allowed to pass through between the pressing rollers and the plate heater to be thermally developed. It is preferable that the plate heater is divided into 2 to 6 stages, and that the top stage has a temperature lower than other stages by approximately 1° C. to 10° C.

Such methods are also described in JP-A No. 54-30032. According to these methods, moisture and organic solvents contained in the photothermographic material can be removed out of a system, and deformation of the support of the photothermographic material caused by rapid heating can also be suppressed.

As for other heating methods, the photothermographic material recited in the invention may be provided with a backside resistive heating layer as described in U.S. Pat. Nos. 4,460,681 and 4,374,921 and, then, heated such that the thus-provided backside resistive heating layer is heated by allowing electric current to pass through the layer.

3-3. System

As a laser imager having an exposure part and a thermal development part for medical diagnosis, Fuji Medical Dry Imager FM-DPL (available from Fuji Photo Film Co., Ltd.) can be mentioned. Such system is described in Fuji Medical Review No. 8, pp. 39 to 55 and techniques described therein can be utilized. Further, the photothermographic material recited in the invention can also be applied as a photothermographic material for the laser imager in "AD network" proposed by Fuji Medical System as a network system adapted to DICOM Standards.

4. Application of the Invention

The photothermographic material using a photographic emulsion with high silver iodide content recited in the invention forms a black-and-white image based on a silver image; hence, the photothermographic material is preferably used as a photothermographic material for medical diagnosis, as a photothermographic material for industrial photography, as a photothermographic material for printing use, and as a photothermographic material for COM use.

EXAMPLES

Hereinafter, specific examples are given below to illustrate the invention. However, the invention is by no means limited by the examples.

Example 1

1. Preparation of PET Support and Undercoating 1-1. Film Forming

PET having an intrinsic viscosity IV=0.66 (measured at 25° C. in phenol/tetrachlorethane=6/4 (ratio by weight)) was obtained in accordance with an ordinary preparation method by using terephthalic acid and ethylene glycol. After the thus-obtained PET is pelletized, the resultant pellets were dried at 130° C. for 4 hours. Then, the pellets of PET were melted at 300° C. and allowed to contain 0.04% by weight of Dye BB having a structure described below. Thereafter, the resultant PET was extruded from a T-type die, and rapidly quenched, thereby preparing an unstretched film having a film thickness of 175 μm after thermal fixation.

Dye BB

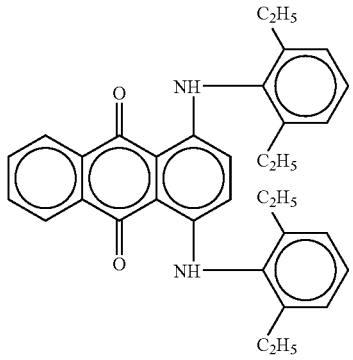

The thus-prepared film was stretched up to 3.3 times in the machine direction with rollers having different peripheral velocities, then up to 4.5 times in the transverse direction by means of a tenter. The temperatures at the time of such stretching were 110° C. and 130° C. respectively. Subsequently, the thus-stretched film was subjected to thermal fixation at 240° C. for 20 seconds and, then, to relaxation by 4% in the transverse direction at the same temperature as at the thermal fixation. Thereafter, chucking parts of the tenter were slit off, and both edges of the film were subjected to knurl processing. The film was rolled at 4 kg/cm$^2$ to obtain a roll of film having a thickness of 175 μm.

1-2. Corona Discharge Surface Treatment

Both surfaces of the support were treated with a solid-state corona processor Model 6 KVA manufactured by Pillar Co., at room temperature at the web handling velocity of 20 m/min. From values of electric current and voltage read at that time, it was found that a treatment of 0.375 kV·A·min/m$^2$ was applied to the support. A treatment frequency was 9.6 kHz and a gap clearance between an electrode and a dielectric roll was 1.6 mm.

2. Preparation of Coating Solution for Back Layer and Application Thereof

To 830 g of MEK, 84.2 g of cellulose acetate butyrate (trade name: CAB381-20; available from Eastman Chemical Co.) and 4.5 g of polyester resin (trade name: Vitel PE2200B; available from Bostic Corp.) were added while stirring MEK and dissolved in MEK. 0.30 g of Dye B was added to the resultant solution, then, 4.5 g of fluorine-type surfactant (trade name: Surflon KH40; available from Asahi Glass Co. Ltd.) and, 2.3 g of fluorine-type surfactant (trade name: Megafag F120K; available from Dainippon Ink & Chemicals Inc.) which have been dissolved in 43.2 g of methanol were added to the solution, and the solution was stirred until they were completely dissolved. To the resultant solution, added was 75 g of silica (trade name: Siloid 64X6000; available from W. R. Grace & Co.), which has been dispersed in methyl ethyl ketone at a concentration of 1% by weight by using a dissolver-type homogenizer, and the solution was stirred to obtain a coating solution for a back layer.

The thus-prepared coating solution for a protective layer for a back face was applied on a support by an extrusion coater such that dry film thickness thereof became to be 3.5 μm and dried. A drying operation was performed by using drying air having a dew point of 10° C. at a temperature of 100° C. for 5 minutes.

3. Image-Forming Layer, Intermediate Layer, and Surface Protective Layer 3-1. Preparation of Material for Coating 1) Preparation of Silver Halide Emulsion To 5,429 ml of water, 88.3 g of phthalated gelatin, 10 ml of a 10% methanol aqueous solution of PAO compound ($HO(CH_2CH_2O)n$-$(CH(CH_3)CH_2O)_{17}$—$(CH_2CH_2O)m$-H; m+n=5 to 7), and 0.32 g of potassium bromide were added and dissolved. 659 ml of a 0.67 mol/l silver nitrate aqueous solution and a solution in which 0.703 mol of KBr and 0.013 mol of KI were dissolved per liter were added to the resultant solution which was kept at 40° C., with a mixing apparatus as described in JP-B Nos. 58-58288 and 58-58289, employing a doupble-jet mixing method while controlling pAg of the solution at 8.09 consuming 4 minutes 45 seconds, to form a nucleus. One minute after the nucleus formation, 20 ml of a 0.63 N potassium hydroxide aqueous solution was added to the resultant mixture. 6 minutes later, 1976 ml of a 0.67 mol/l silver nitrate aqueous solution and a solution in which 0.657 mol of KBr, 0.013 mol of potassium iodide and 30 μmol of dipotassium hexachloroiridate were dissolved per liter were added to the thus-prepared mixuture, employing a doupble-jet mixing method while controlling pAg at 8.09 and a temperature at 40° C. consuming 14 minutes 15 seconds. Thereafter, the resultant mixture was stirred for 5 minutes and cooled down to 38° C.

18 ml of a 56% acetic acid aqueous solution was added to the thus-prepared mixture to allow silver halide emulsion to be precipitated. A supernatant liquid was removed from the mixture leaving 2 liter of a precipitated portion and, then, 10 liter of water was added to the remaining precipitated portion. After the mixture was stirred, the silver halide emulsion was again allowed to be precipitated. Thereafter, a supernatant liquid was removed from the mixture leaving 1.5 liter of a precipitated portion and, then, 10 liter of water was again added to the remaining precipitated portion. After the mixture was stirred, the silver halide emulsion was precipitated. Thereafter, a supernatant liquid was removed from the mixture leaving 1.5 liter of a precipitated portion and, then, a solution in which 1.72 g of anhydrous sodium carbonate was dissolved in 151 ml of water was added to the remaining precipitated portion and heated to 55° C. The resultant mixture was further stirred for 120 minutes. After pH of the mixture was adjusted to be 5.0, the mixture was made up to be 1161 g per mol of silver with water.

The resultant emulsion was found to be monodispersed cubic silver iodide grains in which an average grain size is 40 nm, a variation coefficient of a particle size is 12%, a ratio of [100] face is 92% and a content of silver iodide is 2% by mol.

While keeping the dispersion at 38° C. with stirring, 5 ml of a 0.34% by mass methanol solution of 1,2-benzisothiazoline-3-one was added to the thus-prepared silver halide dispersion, then, the dispersion was heated to 47° C. 20 minutes after the heating, sodium benzene thiosulfonate dissolved in a methanol solution was added to the dispersion in an amount of $7.6\times10^{-5}$ mol per mol of silver. Then, 5 minutes after pAg of the dispersion was adjusted to be 5.5, a tellurium sensitizer (bis(N-phenyl-N-methyl carbamoyl) tellurid) was added to the dispersion in an amount of $5.1\times10^{-4}$ mol per mol of silver and, then, ripened for 84 minutes. 1.3 ml of a 0.8% by mass methanol solution of N,N'-dihydroxy-N"-diethyl melamine was added to the resultant emulsion whose pAg had been adjusted to 7.5 and, 4 minutes later, 5-methyl-2-mercaptobenzimidazole dissolved in methanol was added to the emulsion in an amount of $4.8\times10^{-3}$ mol per mol of silver and 1-phenyl-2-heptyl-5-mercapto-1,3,4-triazole dissolved in methanol was added to the emulsion in an amount of $5.4\times10^{-3}$ mol per mol of silver. The resultant emulsion was denoted as Emulsion 3 (comparative emulsion).

Emulsions 1 and 2 having respective halogen compositions and particle sizes as described below were prepared in the same manner as in the case if Emulsion 3 except for changing respective concentrations of KBr and KI to be used and controlling respective loading temperatures.

| | |
|---|---|
| Emulsion 1 | silver iodide: 100% by mol<br>$AgI_{100}$<br>particle size: 40 nm |
| Emulsion 2 | silver iodide: 90% by mol<br>$AgBr_{10}I_{90}$<br>particle size: 40 nm |
| Emulsion 3 | silver iodide: 2% by mol<br>$AgBr_{98}I_2$<br>particle size: 40 nm |

2) Preparation of Powdered Organic Silver Salt

To 4720 ml of pure water, 0.3776 mol of behenic acid, 0.2266 mol of arachidic acid, 0.1510 mol of stearic acid were added and dissolved at 80° C. and, then, 540.2 ml of a 1.5 N sodium hydroxide aqueous solution was added, thereafter 6.9 ml of concentrated nitric acid was added. Then, the solution was cooled down to 55° C. to obtain a sodium organic acid solution. While maintaining a temperature of the sodium organic acid solution at 55° C., 45.3 g of each of the above-described silver halide emulsions 1, 2, 3, and 4 and 450 ml of pure water were added to the sodium organic acid solution, and thereafter, the solution was stirred with a homogenizer (trade name: ULTRA-TURRAXT-25; available from IKA Japan) at 13200 rpm (21.1 KHz in terms of a mechanical oscillation frequency) for 5 minutes. Next, to the resultant solution, 702.6 ml of a 1 mol/l silver nitrate solution was added consuming 2 minutes, then, the solution was stirred for 10 minutes to obtain an organic silver salt dispersion. Thereafter, the thus-obtained organic silver salt dispersion was transferred to a rinsing vessel, deionized water was added to the dispersion, the dispersion was stirred, and left standstill to allow the organic silver salt dispersion was separated and floated. Thereafter, a water-soluble salts in a lower portion of the resultant emulsion were removed. Subsequently, rinsing of the emulsion with the deionized water and draining was repeated until electric conductivity of drain water became 2 μS/cm. The thus-rinsed emulsion was centrifugally dehydrated and, then, dried at 40° C. by a recirculating-air dryer which blowed a warm air having a partial oxygen pressure of 10% until weight loss ceased to obtain a powdered organic silver salt containing the photosensitive silver halide.

3) Preparation of Dispersion of Organic Silver Salt Containing Photosensitive Silver Halide 14.57 g of polyvinyl butyral powders (trade name: Butvar B-79; available from Monsant Co.) were dissolved in 1457 g of methyl ethyl ketone (MEK) and, while stirring the solution by using a dissolver (trade name: DISPERMAT CA-40M TYPE; available from VMA-GETZMANN Co.), 500 g of the above-obtained powdered organic silver salt was gradually added to the solution and, thereafter, sufficiently mixed to allow the resultant mixture to be a slurry.

The thus-obtained slurry was subjected to a two-pass dispersion treatment with a pressure-type homogenizer (trade name: GM-2 TYPE; available from MMT Co.) to prepare a photosensitive emulsified dispersion. Here, a processing pressure at the time of a one-pass treatment was 280 kg/cm$^2$, while that at the time of a two-pass treatment was 560 kg/cm$^2$.

4) Preparation of Coating Solutions 1 to 32 for Photosensitive Layer 507 g of redispersion of the thus-obtained organic silver salt containing the photosensitive silver halide in an organic solvent was stirred at 13° C. for 15 minutes and, then, 3.9 ml of a 10% by mass methanol solution of pyridinium bromide perbromide (PHP) was added to the redispersion. After stirring the dispersion for 2 hours, 5.2 ml of a 72% by mass methanol solution of potassium bromide was added to the dispersion. After continuously stirred for 30 minutes, 117 g of Butvar B-79 was added to the dispersion. The dispersion was further stirred for 30 minutes, 27.3 g of 1,1-bis(2-hydroxy-3,5-dimethyl phenyl)-2-methyl propane was added to the dispersion as a reducing agent, then, the dispersion was further stirred for 15 minutes. Thereafter, Sensitizing Dye-1 was added to the dispersion in an amount of $1\times10^{-3}$ mol per mol of silver halide, then, the dispersion was stirred for 15 minutes. Subsequently, a solution in which 1.39 g of an aliphatic isocyanate (trade name: Desmodur N3300; available from Mobay Co.) was dissolved in 12.3 g of MEK was added to the dispersion. After further stirred for 15 minutes, the dispersion was heated at 21° C. for 15 minutes.

To 100 g of the resultant dispersion, 2-tribromomethyl sulfonyl pyridine in an amount of 0.03 mol per 1 mol of coated silver, the same mol of Hydrogen bonding Compound-1 with the mol of the reducing agent, Development accelerator-1 in an amount of $5.0\times10^{-3}$ mol per 1 mol of coated silver, and a compound represented by the general formula (1) recited in the invention, a lactone compound, or other sensitizers (kinds and addition amounts as described in Table 1) were added and, then, 2.2 g of 4-chlorobenzophenone-2-carboxylic acid, 0.47 g of 2-chlorobenzoic acid, and 0.47 g of 5-methyl-2-mercaptobenzimidazole were added and, thereafter, the resultant dispersion was stirred for one hour at 21° C. Subsequently, 0.368 g of phthalazine, 0.123 g of tetrachlorophthalic acid and 2 g of Dye-1 were added to the dispersion to obtain a coating solution for the image-forming layer.

5) Preparation of Coating Solution for Surface Protective Layer

To 865 g of MEK which was stirred, 96 g of cellulose acetate butyrate (trade name: CAB171-15; available from Eastman Chemical Co.), 4.5 g of polymethyl methacrylic acid (trade name: Paraloid A-21; available from Rohm & Haas Corp.), 1.5 g of 1,3-di(vinyl sulfonyl)-2-propanol, 1.0 g of benzotriazole, and 1.0 g of fluorine-type surfactant (trade name: Surflon KH40; available from Asahi Glass Co. Ltd.) were added and dissolved therein. 30 g of a dispersion obtained by dispersing a 13.6% by weight of cellulose acetate butyrate (trade name: CAB171-15; available from Eastman Chemical Co.) and a 9% by weight of calcium carbonate (trade name: Super-Pflex 200; available from Speciality Minerals) in MEK with a dissolver-type homogenizer at 8000 rpm for 30 minutes, was added to the solution and then, the solution was stirred to prepare a coating solution for a surface protective layer.

6) Preparation of Coating Solution for Back Layer, and Application thereof.

To 830 g of MEK which was stirred, 84.2 g of cellulose acetate butyrate (trade name: CAB381-20; available from Eastman Chemical Co.) and 4.5 g of polyester resin (trade name: Vitel PE2200B; available from Bostic Corp.) were added and dissolved therein. 0.30 g of Dye B was added to the solution and, then, 4.5 g of fluorine-type surfactant (trade name: Surflon KH40; available from Asahi Glass Co. Ltd.) and, 2.3 g of fluorine-type surfactant (trade name: Megafag F120K; available from Dainippon Ink & Chemicals Inc.) which have been dissolved in 43.2 g of methanol were added to the solution. The solution was stirred to completely dissolve them. To the resultant solution, 75 g of silica (trade name: Siloid 64X6000; available from W. R. Grace & Co.), which has been dispersed in methyl ethyl ketone at a concentration of 1% by weight with a dissolver-type homogenizer was added. The resultant dispersion was stirred to obtain a coating solution for a back layer.

The thus-prepared coating solution for the back layer was applied on a support by an extrusion coater such that a dry film thickness comes to be 3.5 μm and dried. A drying operation was performed at a temperature of 100° C. for 5 minutes by using drying air having a dew point of 10° C.

3-2 Preparation of Photothermographic Material

Respective coating solutions 1 to 32 for the photosensitive layer thus prepared and a coating solution for a surface protective layer were applied on the side of a support opposite to the back layer, on which support a back layer had been coated, in a simultaneous multi-layer coating manner to prepare respective photothermographic materials 1 to 32.

An application operation was performed such that the photosensitive layer had a coated silver amount of 1.9 g/m$^2$ and the surface protective layer had a dry film thickness of 2.5 μm. Therefore, a drying operation was performed at a temperature of 75° C. for 10 minutes by using drying air having a dew point of 10° C.

Next, compounds used in Examples are shown below.

Development accelerator -1

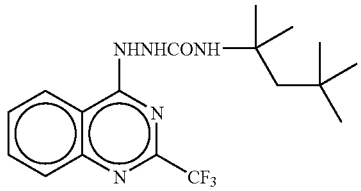

Hydrogen bonding compound -1

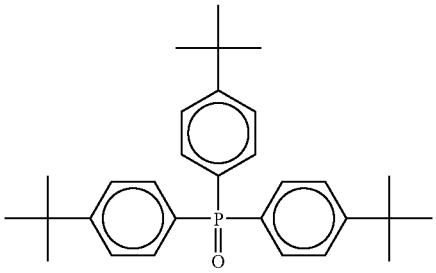

-continued

Sensitizing dye -1

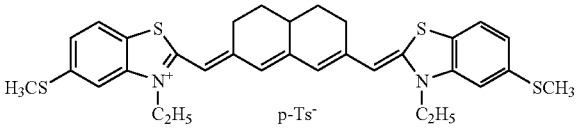

dye -1

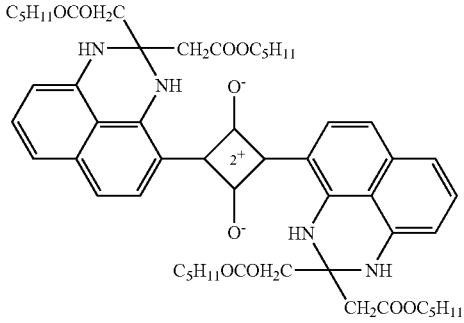

3-3. Exposure and Development

A test-model exposure apparatus was fabricated in which a semiconductor laser emitting laser light oscillated in a vertical multi-mode at a wavelength in the range of from 800 nm to 820 nm by a high frequency superimposition was employed as an exposure light source whereupon the above-prepared samples 1 to 26 were exposed on a side of a face of the image-forming layer with a laser scanning by the thus-fabricated exposure apparatus. Here, an incident angle of such scanning laser light to an exposure face of the photosensitive material was set at 75 degrees, and an image was recorded. Thereafter, thermal development was conducted at 124° C. for 15 seconds, using an automatic processor having a heat drum such that a protective layer of the photosensitive material and a surface of the heat drum came into contact with each other and, then, the resultant image was evaluated with a densitometer. At that time, a room in which exposure and development were conducted was at 23° C. 50% RH.

(Dmin)

Density in a non-image portion was measured by a Macbeth densitometer and designated as Dmin or fog.

(Sensitivity)

Sensitivity was represented by a reciprocal number of exposed amount required for providing a black density of fog+1.0 and is shown as a relative value assuming that the sensitivity of Sample 1 is 100.

(Storability with Passage of Time)

The thus-prepared sample was cut into pieces of a half size (12×20 inch), packaged with a wrapping material described below under conditions of 25° C. 40% RH and, then, heated to 50° C. After the sample was stored for one week, photographic properties were evaluated.

Wrapping Material:

The wrapping material used was a laminate comprising PET: 10 μm/PE: 20 μm/aluminum foil: 9 μm/Ny: 15 μm/polyethylene containing 3% of carbon: 50 μm, and the material has following characteristics:

oxygen permeability: 0.02 ml/atm·m$^2$·day 25° C.; and moisture permeability: 0.10 g/atm·m$^2$·day 25° C.

Sensitivity ($S_2$) after storage under the above-described condition was measured and, then, storability with passage of time was evaluated on the basis of sensitivity difference (ΔS) from the sensitivity ($S_1$) before storage. The smaller absolute value of the sensitivity change (ΔS) indicates better storability with passage of time.

$$\Delta S = S_1 - S_2$$

(Image Storability after Thermal Development and Evaluation of Printout Performance)

A sample carrying an image thereon which has been obtained by thermally developing the photothermographic material recited in the invention was exposed to an illumination intensity of 1000 lux by using a fluorescent light for 7 days in an atmosphere of 30° C. 70% RH. An optical density in a non-image portion thereof was measured. The thus-measured value of the optical density was defined as Dmin2 and a difference (ΔDmin) from that before exposure to the fluorescent light was calculated.

$$\Delta Dmin = Dmin2 - Dmin$$

Smaller increase of Dmin indicates, better image storability.

TABLE 1

| Photo-therm-graphic material | Silver halide emulsion: Emulsion No. 1 | Silver halide emulsion: Halogen composition | Sensitizing Agent of present invention: Kind | Sensitizing Agent of present invention: Addition amount (mol/Ag mol) | Photographic properties: Sensitivity | Photographic properties: Dmin | Storability with time (ΔS) | Image storability after thermal development (ΔDmin) | Remarks |
|---|---|---|---|---|---|---|---|---|---|
| 1 | Emulsion 1 | $AgI_{100}$ | — | — | 100 | 0.16 | 50 | 0.01 | Comparative Example |
| 2 | " | " | General formula (1) No. 1-1 | $3 \times 10^{-3}$ | 480 | 0.17 | 18 | 0.00 | Present invention |
| 3 | " | " | General formula (1) No. 1-2 | $3 \times 10^{-3}$ | 520 | 0.16 | 15 | 0.00 | Present invention |
| 4 | " | " | Lactone No. 2-2 | $5 \times 10^{-3}$ | 500 | 0.16 | 21 | 0.00 | Present invention |
| 5 | " | " | Lactone No. 2-15 | $3 \times 10^{-3}$ | 495 | 0.17 | 20 | 0.00 | Present invention |
| 6 | " | " | Lactone No. 3-1 | $5 \times 10^{-3}$ | 470 | 0.17 | 18 | 0.00 | Present invention |
| 7 | " | " | (82) | $3 \times 10^{-3}$ | 460 | 0.17 | 20 | 0.00 | Present invention |
| 8 | " | " | (84) | $1 \times 10^{-3}$ | 505 | 0.16 | 15 | 0.00 | Present invention |
| 9 | " | " | (20) | $5 \times 10^{-3}$ | 510 | 0.16 | 10 | 0.00 | Present invention |
| 10 | " | " | (19) | $12 \times 10^{-3}$ | 535 | 0.16 | 7 | 0.00 | Present invention |
| 11 | " | " | (71) | $12 \times 10^{-3}$ | 750 | 0.16 | 10 | 0.00 | Present invention |
| 12 | Emulsion 2 | $AgBr_{10}I_{90}$ | General formula (1) No. 1-1 | $3 \times 10^{-3}$ | 432 | 0.17 | 20 | 0.00 | Present invention |
| 13 | " | " | General formula (1) No. 1-2 | $3 \times 10^{-3}$ | 466 | 0.16 | 17 | 0.00 | Present invention |
| 14 | " | " | Lactone No. 2-2 | $5 \times 10^{-3}$ | 450 | 0.16 | 23 | 0.00 | Present invention |
| 15 | " | " | Lactone No. 2-2 | $3 \times 10^{-3}$ | 456 | 0.17 | 22 | 0.00 | Present invention |
| 16 | " | " | Lactone No. 3-1 | $5 \times 10^{-3}$ | 423 | 0.17 | 20 | 0.00 | Present invention |
| 17 | " | " | (82) | $3 \times 10^{-3}$ | 414 | 0.17 | 22 | 0.00 | Present invention |
| 18 | " | " | (84) | $1 \times 10^{-3}$ | 456 | 0.16 | 17 | 0.00 | Present invention |
| 19 | " | " | (20) | $5 \times 10^{-3}$ | 459 | 0.16 | 11 | 0.00 | Present invention |
| 20 | " | " | (19) | $12 \times 10^{-3}$ | 482 | 0.16 | 9 | 0.00 | Present invention |
| 21 | " | " | (71) | $12 \times 10^{-3}$ | 676 | 0.16 | 12 | 0.00 | Present invention |
| 22 | Emulsion 3 | $AgBr_{98}I_2$ | — | — | 250 | 0.20 | 20 | 0.15 | Comparative Example |
| 23 | " | " | General formula (1) No. 1-1 | $3 \times 10^{-3}$ | 265 | 0.22 | 19 | 0.18 | Present invention |
| 24 | " | " | General formula (1) No. 1-2 | $3 \times 10^{-3}$ | 272 | 0.23 | 17 | 0.20 | Present invention |
| 25 | " | " | Lactone No. 2-2 | $5 \times 10^{-3}$ | 285 | 0.23 | 22 | 0.19 | Present invention |
| 26 | " | " | Lactone No. 2-15 | $3 \times 10^{-3}$ | 255 | 0.24 | 23 | 0.22 | Present invention |
| 27 | " | " | Lactone No. 3-1 | $5 \times 10^{-3}$ | 252 | 0.22 | 21 | 0.20 | Present invention |
| 28 | " | " | (82) | $3 \times 10^{-3}$ | 255 | 0.23 | 18 | 0.18 | Present invention |
| 29 | " | " | (84) | $1 \times 10^{-3}$ | 260 | 0.22 | 19 | 0.21 | Present invention |

TABLE 1-continued

| Photo-therm-graphic material | Silver halide emulsion: Emulsion No. 1 | Silver halide emulsion: Halogen composition | Sensitizing Agent of present invention: Kind | Sensitizing Agent of present invention: Addition amount (mol/Ag mol) | Photographic properties: Sensitivity | Photographic properties: Dmin | Storability with time (ΔS) | Image storability after thermal development (ΔDmin) | Remarks |
|---|---|---|---|---|---|---|---|---|---|
| 30 | " | " | (20) | $5 \times 10^{-3}$ | 272 | 0.21 | 15 | 0.22 | Present invention |
| 31 | " | " | (19) | $12 \times 10^{-3}$ | 282 | 0.22 | 13 | 0.21 | Present invention |
| 32 | " | " | (71) | $12 \times 10^{-3}$ | 350 | 0.23 | 20 | 0.22 | Present invention |

The results are shown in Table 1. As is apparent from the results, it is found that the photothermographic material recited in the invention has high sensitivity and excellent storability with passage of time and, further, excellent image storability after a thermal development. Particularly, the compound represented by the general formula (1) recited in the invention, the lactone compound, and the reducible compound having an adsorptive group cause an increase of fog and deteriorate the image storability when combined with Emulsion 3 in which the content of silver iodide is low; on the other hand, when combined with Emulsions 1 and 2 in which the content of silver iodide is high, these compounds do not cause such impairments and exert an extremely advantageous effect such that a favorable image storability is maintained and higher sensitivity is attained.

Example 2

1) Preparation of Coating Solution for Photosensitive Layer

As shown in Example 1, to 500 g of each of dispersions of organic silver salt containing respective Emulsions 1 to 3, 100 g of MEK was added with stirring in an atmosphere of a nitrogen gas flow, and stored at 24° C. Thereafter, to the resultant mixture, 2.5 ml of a 10% by mass methanol solution of Antifoggant-1 described below was added and then, stirred for 15 minutes. Thereafter, to the resultant solution, 1.8 ml of a methanol solution in which 20% by mass of a dye-adsorption assistant and 10% by mass of potassium acetate are contained was added and then, stirred for 15 minutes. Next, to the resultant mixture, a Sensitizing Dye-2 in an amount of $1.0\times10^{-3}$ mol per mol of silver halide, 7 ml of a mixed solution of 4-chloro-2-benzoyl benzoic acid and 5-methyl-2-mercaptobenzimidazole as a super-sensitizer (mixing ratio=25:2 by mass; a methanol solution of 3.0% by mass in total), 2-tribromomethylsulfonyl quinoline in an amount of 0.03 mol per mol of coated silver, and a compound represented by the general formula (1) recited in the invention, a lactone compound, or other sensitizing agents (kinds and addition amount are shown in Table 2) were added, then, the mixture was stirred for one hour, cooled down to 13° C. and, then, stirred again for 30 minutes. While the mixture was maintained at 13° C., 48 g of polyvinylbutyral was added to the mixture and sufficiently dissolved. Then, the following additives were added to the mixture. These operations were all conducted under a nitrogen gas flow.

| | |
|---|---|
| Phthalazine | 1.5 g |
| Tetrachlorophthalic acid | 0.5 g |
| 4-methylphthalic acid | 0.5 g |
| Antifoggant-2 | 0.9 g |
| Hydrogen bonding compound-1 | 0.67 g |
| Development accelerator-1 | 0.046 g |
| Development accelerator-2 | 0.039 g |
| Dye 2 | 2.0 g |
| Reducing agent (1,1-bis(2-hydroxy-3,5-dimethyl phenyl)-2-methyl propane) | 15 g |
| Desmodur N3300 (aliphatic isocyanate; available from Mobay Co.) | 1.10 g |

Dye adsorption assistant

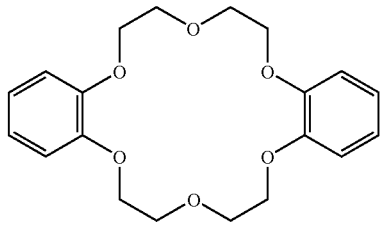

Antifoggant 1

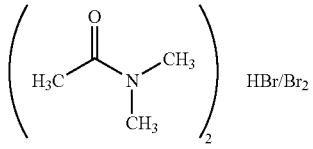

Dye 2

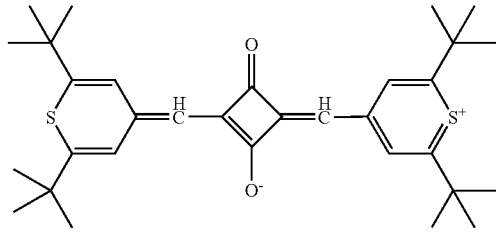

Antfoggant 2

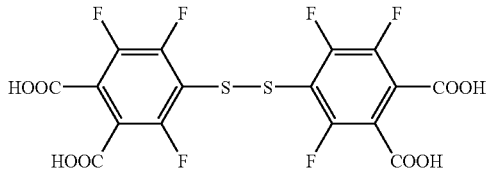

-continued

Sensitizing dye -2

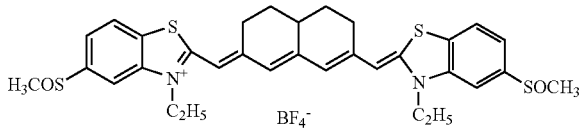

Development accelerator -2

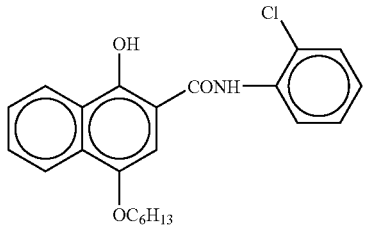

4) Coating

Image-Forming Layer:

The above-described coating solution for the image-forming layer was applied on the same support with that in Example 1 such that an amount of coated silver was 1.8 g/m$^2$ and polyvinyl buryral as a binder was 8.5 g/m$^2$.

Surface Protective Layer:

A coating solution described below was applied such that wet coating thickness became 100 μm.

| | |
|---|---|
| Acetone | 175 ml |
| 2-propanol | 40 ml |
| Methanol | 15 ml |
| Cellulose acetate | 8 g |
| Phthalazine | 1.5 g |
| 4-methyl phthalazine | 0.72 g |
| Tetrachlorophthalic acid | 0.22 g |
| Tetrachlorophthalic anhydride | 0.5 g |
| Monodispersed silica having an average grain size of 4 μm (variation coefficient: 20%) | 1% by mol with respect to the binder |
| The same fluorine-type surfactant with that in Example 1 | 0.5 g |

2) Exposure and Thermal Developing Processing

Exposure and thermal development were conducted in the same manner as in Example 1.

Performance of the obtained image was measured in the same manner as in Example 1 and the results are shown in Table 2

TABLE 2

| Photo-therm-graphic material | Silver halide emulsion: Emulsion No. 1 | Silver halide emulsion: Halogen composition | Sensitizing Agent of present invention: Kind | Sensitizing Agent of present invention: Addition amount (mol/Ag mol) | Photographic properties: Sensitivity | Photographic properties: Dmin | Storability with time (ΔS) | Image storability after thermal development (ΔDmin) | Remarks |
|---|---|---|---|---|---|---|---|---|---|
| 2-1 | Emulsion 1 | AgI100 | — | — | 100 | 0.20 | 70 | 0.01 | Comparative Example |
| 2-2 | " | " | General formula (1) No. 1-1 | $3 \times 10^{-3}$ | 450 | 0.19 | 38 | 0.00 | Present invention |
| 2-3 | " | " | General formula (1) No. 1-2 | $3 \times 10^{-3}$ | 490 | 0.18 | 35 | 0.00 | Present invention |
| 2-4 | " | " | Lactone No. 2-2 | $5 \times 10^{-3}$ | 470 | 0.18 | 41 | 0.00 | Present invention |
| 2-5 | " | " | Lactone No. 2-15 | $3 \times 10^{-3}$ | 465 | 0.19 | 40 | 0.00 | Present invention |
| 2-6 | " | " | Lactone No. 3-1 | $5 \times 10^{-3}$ | 440 | 0.19 | 38 | 0.00 | Present invention |
| 2-7 | " | " | (82) | $3 \times 10^{-3}$ | 430 | 0.19 | 40 | 0.00 | Present invention |
| 2-8 | " | " | (84) | $1 \times 10^{-3}$ | 475 | 0.18 | 35 | 0.00 | Present invention |
| 2-9 | " | " | (20) | $5 \times 10^{-3}$ | 480 | 0.18 | 40 | 0.00 | Present invention |
| 2-10 | " | " | (19) | $12 \times 10^{-3}$ | 495 | 0.18 | 30 | 0.00 | Present invention |
| 2-11 | " | " | (71) | $12 \times 10^{-3}$ | 725 | 0.18 | 38 | 0.00 | Present invention |
| 2-12 | Emulsion 2 | $AgBr_{10}I_{90}$ | General formula (1) No. 1-1 | $3 \times 10^{-3}$ | 402 | 0.19 | 40 | 0.00 | Present invention |
| 2-13 | " | " | General formula (1) No. 1-2 | $3 \times 10^{-3}$ | 436 | 0.18 | 37 | 0.00 | Present invention |
| 2-14 | " | " | Lactone No. 2-2 | $5 \times 10^{-3}$ | 420 | 0.18 | 43 | 0.00 | Present invention |
| 2-15 | " | " | Lactone No. 2-2 | $3 \times 10^{-3}$ | 426 | 0.19 | 42 | 0.00 | Present invention |
| 2-16 | " | " | Lactone No. 3-1 | $5 \times 10^{-3}$ | 393 | 0.19 | 40 | 0.00 | Present invention |
| 2-17 | " | " | (82) | $3 \times 10^{-3}$ | 384 | 0.19 | 42 | 0.00 | Present invention |

TABLE 2-continued

| Photo-therm-graphic material | Silver halide emulsion Emulsion No. 1 | Halogen composition | Sensitizing Agent of present invention Kind | Addition amount (mol/Ag mol) | Photographic properties Sensitivity | Dmin | Storability with time (ΔS) | Image storability after thermal development (ΔDmin) | Remarks |
|---|---|---|---|---|---|---|---|---|---|
| 2-18 | " | " | (84) | $1 \times 10^{-3}$ | 426 | 0.18 | 37 | 0.00 | Present invention |
| 2-19 | " | " | (20) | $5 \times 10^{-3}$ | 426 | 0.18 | 31 | 0.00 | Present invention |
| 2-20 | " | " | (19) | $12 \times 10^{-3}$ | 435 | 0.18 | 25 | 0.00 | Present invention |
| 2-21 | " | " | (71) | $12 \times 10^{-3}$ | 622 | 0.18 | 42 | 0.00 | Present invention |
| 2-22 | Emulsion 3 | $AgBr_{98}I_2$ | — | — | 220 | 0.22 | 5 | 0.18 | Comparative Example |
| 2-23 | " | " | General formula (1) No. 1-1 | $3 \times 10^{-3}$ | 235 | 0.24 | 39 | 0.21 | Present invention |
| 2-24 | " | " | General formula (1) No. 1-2 | $3 \times 10^{-3}$ | 242 | 0.25 | 37 | 0.23 | Present invention |
| 2-25 | " | " | Lactone No. 2-2 | $5 \times 10^{-3}$ | 235 | 0.25 | 42 | 0.22 | Present invention |
| 2-26 | " | " | Lactone No. 2-15 | $3 \times 10^{-3}$ | 225 | 0.26 | 43 | 0.25 | Present invention |
| 2-27 | " | " | Lactone No. 3-1 | $5 \times 10^{-3}$ | 222 | 0.24 | 41 | 0.23 | Present invention |
| 2-28 | " | " | (82) | $3 \times 10^{-3}$ | 225 | 0.25 | 38 | 0.21 | Present invention |
| 2-29 | " | " | (84) | $1 \times 10^{-3}$ | 230 | 0.24 | 39 | 0.24 | Present invention |
| 2-30 | " | " | (20) | $5 \times 10^{-3}$ | 242 | 0.23 | 35 | 0.25 | Present invention |
| 2-31 | " | " | (19) | $12 \times 10^{-3}$ | 252 | 0.23 | 30 | 0.24 | Present invention |
| 2-32 | " | " | (71) | $12 \times 10^{-3}$ | 325 | 0.24 | 42 | 0.25 | Present invention |

The samples according to the invention has high sensitivity to a laser exposure similar to Example 1, small fog, and extremely favorable image storability.

Example 3

Photothermographic materials 3-1 to 3-32 were prepared in the same manner as in Example 1 except that Sensitizing Dye-1 was not used.

The thus-prepared samples were exposed by xenon flash light via a light coherent filter having a peak at a wavelength of 410 nm, through a stepwedge for an illumination period of $10^{-6}$ second. This exposure condition is suitable for evaluating a performance toward a blue-color semiconductor lazer.

After exposed, samples were subjected to thermal development at 124° C. for 15 seconds with an automatic processor having a heat drum in a manner similar to that in Example 1 such that a protective layer of the photosensitive material and a surface of the drum were allowed to contact with each other. The obtained results were evaluated in the same manner as in Example 1 and are shown in Table 3.

TABLE 3

| Photo-therm-graphic material | Silver halide emulsion Emulsion No. 1 | Halogen composition | Sensitizing Agent of present invention Kind | Addition amount (mol/Ag mol) | Photographic properties Sensitivity | Dmin | Storability with time (ΔS) | Image storability after thermal development (ΔDmin) | Remarks |
|---|---|---|---|---|---|---|---|---|---|
| 3-1 | Emulsion 1 | $AgI_{100}$ | — | — | 100 | 0.18 | 80 | 0.01 | Comparative Example |
| 3-2 | " | " | General formula (1) No. 1-1 | $3 \times 10^{-3}$ | 510 | 0.17 | 13 | 0.00 | Present invention |
| 3-3 | " | " | General formula (1) No. 1-2 | $3 \times 10^{-3}$ | 550 | 0.16 | 10 | 0.00 | Present invention |
| 3-4 | " | " | Lactone No. 2-2 | $5 \times 10^{-3}$ | 530 | 0.16 | 16 | 0.00 | Present invention |
| 3-5 | " | " | Lactone No. 2-15 | $3 \times 10^{-3}$ | 525 | 0.7 | 15 | 0.00 | Present invention |
| 3-6 | " | " | Lactone No. 3-1 | $5 \times 10^{-3}$ | 500 | 0.17 | 13 | 0.00 | Present invention |

TABLE 3-continued

| Photo-therm-graphic material | Silver halide emulsion: Emulsion No. 1 | Silver halide emulsion: Halogen composition | Sensitizing Agent of present invention: Kind | Sensitizing Agent of present invention: Addition amount (mol/Ag mol) | Photographic properties: Sensitivity | Photographic properties: Dmin | Storability with time (ΔS) | Image storability after thermal development (ΔDmin) | Remarks |
|---|---|---|---|---|---|---|---|---|---|
| 3-7 | " | " | (82) | $3 \times 10^{-3}$ | 490 | 0.17 | 15 | 0.00 | Present invention |
| 3-8 | " | " | (84) | $1 \times 10^{-3}$ | 535 | 0.16 | 10 | 0.00 | Present invention |
| 3-9 | " | " | (20) | $5 \times 10^{-3}$ | 540 | 0.16 | 5 | 0.00 | Present invention |
| 3-10 | " | " | (19) | $12 \times 10^{-3}$ | 550 | 0.16 | 4 | 0.00 | Present invention |
| 3-11 | " | " | (71) | $12 \times 10^{-3}$ | 750 | 0.16 | 15 | 0.00 | Present invention |
| 3-12 | Emulsion 2 | $AgBr_{10}I_{90}$ | General formula (1) No. 1-1 | $3 \times 10^{-3}$ | 462 | 0.17 | 15 | 0.00 | Present invention |
| 3-13 | " | " | General formula (1) No. 1-2 | $3 \times 10^{-3}$ | 496 | 0.16 | 12 | 0.00 | Present invention |
| 3-14 | " | " | Lactone No. 2-2 | $5 \times 10^{-3}$ | 480 | 0.16 | 18 | 0.00 | Present invention |
| 3-15 | " | " | Lactone No. 2-2 | $3 \times 10^{-3}$ | 486 | 0.17 | 17 | 0.00 | Present invention |
| 3-16 | " | " | Lactone No. 3-1 | $5 \times 10^{-3}$ | 453 | 0.17 | 15 | 0.00 | Present invention |
| 3-17 | " | " | (82) | $3 \times 10^{-3}$ | 444 | 0.17 | 17 | 0.00 | Present invention |
| 3-18 | " | " | (84) | $1 \times 10^{-3}$ | 486 | 0.16 | 12 | 0.00 | Present invention |
| 3-19 | " | " | (20) | $5 \times 10^{-3}$ | 489 | 0.16 | 6 | 0.00 | Present invention |
| 3-20 | " | " | (19) | $12 \times 10^{-3}$ | 492 | 0.16 | 4 | 0.00 | Present invention |
| 3-21 | " | " | (71) | $12 \times 10^{-3}$ | 750 | 0.16 | 18 | 0.00 | Present invention |
| 3-22 | Emulsion 3 | $AgBr_{98}I_2$ | — | — | 200 | 0.2 | 25 | 0.15 | Comparative Example |
| 3-23 | " | " | General formula (1) No. 1-1 | $3 \times 10^{-3}$ | 215 | 0.22 | 24 | 0.18 | Present invention |
| 3-24 | " | " | General formula (1) No. 1-2 | $3 \times 10^{-3}$ | 222 | 0.23 | 22 | 0.20 | Present invention |
| 3-25 | " | " | Lactone No. 2-2 | $5 \times 10^{-3}$ | 215 | 0.23 | 27 | 0.19 | Present invention |
| 3-26 | " | " | Lactone No. 2-15 | $3 \times 10^{-3}$ | 205 | 0.24 | 28 | 0.22 | Present invention |
| 3-27 | " | " | Lactone No. 3-1 | $5 \times 10^{-3}$ | 202 | 0.22 | 26 | 0.20 | Present invention |
| 3-28 | " | " | (82) | $3 \times 10^{-3}$ | 205 | 0.23 | 23 | 0.18 | Present invention |
| 3-29 | " | " | (84) | $1 \times 10^{-3}$ | 210 | 0.22 | 24 | 0.21 | Present invention |
| 3-30 | " | " | (20) | $5 \times 10^{-3}$ | 222 | 0.21 | 20 | 0.22 | Present invention |
| 3-31 | " | " | (19) | $12 \times 10^{-3}$ | 235 | 0.21 | 18 | 0.21 | Present invention |
| 3-32 | " | " | (71) | $12 \times 10^{-3}$ | 320 | 0.22 | 27 | 0.22 | Present invention |

The samples according to the invention has high sensitivity to a blue-color laser exposure, small fog, and extremely favorable image storability.

Therefore, a photothermographic material having high sensitivity to laser exposure and excellent image storability can be obtained.

What is claimed is:

1. A photothermographic material comprising, on one surface of a support, a photosensitive silver halide, a non-photosensitive organic silver salt, a reducing agent for a silver ion, and a binder, which are applied to the support using an organic solvent, wherein the photosensitive silver halide has a silver iodide content of 40% by mol to 100% by mol, the photothermographic material further comprises a compound having a β-lactam ring, and the compound having a β-lactam ring is a penicillin or a cephalosporin.

2. The photothermographic material according to claim 1, wherein the penicillin is represented by formula (2), and the cephalosporin is represented by formula (3):

General formula (2)

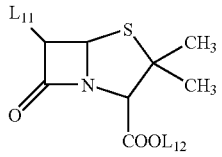

General formula (3)

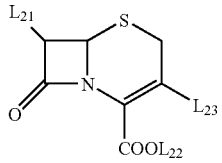

wherein in formulae (2) and (3), $L_{11}$ and $L_{21}$ each independently represent an amino group or a substituted amino group;

$L_{12}$ and $L_{22}$ each independently represent a hydrogen atom, an alkaline metal ion, a quaternary ammonium ion, a hydrocarbon, or a heterocyclic residue; and $L_{23}$ represents a hydrogen atom, a halogen atom, an amino group, a hydroxyl group, a mercapto group, an alkyl group, an alkoxy group, an aryloxy group, an alkylthio group, an arylthio group, an acyloxy group, an acylthio group, a formyl group, or a heterocyclic residue.

3. The photothermographic material according to claim 2, wherein in formulae (2) and (3), $L_{11}$ and $L_{21}$ each independently represent an amino group or an acylamino group;

$L_{21}$ and $L_{22}$ each independently represent a hydrogen atom, an alkaline metal ion, or an ammonium ion; and $L_{23}$ represents a non-substituted or substituted alkyl group.

4. A photothermographic material comprising, on one surface of a support, a photosensitive silver halide, a non-photosensitive organic silver salt, a reducing agent for a silver ion, and a binder, which are applied to the support using an organic solvent, wherein the phot sensitive silver halide has a silver iodide content of 40% by mol to 100% by mol, and the photothermographic material further comprises a compound having a β-lactam ring.

5. The photothermographic material according to claim 4, wherein an average grain diameter of the photosensitive silver halide is from 5 nm to 80 nm.

6. The photothermographic material according to claim 4, wherein a silver iodide content of the photosensitive silver halide is from 90% by mol to 100% by mol.

7. The photothermographic material according to claim 4 comprising, as the binder, polyvinyl butyral in an amount of 50% by weight to 100% by weight based on a total binder component in a photosensitive layer which is provided on the support.

* * * * *